US005306609A

United States Patent [19]

Mihayashi et al.

[11] Patent Number: 5,306,609

[45] Date of Patent: * Apr. 26, 1994

[54] SILVER HALIDE COLOR PHOTOGRAPHIC MATERIAL

[75] Inventors: Keiji Mihayashi; Takayoshi Kamio, both of Kanagawa, Japan

[73] Assignee: Fuji Photo Film Co., Ltd., Kanagawa, Japan

[ * ] Notice: The portion of the term of this patent subsequent to Mar. 16, 2010 has been disclaimed.

[21] Appl. No.: 846,955

[22] Filed: Mar. 6, 1992

[30] Foreign Application Priority Data

Mar. 8, 1991 [JP] Japan ..... 3-67807

[51] Int. Cl.[5] ..... G03C 1/08; G03C 7/26; G03C 7/32

[52] U.S. Cl. ..... 430/557; 430/549; 430/957

[58] Field of Search ..... 430/557, 957, 549

[56] References Cited

U.S. PATENT DOCUMENTS

| | | | |
|---|---|---|---|
| Re. 27,848 | 12/1973 | Weissberger | 407/105 |
| 3,265,506 | 5/1964 | Weissberger et al. | 430/556 |
| 4,146,396 | 3/1979 | Yokota et al. | 430/385 |
| 4,149,886 | 4/1979 | Tanaka et al. | 430/382 |
| 4,248,961 | 2/1991 | Hagen et al. | 430/381 |
| 4,268,591 | 5/1981 | Tschopp | 430/17 |
| 4,289,847 | 9/1981 | Ishikawa et al. | 430/389 |
| 4,980,267 | 12/1990 | Taber | 430/549 |
| 4,992,360 | 2/1991 | Tsuruta et al. | 430/556 |

FOREIGN PATENT DOCUMENTS

| | | |
|---|---|---|
| 0447920A1 | 9/1991 | European Pat. Off. . |
| 2213461 | 11/1972 | Fed. Rep. of Germany . |
| 56161543 | 12/1991 | Japan . |
| 56164343 | 12/1991 | Japan . |
| 1204680 | 9/1970 | United Kingdom . |

OTHER PUBLICATIONS

Chemical Abstracts, vol. 115, No. 3, Abstracts 22252 & 22253 (1991).

*Primary Examiner*—Charles L. Bowers, Jr.
*Assistant Examiner*—Geraldine Letscher
*Attorney, Agent, or Firm*—Birch, Stewart, Kolasch & Birch

[57] ABSTRACT

A silver halide color photographic material comprising a support having thereon at least one light-sensitive silver halide emulsion layer, wherein the silver halide color photographic material comprises i) a nondiffusive coupler represented by the general formula (I) or (II):

(I)

(II)

and ii) an acyl acetamide coupler comprising, as an acyl group, a group represented by the general formula (A)

(A)

The silver halide color photographic material provides a high color density and exhibits a small fluctuation of photographic performance during preservation thereof and improved color image fastness and color reproducibility.

19 Claims, No Drawings

SILVER HALIDE COLOR PHOTOGRAPHIC MATERIAL

FIELD OF THE INVENTION

The present invention relates to a silver halide color photographic material which provides high color density and exhibits a small fluctuation in photographic performance during preservation, and improved color image fastness and color reproducibility.

BACKGROUND OF THE INVENTION

For silver halide color photographic materials (hereinafter simply referred to as light-sensitive materials), particularly those for photographing, it is required to have high sensitivity, to not exhibit fluctuation of photographic performance during preservation of the light-sensitive materials, and to have excellent image quality (color reproducibility, sharpness and granularity) and preservability of the color images formed.

As yellow couplers for forming color photographic images in the subtractive color process, acyl acetamide couplers typically include benzoyl acetanilides and pivaloyl acetanilides. The former couplers are mainly utilized in color light-sensitive materials for photographing which require a high sensitivity, since they ordinarily have a high coupling activity with an oxidation product of an aromatic primary amine developing agent in color development, and since the molecular extinction coefficient of yellow dyes formed therefrom is large in comparison with that of yellow dyes formed from the latter couplers. On the other hand, the latter yellow couplers are mainly utilized in color papers or in color reversal photographic materials, because they are superior to the former couplers in view of their spectral absorption characteristics and the fastness of the yellow dyes formed therefrom.

As described above, although benzoyl acetanilide type couplers have a high coupling reactivity with an oxidation product of an aromatic primary amine developing agent in color development, and a somewhat large molecular extinction coefficient of yellow dyes formed therefrom as compared with pivaloyl acetanilide couplers, they have problems in that the spectral absorption characteristics and the fastness of the yellow color images formed therefrom are poor. When the couplers have a high coupling reactivity and a large molecular extinction coefficient of the dyes formed therefrom, it becomes possible to provide high sensitivity, gradation and color density, and to bring about a so-called high color forming property. The excellent spectral absorption characteristics of the yellow color image results, for example, in a low absorption density on the longer wavelength side of the absorption spectrum, and in small undesirable absorption in the green region.

Therefore, it has been desirable to develop a yellow coupler which provides not only a high color density due to a high molecular extinction coefficient of the dye formed, but also a color image having excellent spectral absorption characteristics and fastness.

Acyl groups of the acyl acetanilide couplers, include a pivaloyl group, a 7,7-dimethylnorbornane-1-carbonyl group and an 1-methylcyclohexane-1-carbonyl group as described in U.S. Pat. No. 3,265,506, and a cyclopropane-1-carbonyl group and a cyclohexane-1-carbonyl group as described in JP-A-47-26133 (the term "JP-A" as used herein means an unexamined published Japanese patent application). However, these couplers are disadvantageous in that they have poor coupling reactivity, the molecular extinction coefficient of dyes formed therefrom are low, the spectral absorption characteristics of the color image formed are poor, or the fastness of color image formed is poor.

Further, benzoyl acetanilide or pivaloyl acetanilide couplers having an oil-soluble diffusion resistant group in their molecules, which are representative examples of acyl acetanilide couplers, have the problem that the above-described color forming property is degraded when the amount of a high-boiling point organic solvent added per unit weight of the coupler is small in a process for the production of a color light-sensitive material in which the coupler is mixed with a high-boiling point organic solvent, dissolved therein, and then finely dispersed to prepare a dispersion, and the resulting coupler dispersion is mixed with a silver halide emulsion.

On the other hand, malondiamide couplers which are relevant to one of the yellow couplers according to the present invention are described in French Patent 1,558,452. However, the couplers described therein are so-called O-releasing type couplers which have a group capable of being released through an oxygen atom at their active position and are predominantly diffusible couplers. Also, as functional couplers of malondiamide couplers, development inhibitor releasing (DIR) couplers are described, for example, in JP-A-52-69624, JP-A-52-82424, JP-A-57-151944 and JP-A-2-250053. However specific examples of the compounds are not described in JP-A-52-82424 and JP-A-57-151944, and the effect is not specifically described in JP-A-52-69624. Further, it has been found that the couplers described in the above described patents have some problems with respect to color forming preservability of the light-sensitive materials containing them, and color image fastness.

SUMMARY OF THE INVENTION

Therefore, an object of the present invention is to provide a silver halide color photographic material which provides high color density and has excellent color image fastness.

Another object of the present invention is to provide a silver halide color photographic material having improved image quality.

A further object of the present invention is to provide a silver halide color photographic material having improved preservability.

Other objects of the present invention will become apparent from the following detailed description and examples.

These objects of the present invention can be accomplished with a silver halide color photographic material comprising a support having thereon at least one light-sensitive silver halide emulsion layer, wherein the silver halide color photographic material contains a nondiffusive coupler represented by the general formula (I) or (II) described below:

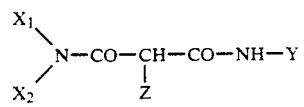

(I)

-continued

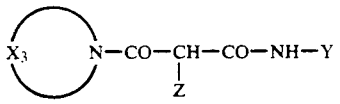

(II)

wherein $X_1$ and $X_2$ each represents an aliphatic or alicyclic hydrocarbon residue, an aryl group or a heterocyclic group; $X_3$ represents an organic moiety necessary to form a nitrogen-containing heterocyclic group together with >N—; Y represents an aryl group or a heterocyclic group; Z represents a group capable of being released upon a reaction with an oxidation product of a developing agent; and the coupler may be in the form of a dimer, a higher polymer or a biscompound which is formed at $X_1$, $X_2$, $X_3$, Y or Z; and an acyl acetamide yellow coupler containing, as an acyl group, a group represented by the general formula (A) described below:

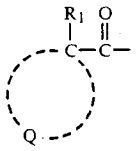

(A)

wherein $R_1$ represents a mono-valent group; Q represents a non-metallic atomic group necessary to form a 3- to 5-membered hydrocarbon ring or a 3- to 5-membered heterocyclic ring containing at least one hetero atom selected from N, O, S and P as a ring-forming member together with C, provided that $R_1$ is not a hydrogen atom and does not combine with Q to form a ring; and the coupler may be in the form of a dimer, a higher polymer or a biscompound.

DETAILED DESCRIPTION OF THE INVENTION

The couplers represented by the general formulae (I) and (II) are described in more detail below.

In the present invention an aliphatic hydrocarbon residue includes substituted or unsubstituted, saturated or unsaturated aliphatic hydrocarbon residue such as an alkyl group and an alkenyl group which may be straight chain or branched chain; and alicyclic hydrocarbon residue includes a substituted or unsubstituted, saturated or unsaturated alicyclic hydrocarbon residue such as a cycloalkyl or a cycloalkenyl group.

When $X_1$ or $X_2$ represents an aliphatic or alicyclic hydrocarbon residue, it preferably has from 1 to 30, more preferably from 1 to 20 carbon atoms. Suitable examples of these groups include methyl, ethyl, propyl, butyl, cyclopropyl, allyl, tert-octyl, isobutyl, dodecyl and 2-hexyldecyl.

When $X_1$ or $X_2$ represents a heterocyclic group, the heterocyclic group preferably is a 3-membered to 12-membered, more preferably 5-membered to 6-membered, saturated or unsaturated, substituted or unsubstituted, monocyclic or condensed ring heterocyclic group preferably having from 1 to 20, more preferably from 1 to 10 carbon atoms and at least one hetero atom, for example, a nitrogen atom, an oxygen atom or a sulfur atom. Suitable examples of the heterocyclic group include 3-pyrrolidinyl, 1,2,4-triazol-3-yl, 2-pyridyl, 4-pyrimidinyl, 3-pyrazolyl, 2-pyrrolyl, 2,4-dioxo-1,3-imidazolidin-5-yl and pyranyl.

When $X_1$ or $X_2$ represents an aryl group, the aryl group may be a substituted or unsubstituted aryl group preferably having from 6 to 20, more preferably from 6 to 10 carbon atoms. Typical examples of the aryl group include phenyl and naphthyl.

When $X_3$ forms a nitrogen-containing heterocyclic group together with >N, the heterocyclic group is preferably a 3-membered to 12-membered, more preferably 5-membered to 6-membered, saturated or unsaturated, substituted or unsubstituted, monocyclic or condensed ring heterocyclic group preferably having from 1 to 20, more preferably from 1 to 15 carbon atoms, and the heterocyclic group may further have at least one hetero atom, for example, a nitrogen atom, an oxygen atom or a sulfur atom in addition to the nitrogen atom. Suitable examples of the heterocyclic group include pyrrolidino, piperidino, morpholino, 1-piperazinyl, 1-indolinyl, 1,2,3,4-tetrahydroquinolin-1-yl, 1-imidazolidinyl, 1-pyrazolyl, 1-pyrrolinyl, 1-pyrazolidinyl, 2,3-dihydro-1-imidazolyl, 2-isoindolinyl, 1-indolinyl, 1-pyrrolyl, 4-thiazin-S,S-dioxo-4-yl and benzoxazin-4-yl.

When $X_1$ or $X_2$ represents an aliphatic hydrocarbon, alicyclic hydrocarbon, aryl or heterocyclic group having a substituent, or $X_3$ represents the nitrogen-containing heterocyclic group formed together with >N having a substituent, suitable examples of the substituent include a halogen atom (e.g., fluorine or chlorine), an alkoxycarbonyl group (having from 2 to 30, preferably from 2 to 20 carbon atoms, e.g., methoxycarbonyl, dodecyloxycarbonyl or hexadecyloxycarbonyl), an aliphatic or aromatic (in the present invention aromatic group means that which has, for example, a phenyl or a naphthyl group) acylamino group (having from 2 to 30, preferably 2 to 20 carbon atoms, e.g., acetamido, tetradecanamido, 2-(2,4-di-tert-amylphenoxy)butanamido or benzamido), an alkyl- or aryl- (in the present invention examples of an aryl group include a phenyl group and a naphthyl group) sulfonamido group (having from 1 to 30, preferably from 1 to 20 carbon atoms, e.g., methanesulfonamido, dodecanesulfonamido, hexadecanesulfonamido or benzenesulfonamido), a carbamoyl group (having from 1 to 30, preferably from 1 to 20 carbon atoms, e.g., N-butylcarbamoyl or N,N-diethylcarbamoyl), an N-alkyl- or aryl-sulfonylcarbamoyl group (having from 1 to 30, preferably from 1 to 20 carbon atoms, e.g., N-mesylcarbamoyl or N-dodecylsulfonylcarbamoyl), a sulfamoyl group (having from 0 to 30, preferably from 1 to 20 carbon atoms, e.g., N-butylsulfamoyl, N-dodecylsulfamoyl, N-hexadecylsulfamoyl, N-[3-(2,4-di-tert-amylphenoxy)butyl]sulfamoyl or N,N-diethylsulfamoyl), an alkoxy group (having from 1 to 30, preferably from 1 to 20 carbon atoms, e.g., methoxy, hexadecyloxy or isopropoxy), an aryloxy group (having from 6 to 20, preferably from 6 to 10 carbon atoms, e.g., phenoxy, 4-methoxyphenoxy, 3-tert-butyl-4-hydroxyphenoxy or naphthoxy), an aryloxycarbonyl group (having from 7 to 21, preferably from 7 to 11, e.g., phenoxycarbonyl), an N-aliphatic or aromatic acylsulfamoyl group (having from 2 to 30, preferably from 2 to 20 carbon atoms, e.g., N-propanoylsulfamoyl or N-tetradecanoylsulfamoyl), an alkyl- or aryl- sulfonyl group (having from 1 to 30, preferably from 1 to 20 carbon atoms, e.g., methanesulfonyl, octanesulfonyl, 4-hydroxyphenylsulfonyl or dodecanesulfonyl), an alkoxycarbonylamino group (having from 2 to 30, preferably from 2 to 20 carbon atoms, e.g., ethoxycarbonylamino), a cyano group, a nitro group, a carboxy group, a hydroxy group, a sulfo group, an alkylthio group (having from 1 to 30, preferably from 1 to 20 carbon atoms, e.g., methylthio, dodecylthio or dodecylcarbamoylmethylthio), a ureido group (having from 1 to 30, preferably from 1 to 20 carbon atoms, e.g., N-phenylureido or N-hexadecylureido), an aryl group (having from 6 to 20, preferably from 6 to 10 carbon atoms, e.g., phenyl, naphthyl or 4-methoxyphenyl), a heterocyclic group (which has from 1 to 20, preferably 1 to 10 carbon atoms and at least one hetero atom, for example, a nitrogen atom, an oxygen atom or a sulfur atom and may be a 3-membered to 12-membered, preferably 5-membered to 6-membered, monocyclic or condensed ring, e.g., 2-pyridyl, 3-pyrazolyl, 1-pyrrolyl, 2,4-dioxo-1,3-imidazolidin-1-yl, 2-benzoxazolyl, morpholino or indolyl), an aliphatic or alicyclic hydrocarbon residue (which has from 1 to 30, preferably from 1 to 20 carbon atoms, e.g., methyl, ethyl, isopropyl, cyclopropyl, allyl, tert-pentyl, tertoctyl, cyclopentyl, tert-butyl, sec-butyl, dodecyl or 2-hexadecyl), an aliphatic or aromatic acyl group (having from 2 to 30, preferably from 2 to 20 carbon atoms, e.g., acetyl or benzoyl), an aliphatic or aromatic acyloxy group (having from 2 to 30, preferably from 2 to 20 carbon atoms, e.g., propanoyloxy or tetradecanoyloxy), an arylthio group (having from 6 to 20, preferably from 6 to 10 carbon atoms, e.g., phenylthio or naphthylthio), an alkyl- or aryl-sulfamoylamino group (having from 0 to 30, preferably from 0 to 20 carbon atoms, e.g., N-butylsulfamoylamino, N-dodecylsulfamoylamino or N-phenylsulfamoylamino) and an N-alkyl- or aryl-sulfonylsulfamoyl amino group (having from 1 to 30, preferably from 1 to 20 carbon atoms, e.g., N-mesylsulfamoyl, N-ethanesulfonylsulfamoyl, N-dodecanesulfonylsulfamoyl or N-hexadecanesulfonylsulfamoyl). These substituents (other than a halogen atom, a cyano group, a nitro group, a carboxy group, a hydroxyl group and a sulfo group) may be further substituted with the above-described substituents. Suitable examples of the substituent are those substituents described above.

Among the substituents described above, those preferred are an alkoxy group, a halogen atom, an alkoxycarbonyl group, an aliphatic or aromatic acyloxy group, an aliphatic or aromatic acylamino group, an alkyl or aryl-sulfonyl group, a carbamoyl group, an alkyl or aryl-sulfamoyl group, an alkyl or aryl-sulfonamido group, a nitro group, an aliphatic or alicyclic hydrocarbon residue and an aryl group.

When Y represents an aryl group in the general formula (I) or (II), the aryl group may be a substituted or unsubstituted aryl group preferably having from 6 to 20, more preferably from 6 to 10 carbon atoms. Typical examples of the aryl group include phenyl and naphthyl.

When Y represents a heterocyclic group in the general formula (I) or (II), the heterocyclic group may have the same meaning as that described for $X_1$ or $X_2$ above.

When Y represents a substituted aryl group or a substituted heterocyclic group, suitable examples of the substituents include those described for the group represented by $X_1$ or $X_2$ above. More preferred examples of the substituents for Y include a halogen atom, an alkoxycarbonyl group, a sulfamoyl group, a carbamoyl group, an alkyl- or aryl-sulfonyl group, an N-alkyl- or aryl-sulfonylsulfamoyl group, an N-aliphatic or aromatic acylsulfamoyl group, an alkoxy group, an aliphatic or aromaticacylamino group, an N-alkyl- or aryl-sulfonylcarbamoyl group, an alkyl- or aryl-sulfonamido group, and an aliphatic or alicyclic hydrocarbon residue.

The group represented by Z in the general formula (I) or (II) may be any of hitherto known coupling releasing groups. Preferred examples include a nitrogen-containing heterocyclic group bonded to the coupling position through the nitrogen atom, an aryloxy group, an arylthio group, a heterocyclic oxy group, a heterocyclic thio group, an acyloxy group, a carbamoyloxy group, an aliphatic or alicyclic hydrocarbon thio group and a halogen atom.

The coupling releasing group may be any nonphotographically useful group, or may be any photographically useful groups or the precursors therefor, for example, groups which are able to release development inhibitors, development accelerators, desilvering accelerators, fogging agents, dyes, hardeners, couplers, scavengers for oxidation products of developing agents, fluorescent dyes, developing agents and electron transfer agents.

For the photographically useful groups, those hitherto known are suitable. For example, photographically useful groups or releasing groups (for example, timing groups having a photographically useful group) for releasing photographically useful groups are described, for example, in U.S. Pat. Nos. 4,248,962, 4,409,323, 4,438,193, 4,421,845, 4,618,571, 4,652,516, 4,861,701, 4,782,012, 4,857,440, 4,847,185, 4,477,563, 4,438,193, 4,628,024, 4,618,571 and 4,741,994, European Patent Application (OPI) Nos. 193,389A, 348,139A and 272,573A.

When Z represents a nitrogen-containing heterocyclic group bonded to the coupling position through the nitrogen atom, a examples of preferred heterocyclic group is 5-membered or 6-membered, substituted or unsubstituted, saturated or unsaturated, monocyclic or condensed heterocyclic group having from 1 to 15, more preferably from 1 to 10 carbon atoms. As a hetero atom, an oxygen atom or a sulfur atom may be included in addition to the nitrogen atom. Preferred specific examples of the heterocyclic groups include 1-pyrazolyl, pyrrolinyl, 1,2,4-triazol-2-yl, 1,2,3-triazol-3-yl, benzotriazolyl, benzimidazolyl, imidazolidin-2,4-dion-3-yl, oxazolidin-2,4-dion-3-yl, 1,2,4-triazolidin-3,5-dion-4-yl, 2-imidazolidinon-1-yl, 3,5-dioxomorpholino and 1-imidazolyl. When the heterocyclic group has a substituent, suitable examples of the substituents include those described for the group represented by $X_1$ or $X_2$ above. Preferred examples of the substituents include an aliphatic- or alicyclic-hydrocarbon residue, an alkoxy group, a halogen atom, an alkoxycarbonyl group, an aryloxycarbonyl group, an alkylthio group, an aliphatic or aromatic acylamino group, an alkyl- or aryl-sulfonamido group, an aryl group, a nitro group, a carbamoyl group and an alkyl- or aryl-sulfonyl group.

When Z represents an aryloxy group, a substituted or unsubstituted aryloxy group having from 6 to 10 carbon atoms is preferred. A substituted or unsubstituted phenoxy group is particularly preferred. When the aryloxy group has a substituent, suitable examples of the substituents include those described for the group represented by $X_1$ or $X_2$ above. Preferred substituents thereof include an electron withdrawing substituent, for example, an alkyl- or aryl-sulfonyl group, an alkoxycarbonyl group, a sulfamoyl group, a halogen atom, a carboxy group, a carbamoyl group, a nitro group, a cyano group or an aliphatic or aromatic acyl group. The substituents may be substituted at any position of the phenyl or naphthyl group, but it is preferred that the substituents are substituted at 1-and/or 4-position of the phenyl or naphthyl group.

When Z represents an arylthio group, a substituted or unsubstituted arylthio group having from 6 to 10 carbon atoms is preferred. A substituted or unsubstituted phenylthio group is particularly preferred. When the arylthio group has a substituent, suitable examples of the substituents include those described for the group represented by $X_1$ or $X_2$ above. Preferred substituents thereof include an aliphatic or alicyclic hydrocarbon residue, an alkoxy group, an alkyl- or arylsulfonyl group, an alkoxycarbonyl group, a sulfamoyl group, a halogen atom, a carbamoyl group and a nitro group. The substituents may be substituted at any position of the phenyl or naphthyl group, but it is preferred that the substituents are substituted at 1-and/or 4-position of the phenyl or naphthyl group.

When Z represents a heterocyclic oxy group, the heterocyclic group may be a 3-membered to 12-membered, preferably 5-membered to 6-membered, saturated or unsaturated, substituted or unsubstituted, monocyclic or condensed ring heterocyclic group having from 1 to 20, preferably from 1 to 10 carbon atoms and at least one hetero atom, for example, a nitrogen atom, an oxygen atom or a sulfur atom. Suitable examples of the heterocyclic oxy group include pyridyloxy, pyrazolyloxy and furyloxy. When the heterocyclic oxy group has a substituent, suitable examples of the substituents include those described for the group represented by $X_1$ or $X_2$ above. Preferred substituents include an aliphatic or alicyclic hydrocarbon residue, an aryl group, a carboxy group, an alkoxy group, a halogen atom, an alkoxycarbonyl group, an aryloxycarbonyl group, an alkylthio group, an aliphatic or aromatic acylamino group, a sulfonamido group, a nitro group, a carbamoyl group and an aliphatic or aromatic sulfonyl group.

When Z represents a heterocyclic thio group, the heterocyclic group may be a 3-membered to 12-membered, preferably 5-membered to 6-membered, saturated or unsaturated, substituted or unsubstituted, monocyclic or condensed ring heterocyclic group having from 1 to 20, preferably from 1 to 10 carbon atoms and at least one hetero atom, for example, a nitrogen atom, an oxygen atom or a sulfur atom. Suitable examples of the heterocyclic thio group include tetrazolylthio, 1,3,4-thiadiazolylthio, 1,3,4-oxadiazolylthio, 1,3,4-triazolylthio, benzimidazolylthio, benzothiazolylthio and 2-pyridylthio. When the heterocyclic thio group has a substituent, suitable examples of the substituents include those described for the group represented by $X_1$ or $X_2$ above. Preferred substituents thereof include an aliphatic or alicyclic hydrocarbon residue, an aryl group, a carboxy group, an alkoxy group, a halogen atom, an alkoxy carbonyl group, an aryloxycarbonyl group, an alkylthio group, an aliphatic or aromatic acylamino group, a sulfonamido group, a nitro group, a carbamoyl group, a heterocyclic group and an alkyl- or aryl-sulfonyl group.

When Z represents an aliphatic or aromatic acyloxy group, a monocyclic or condensed ring, substituted or unsubstituted aromatic acyloxy group having from 6 to 10 carbon atoms or a substituted or unsubstituted aliphatic acyloxy group having from 2 to 30, preferably from 2 to 20 carbon atoms. When the acyloxy group has a substituent, suitable examples of the substituents include those described for the group represented by $X_1$ or $X_2$ above.

When Z represents a carbamoyloxy group, the carbamoyloxy group may be an aliphatic, aromatic or heterocyclic, substituted or unsubstituted carbamoyloxy group having from 1 to 30, preferably from 1 to 20 carbon atoms. Suitable examples of the carbamoyloxy group include N,N-diethylcarbamoyloxy, N-phenylcarbamoyloxy, 1-imidazolylcarbamoyloxy and 1-pyrrolocarbamoyloxy. When the carbamoyloxy group has a substituent, suitable examples of the substituents include those described for the group represented by $X_1$ or $X_2$ above.

When Z represents an aliphatic or alicyclic hydrocarbon thio group may be a straight chain, branched chain or cyclic, saturated or unsaturated, substituted or unsubstituted group having from 1 to 30, preferably from 1 to 20 carbon atoms. When the group has a substituent, suitable examples of the substituents include those described for the group represented by $X_1$ or $X_2$ above.

Preferred embodiments of the couplers represented by the general formulae (I) and (II) will be described below.

In the general formula (I), $X_1$ represents preferably an alkyl group, particularly preferably an alkyl group having from 1 to 10 carbon atoms.

In the general formula (I) or (II), Y represents preferably an aryl group, particularly preferably a phenyl group having at least one substituent in the ortho positions. Suitable and preferred examples of the substituents include those described for the aryl group represented by Y above respectively.

In the general formula (I) or (II), Z preferably represents a 5-membered or 6-membered nitrogen-containing heterocyclic group bonded to the coupling position through the nitrogen atom, an aryoxy group, a 5-membered or 6-membered heterocyclic oxy group or a 5-membered or 6-membered heterocyclic thio group.

Of the couplers represented by the general formula (I) or (II), those preferred are represented by the following general formula (III), (IV) or (V):

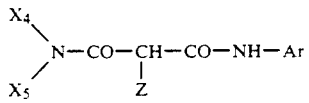
(III)

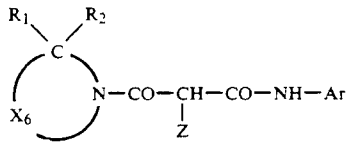
(IV)

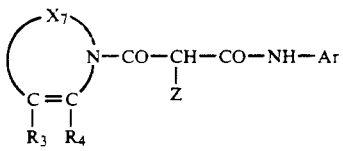
(V)

wherein Z has the same meaning as defined in the general formula (I); $X_4$ represents an aliphatic or alicyclic hydrocarbon residue; $X_5$ represents an aliphatic or alicyclic hydrocarbon residue or an aryl group; Ar represents a phenyl group having at least one substituent in the ortho positions; $X_6$ represents an organic moiety necessary to form a nitrogen-containing mono-cyclic or condensed heterocyclic group together with

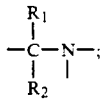

$X_7$ represents an organic moiety necessary to form a nitrogen-containing mono-cyclic or condensed hetero cyclic group together with

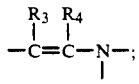

and $R_1$, $R_2$, $R_3$ and $R_4$ each represents a hydrogen atom or a substituent.

Detailed description and preferred embodiments of the groups represented by $X_4$ to $X_7$, Ar and Z in the general formulae (III) to (V) are same as those described for the corresponding groups in the general formulae (I) and (II). In a case wherein, $R_1$, $R_2$, $R_3$ or $R_4$ represents a substituent, suitable examples of the substituents include those described for the group represented by $X_1$ or $X_2$ above.

Of the couplers represented by the general formulae (III), (IV) and (V), those represented by the general formulae (IV) and (V) are particularly preferred.

The couplers represented by the general formulae (I) to (V) described above may be connected with each other via a group having a valency of 2 or more or a single bond at the groups represented by $X_1$ to $X_7$, Y, Ar, $R_1$ to $R_4$ and Z to form a dimer, higher polymer (for example, telomer homopolymer or copolymer) or a bis-compound. The couplers may also form a biscompound which can be represented by a formula obtained by connecting a moiety in the general formulae (I) to (V) to the groups represented by $X_1$ to $X_7$, Y, Ar, $R_1$ to $R_4$ and Z. In such cases, the number of carbon atoms contained in the substituents described above may deviate from the range defined above. Typical examples of the higher polymer are described hereinafter.

The couplers represented by the general formulae (I) to (V) are nondiffusive. The term "nondiffusive coupler" means a coupler containing in its molecule a group having a high molecular weight sufficient to render the coupler immobile in the layer to which it is added. Usually an alkyl group having from 8 to 30, preferably from 10 to 20 total carbon atomsin or a substituted aryl group having a substituent(s) having from 4 to 20 total carbon atoms is employed as a nonduffusive group. The nondiffusive group may be substituted in any portion of the coupler. Two or more diffusion resistant groups may be present in the coupler.

Specific examples of the yellow couplers represented by the general formulae (I) to (V) are set forth below, but the present invention should not be construed as being limited thereto.

In the formulae of the couplers or compounds used in the present invention, the alkyl group having no symbol such as (n), (t) and (i) represents a n-alkyl group.

(1)

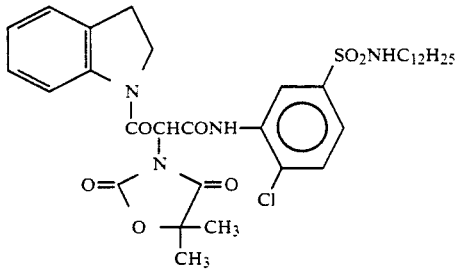

(2)

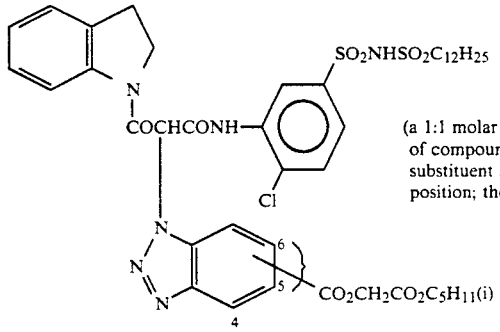

(a 1:1 molar ratio mixture of compounds having the substituent at 5- or 6-position; the same hereinafter)

-continued
(3)
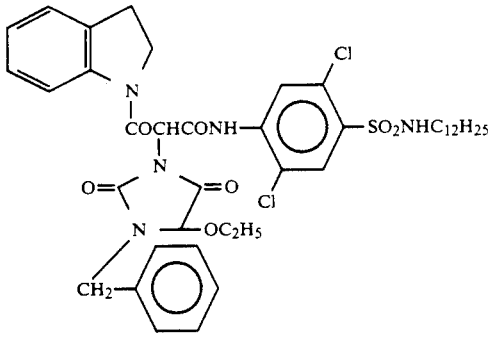
(4)
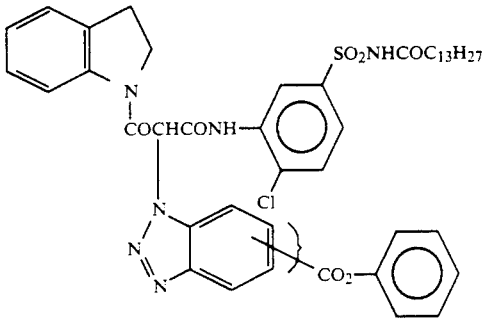
(5)
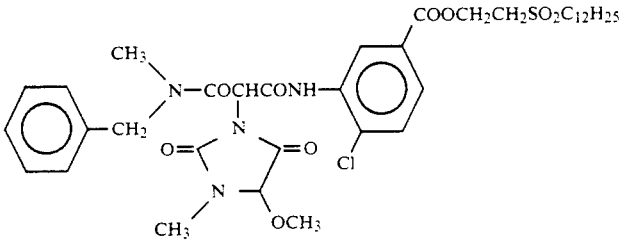
(6)
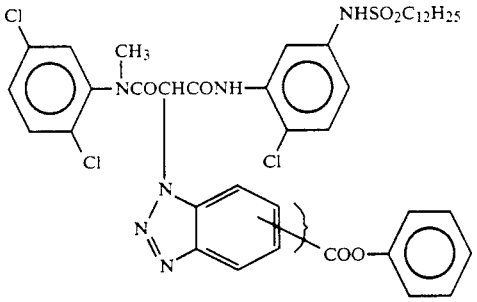
(7)
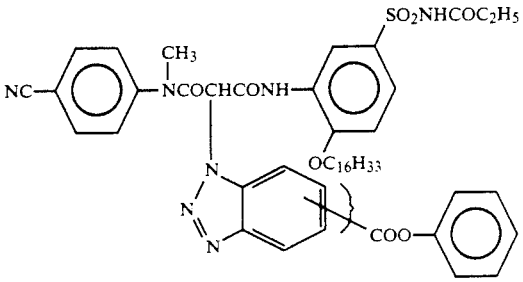

-continued
(8)
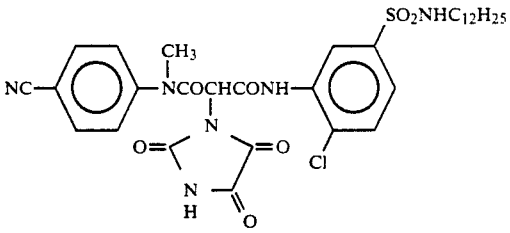
(9)
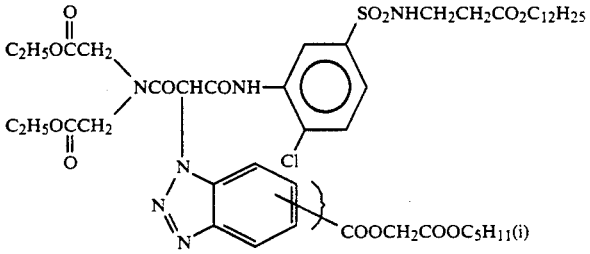
(10)
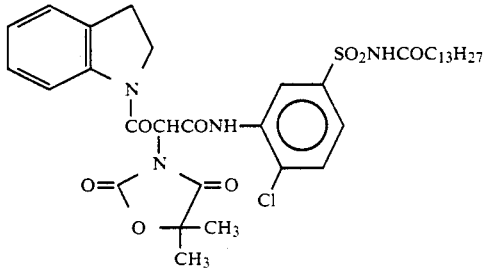
(11)
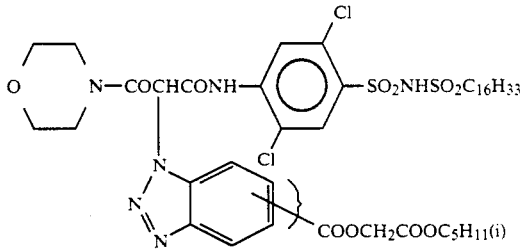
(12)
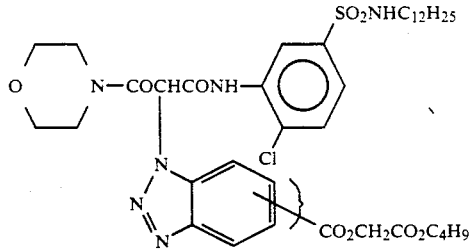
(13)
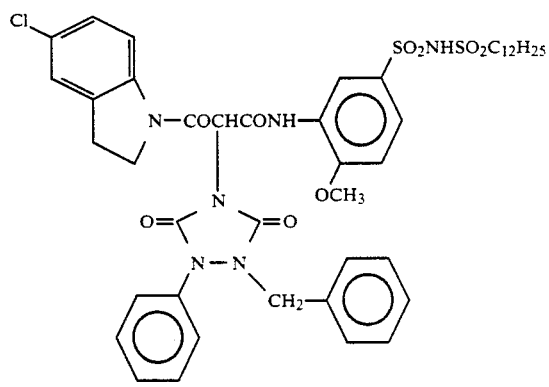

-continued
(14)
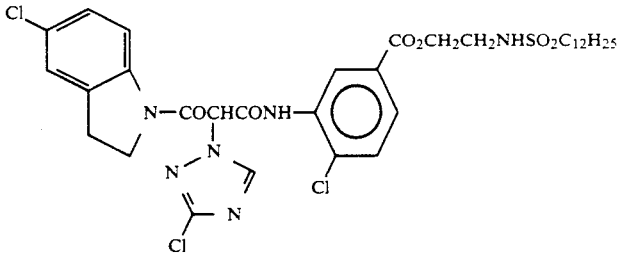
(15)
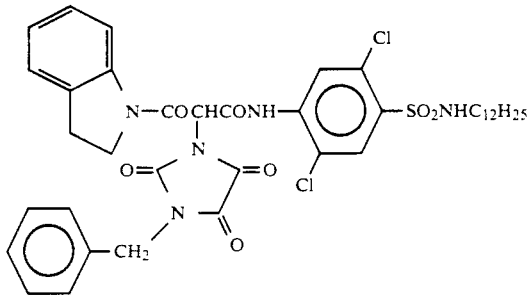
(16)
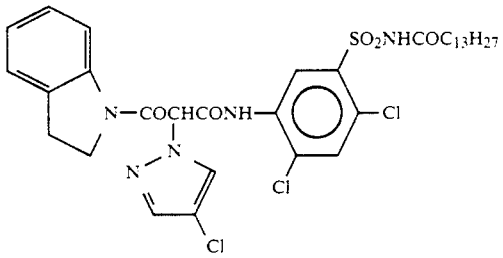
(17)
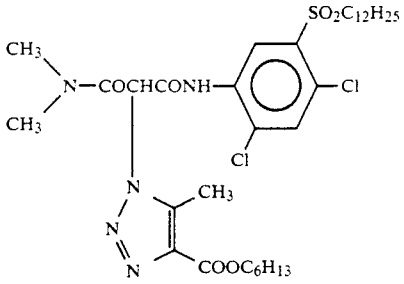
(18)
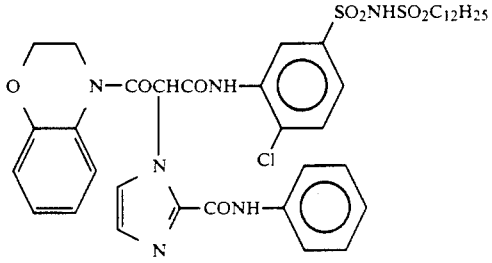

-continued
(19)
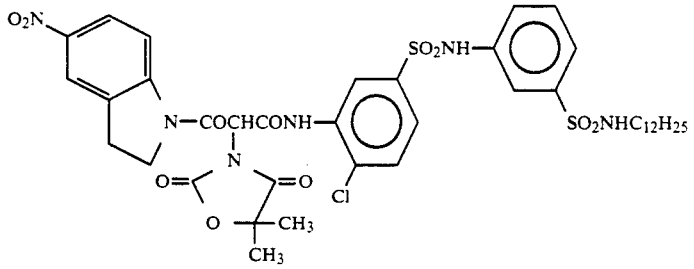
(20)
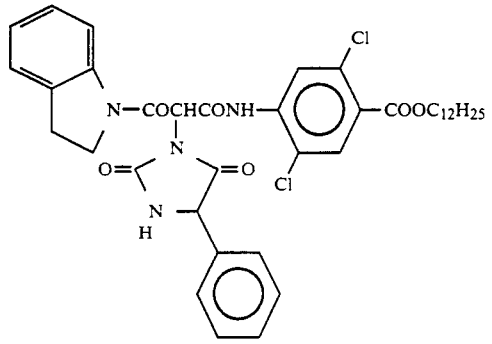
(21)
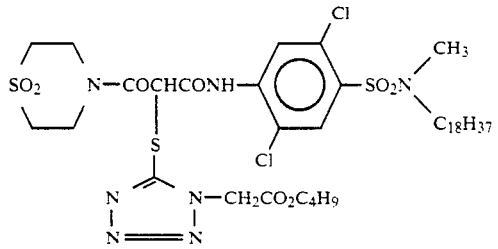
(22)
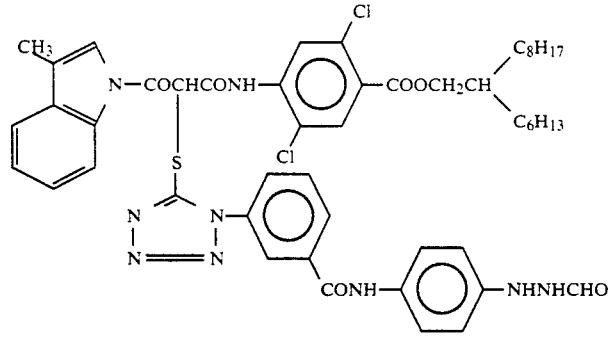
(23)
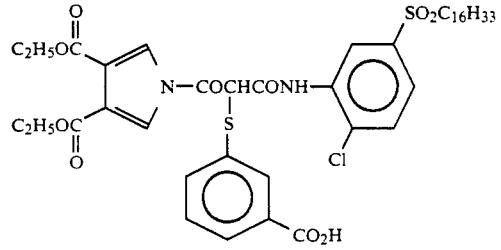

-continued
(24)
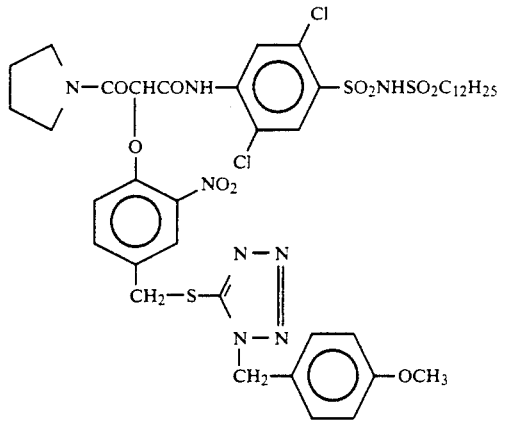
(25)
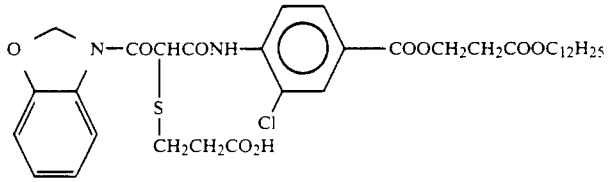
(26)
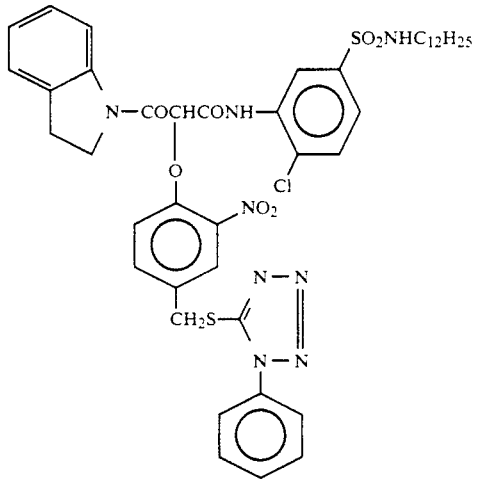
(27)
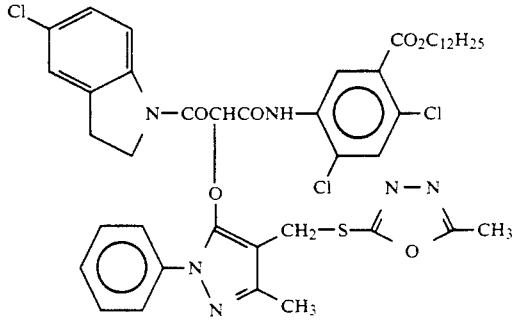

-continued
(28)
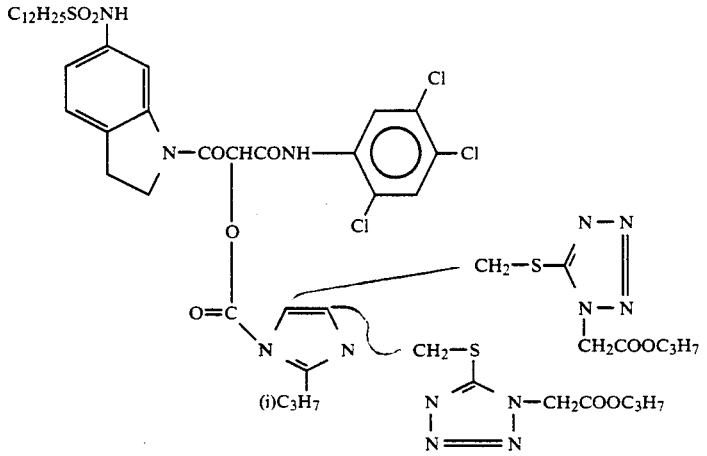
(29)
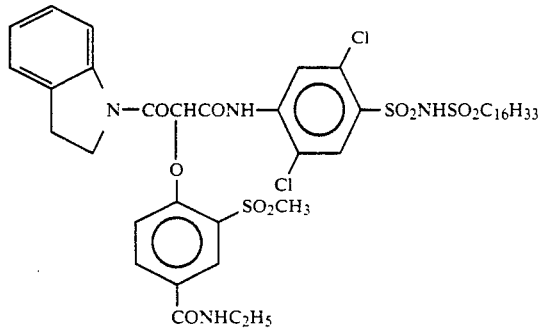
(30)
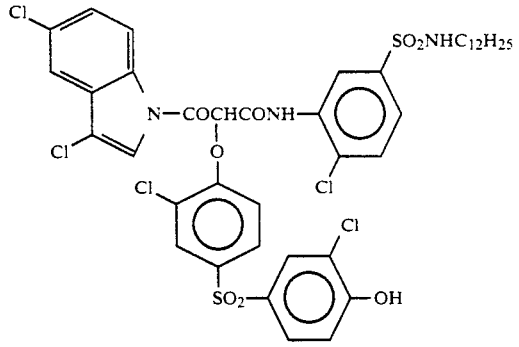
(31)
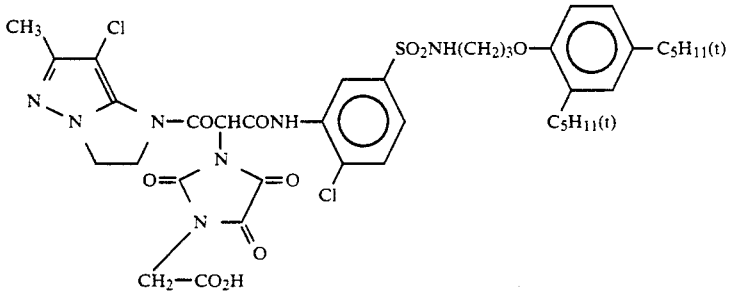

-continued
(32)
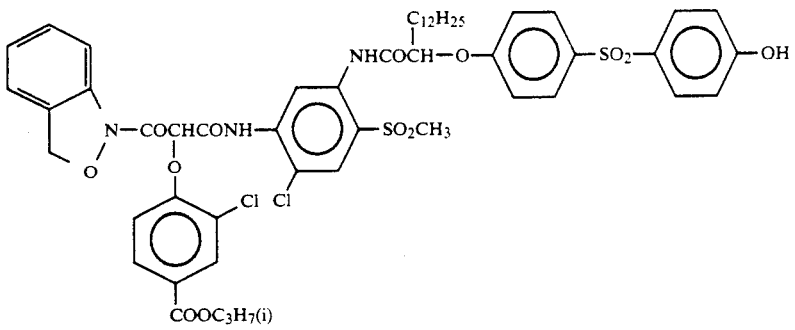
(33)
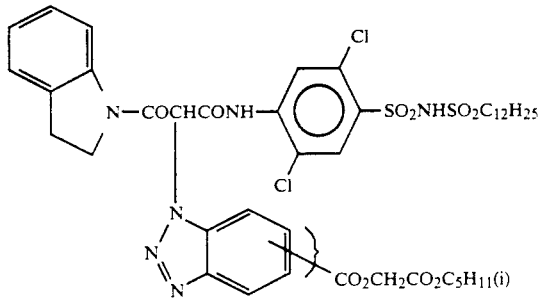
(34)
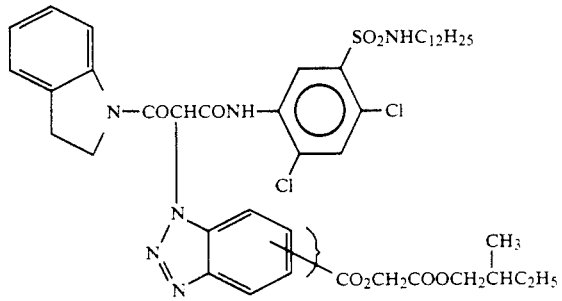
(35)
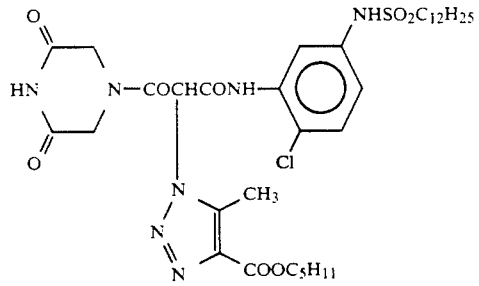
(36)
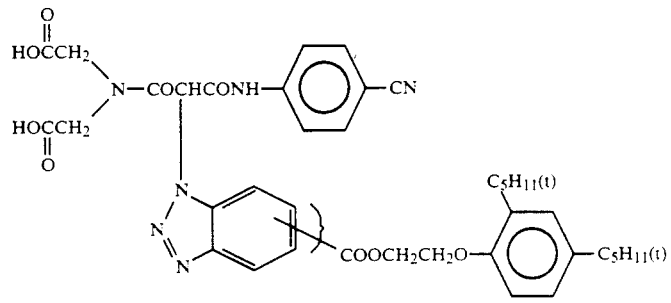

-continued
(37)
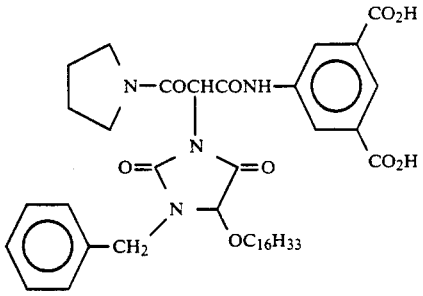
(38)
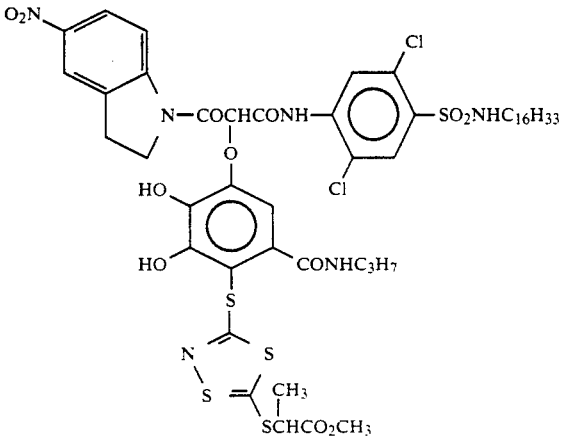
(39)
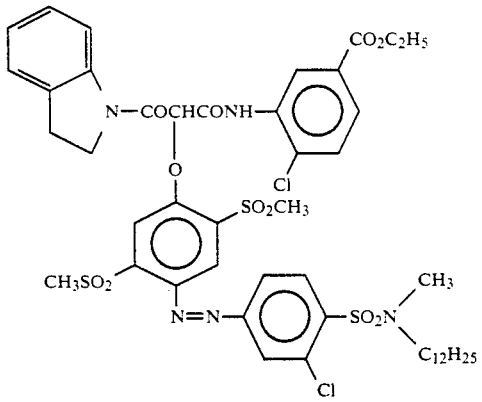
(40)
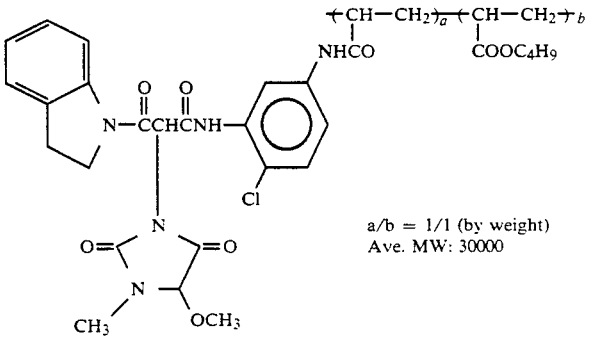
a/b = 1/1 (by weight)
Ave. MW: 30000

-continued
(41)
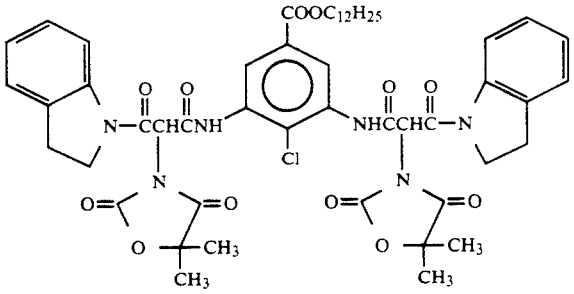
(42)
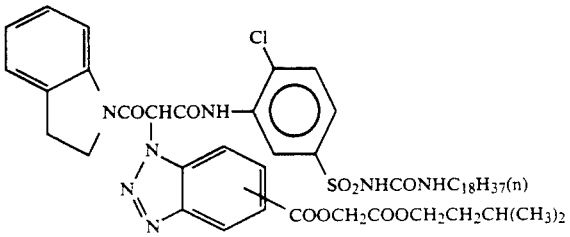
(43)
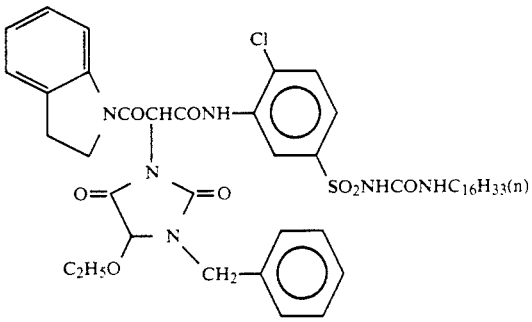
(44)
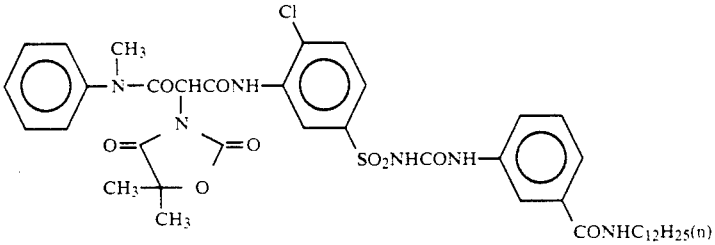
(45)
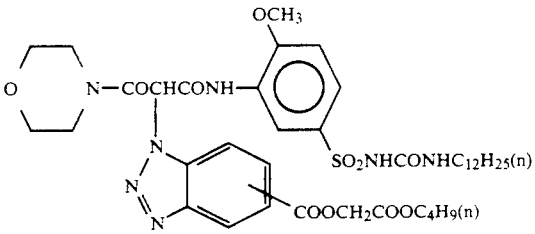
(46)
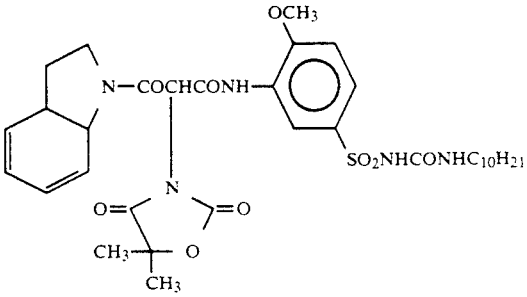

-continued (47)

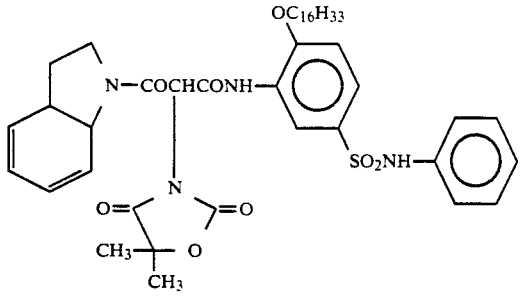

(48)

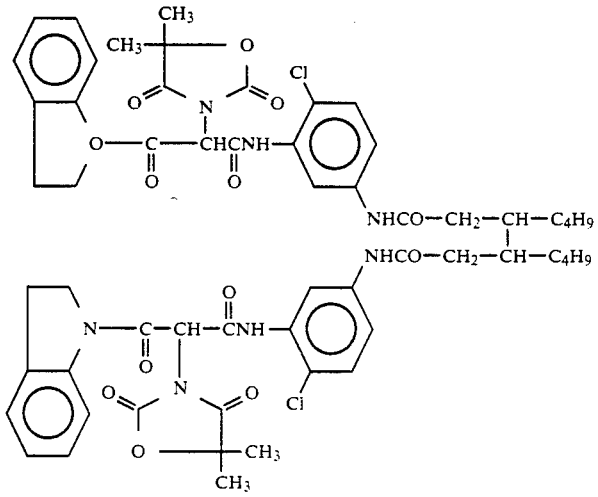

The yellow coupler represented by the general formula (I) or (II) according to the present invention is preferably incorporated into a light-sensitive silver halide emulsion layer of the light-sensitive material or a light-insensitive layer (for example, a protective layer, an antihalation layer, and intermediate layer) adjacent to a silver halide emulsion layer, and particularly preferably incorporated into a light-sensitive silver halide emulsion layer. When the light-sensitive material contains a silver halide emulsion layer unit comprising two or more of light-sensitive layers having sensitivity to a same color, the coupler may be incorporated into any layer thereof. The total amount of the coupler added to the light-sensitive material is preferably from 0.0001 to 0.80 g/m$^2$, more preferably from 0.0005 to 0.50 g/m$^2$, and particularly preferably from 0.02 to 0.30 g/m$^2$ when the releasing group represented by Z contains a photographically useful moiety. On the other hand, the total amount of the coupler added is preferably from 0.001 to 1.20 g/m$^2$, more preferably from 0.01 to 1.00 g/m$^2$, and particularly preferably from 0.10 to 0.80 g/m$^2$, when the releasing group represented by Z does not contain a photographically useful moiety.

Two or more couplers represented by formula (I) or (II) may be used in combination. Furthermore, the coupler or couplers may be divided in two or more and incorporated into two or more layers.

The coupler represented by formula (I) or (II) may be used in combination with conventional yellow couplers, or couplers or compounds having a conventional photographically useful group, In such a case the mixing ratio of the combination is not limited. However, the mixing ratio of the coupler represented by formula (I) or (II) having a photographically useful group at Z when used with the conventional coupler or compound having the same photographically useful group (excluding the coupler represented by formula (Y)) or the mixing ratio of the coupler represented by formula (I) or (II) having no photographically useful group at Z when used with the conventional coupler having no photographically useful group (excluding the coupler represented by formula (Y)) is preferably at least 50 mol %, more preferably at least 70 mol %.

The yellow coupler according to the present invention can be incorporated into a light-sensitive material in the same manner as for conventional couplers as described hereinafter.

Synthesis of the yellow coupler represented by formula (I) or (II) is specifically described with reference to the following synthesis examples.

SYNTHESIS EXAMPLE 1

Synthesis of Coupler (1)

Coupler (1) was synthesized according to the synthesis route shown below.

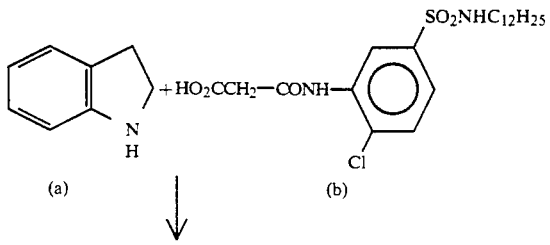

-continued

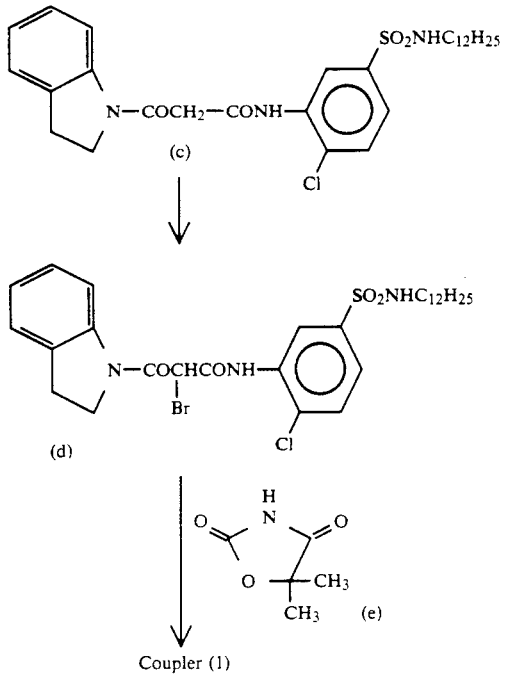

step (1)

In a solvent mixture of 100 ml of N,N-dimethylformamide and 100 ml of acetonitrile were dissolved 3.5 g of Compound (a) and 13 g of Compound (b). To the resulting solution was added dropwise 40 ml of an acetonitrile solution containing 6 g of N,N'-dicyclohexylcarbodiimide dissolved therein at room temperature. After reacting for 2 hours, the N,N'-dicyclohexylurea thus deposited was removed by filtration. The filtrate was poured into 500 ml of water and extracted with 500 ml of ethyl acetate. The extract was washed with water in a separating funnel and the oil layer was separated. The solvent was distilled off under reduced pressure, and to the residue was added hexane to obtain by crystallization 16.1 g of Compound (c).

step (2)

16 g of Compound (c) was mixed with 150 ml of dichloromethane. To the mixture was added dropwise 10 ml of a dichloromethane solution containing 4.8 g of bromine under cooling with ice (at 5° C. to 10° C.). After reacting for 10 minutes, the mixture was washed with water in a separating funnel. The oil layer containing Compound (d) was collected to use in the following step.

step (3)

8.2 g of Compound (e) and 8.8 ml of triethylamine were added to 160 ml of N,N-dimethylformamide. To the resulting solution was added dropwise the dichloromethane solution of Compound (d) obtained above at room temperature. After reacting for one hour, 500 ml of ethyl acetate was added, and the mixture was washed with water in a separating funnel. After neutralizing with diluted hydrochloric acid, the mixture was again washed with water. The oil layer was separated and the solvent was distilled off under reduced pressure. The residue was separated and purified by column chromatography using silica gel as a bulking agent and ethyl acetate/hexane (1/1) as an eluate. The fraction containing the desired compound was collected and the solvent was distilled off under reduced pressure to obtain 16.3 g of Coupler (1) as a wax.

SYNTHESIS EXAMPLE 2

Synthesis of Coupler (2)

In the same manner as in Synthesis Example 1 except for using the equimolar amounts of Compound (f) and Compound (g) shown below in place of Compound (b) and Compound (e), respectively, 15.4 g of Coupler (2) was obtained as a wax.

Compound (f):

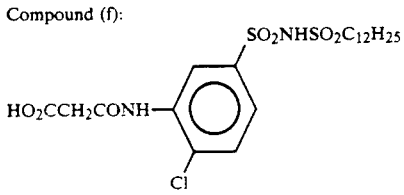

Compound (g):

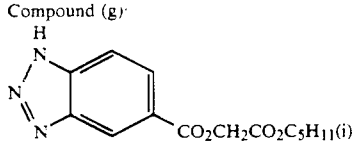

SYNTHESIS EXAMPLE 3

Synthesis of Coupler (6)

Coupler (6) was synthesized according to the synthesis route shown below.

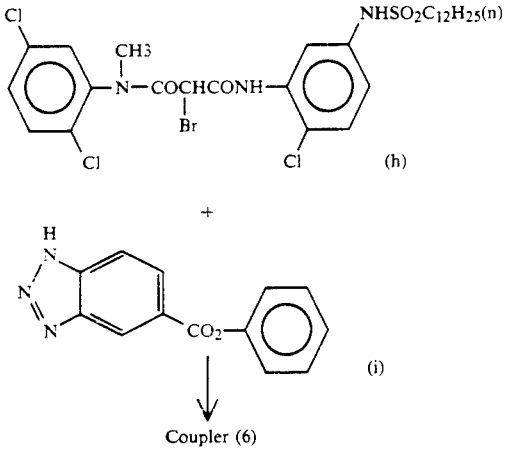

To 50 ml of N,N-dimethylformamide were added 4.42 g of Compound (i) and 1.87 g of triethylamine and the mixture was stirred for 10 minutes. To the solution was added dropwise a solution containing 6.23 g of Compound (h) dissolved in 20 ml of methylene chloride at room temperature over a period of 15 minutes. After reacting at room temperature for one hour, the reaction solution was poured into water and extracted with ethyl acetate. The organic layer was dried with magnesium sulfate, filtered to remove the magnesium sulfate, and the solvent was distilled off under reduced pressure. The residue was purified by silica gel column chromatography to obtain 4.7 g of Coupler (6) as white powder.

Now, the acyl acetamide yellow coupler used in the present invention will be described in more detail below.

The acyl acetamide yellow coupler according to the present invention is preferably represented by the following general formula (Y):

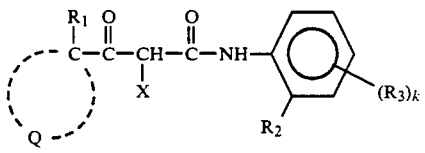

(Y)

wherein $R_1$ represents a mono-valent substituent other than a hydrogen atom; Q represents a non-metallic atomic group necessary for forming a 3-membered, 4-membered or 5-membered hydrocarbon ring or heterocyclic ring containing at least one hetero atom selected from N, S, O and P as a ring-forming member together with C; $R_2$ represents a hydrogen atom, a halogen atom (e.g., F, Cl, Br or I, hereinafter the same as to the description of the general formula (Y)), an alkoxy group, an aryloxy group, an aliphatic or alicyclic hydrocarbon residue or an amino group; $R_3$ represents a group capable of substituting on the benzene ring; X represents a hydrogen atom or a group capable of being released upon a coupling reaction with an oxidation product of an aromatic primary amine developing agent (hereinafter referred to as releasing group); and k represents an integer of from 0 to 4, when k represents 2 or more, two or more $R_3$'s may be the same or different.

Suitable examples of the group for $R_3$ include a halogen atom, an aliphatic or alicyclic hydrocarbon residue, an aryl group, an alkoxy group, an aryloxy group, an alkoxycarbonyl group, an aryloxycarbonyl group, an alkyl- or aryl-carbonamido group, an alkyl- or aryl-sulfonamido group, a carbamoyl group, a sulfamoyl group, an alkylsulfonyl group, an arylsulfonyl group, a ureido group, a sulfamoylamino group, an alkoxycarbonylamino group, an alkoxysulfonyl group, an aliphatic or aromatic acyloxy group, a nitro group, a heterocyclic group, a cyano group, an aliphatic or aromatic acyl group, an amino group, an imido group, an alkylsulfonyloxy group, an arylsulfonyloxy group, a carboxy group, a sulfo group and a hydroxy group (hereinafter referred to as Substituent Group A). Suitable examples of the releasing group for X include a heterocyclic group bonded to the coupling active position through a nitrogen atom contained in the ring. an aryloxy group, an arylthio group, an aliphatic or aromatic acyloxy group, an alkylsulfonyloxy group, an arylsulfonyloxy group, a heterocyclic oxy group and a halogen atom.

The definition for the aliphatic and alicyclic hydrocarbon residue can be seen in the definition of the general formulae (I) and (II).

In a case wherein the substituent in the general formula (Y) is or includes an aryl group, the aryl group means a monocyclic or condensed ring aryl group (i.e., phenyl or naphthyl group) which may be substituted, unless otherwise specified.

In a case wherein the substituent in the general formula (Y) is or includes a heterocyclic group, the heterocyclic group means a 3-membered to 8-membered, monocyclic or condensed ring heterocyclic group containing at least one hetero atom selected from O, N, S, P, Se and Te in the ring which may be substituted, unless otherwise specified.

Preferred substituents used in the general formula (Y) will be described below.

In the general formula (Y), $R_1$ preferably represents a halogen atom, a cyano group, a mono-valent group having from 1 to 30 carbon atoms in total (for example, an aliphatic or alicyclic hydrocarbon residue or an alkoxy group) which may be substituted or a monovalent group having from 6 to 30 carbon atoms in total (for example, an aryl group or an aryloxy group) which may be substituted. Suitable examples of the substituent include a halogen atom, an aliphatic or alicyclic hydrocarbon residue, an alkenyl group, an alkoxy group, a nitro group, an amino group, an alkyl- or aryl-carbonamido group, an alkyl- or aryl-sulfonamide group and an aliphatic or aromatic acyl group.

In the general formula (Y), Q preferably represents a non-metallic atomic group necessary to form a 3-membered, 4-membered or 5-membered hydrocarbon ring having from 3 to 30 carbon atoms in total or a heterocyclic ring containing at least one hetero atom selected from N, S, O and P in the ring and having from 2 to 30 carbon atoms in total which may be substituted. The ring formed by Q together with C may contain an unsaturated bond therein. Suitable examples of the ring which is formed by Q together with C include a cyclopropane ring, a cyclobutane ring, a cyclopentane ring, a cyclopropene ring, a cyclobutene ring, a cylcopentene ring, an oxethane ring, a oxolane ring, a 1,3-dioxolane ring, a thiethane ring, a thiolane ring and a pyrrolidine ring. Suitable examples of the substituent include a halogen atom, a hydroxy group, an aliphatic or alicyclic hydrocarbon residue, an alkenyl group, an aryl group, an aliphatic or aromatic acyl group, an alkoxy group, an aryloxy group, a cyano group, an alkoxycarbonyl group, an alkylthio group and arylthio group. Two of these substituents may be bonded to form a hydrocarbon ring or a heterocyclic ring.

In the general formula (Y), $R_2$ preferably represents a halogen atom, an alkoxy group having from 1 to 30 carbon atoms in total which may be substituted, an aryloxy group having from 6 to 30 carbon atoms in total which may be substituted, an alkyl group or alkenyl having from 1 to 30 carbon atoms in total which may be substituted or an amino group having from 0 to 30 carbon atoms in total which may be substituted. Suitable examples of the substituent include a halogen atom, an alkyl group, an alkenyl group, an alkoxy group and an aryloxy group.

In the general formula (Y), $R_3$ preferably represents a halogen atom, an alkyl or alkenyl group having from 1 to 30 carbon atoms in total which may be substituted, an aryl group having from 6 to 30 carbon atoms in total which may be substituted, an alkoxy group having from 1 to 30 carbon atoms in total which may be substituted, an alkoxycarbonyl group having from 2 to 30 carbon atoms in total which may be substituted, an aryloxycarbonyl group having from 7 to 30 carbon atoms in total which may be substituted, an alkyl- or aryl-carbonamido group having from 1 to 30 carbon atoms in total which may be substituted, an alkyl- or aryl-sulfonamido group having from 1 to 30 carbon atoms in total which may be substituted, a carbamoyl group having from 1 to 30 carbon atoms in total which may be substituted, a sulfamoyl group having from 0 to 30 carbon atoms in total which may be substituted, an alkylsulfonyl group having from 1 to 30 carbon atoms in total which may be substituted, an arylsulfonyl group having from 6 to 30 carbon atoms in total which may be substituted, a ureido group having from 1 to 30 carbon atoms in total which may be substituted, a sulfamoylamino group having from 0 to 30 carbon atoms in total which may be substituted, an alkoxycarbonylamino group having from 2 to 30 carbon atoms in total which may be substituted, a heterocyclic group having from 1 to 30 carbon atoms in total which may be substituted, an acyl group having from 2 to 30 carbon atoms in total which may be substituted, an alkylsulfonyloxy group having from 1 to 30 carbon atoms in total which may be substituted or an arylsulfonyloxy group having from 6 to 30 carbon atoms in total which may be substituted. Suitable examples of the substituent include those of Substituent Group A.

In the general formula (Y), k preferably represents an integer of 1 or 2, and the position of $R_3$ is preferably at the meta-position or para-position to the

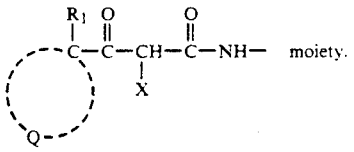

moiety.

In the general formula (Y), X preferably represents a heterocyclic group bonded to the coupling active position through a nitrogen atom contained in the ring or an aryloxy group.

In a case wherein X represents a heterocyclic group, the heterocyclic group is preferably a 5-membered to 7-membered monocyclic or condensed ring heterocyclic group which may be substituted. Suitable examples of the heterocyclic ring include those derived from succinimide, maleinimide, phthalimide, diglycolimide, pyrrole, pyrazole, imidazole, 1,2,4-triazole, tetrazole, indole, indazole, benzimidazole, benzotriazole, imidazolidin-2,4-dione, oxazolidin-2,4-dione, thiazolidin-2,4-dione, imidazolidin-2-one, oxazolidin-2-one, thiazolidin-2-one, benzimidazolin-2-one, benzoxazolin-2-one, benzothiazolin-2-one, 2-pyrrolin-5-one, 2-imidazolin-5-one, indolin-2,3-dione, 2,6-dioxypurine, parabanic acid, 1,2,4-triazolidine-3,5-dione, 2 -pyridone, 4-pyridone, 2-pyrimidone, 6-pyridazone, 2-pyrazone, 2-amino-1,3,4-thiazolidine, and 2-imino-1,3,4-thiazolidin-4-one. These heterocyclic rings may be substituted. Suitable examples of the substituent include those of Substituent Group A.

In a case wherein X represents an aryloxy group, the aryloxy group is preferably an aryloxy group having from 6 to 30 carbon atoms in total which may be substituted. Suitable examples of the substituent include those described for the heterocyclic group represented by X above. Preferred examples of the substituent for the aryloxy group include a halogen atom, a cyano group, a nitro group, a carboxy group, a trifluoromethyl group, an alkoxycarbonyl group, an alkyl- or aryl-carbonamido group, an alkyl or aryl-sulfonamido group, a carbamoyl group, a sulfamoyl group, an alkylsulfonyl group, an arylsulfonyl group and a cyano group.

Now, particularly preferred substituents used in the general formula (Y) will be described below.

$R_1$ is particularly preferably a halogen atom or an alkyl group, and most preferably a methyl group.

Q is particularly preferably a non-metallic atomic group necessary to form a 3-membered, 4-membered or 5-membered hydrocarbon ring together with C, for example,

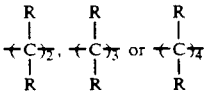

wherein R, which may be the same or different, each represents a hydrogen atom, a halogen atom or an alkyl group. Most preferably Q is

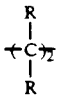

which forms a 3-membered ring together with C.

$R_2$ is particularly preferably a chlorine atom, a fluorine atom, an alkyl group having from 1 to 6 carbon atoms in total (e.g., methyl, trifluoromethyl, ethyl, isopropyl or tert-butyl), an alkoxy group having from 1 to 8 carbon atoms in total (e.g., methoxy, ethoxy, methoxyethoxy or butoxy) or an aryloxy group having from 6 to 24 carbon atoms in total (e.g., phenoxy, p-tolyloxy or p-methoxyphenoxy), and most preferably a chlorine atom, a methoxy group or a trifluoromethyl group.

$R_3$ is particularly preferably a halogen atom, an alkoxy group, an alkoxycarbonyl group, an aryloxycarbonyl group, a carbonamido group, a sulfonamido group, a carbamoyl group or a sulfamoyl group, and most preferably an alkoxy group, an alkoxycarbonyl group, an alkyl- or aryl-carbonamido group or an alkyl- or aryl-sulfonamido group.

X is particularly preferably a 5-membered heterocyclic group bonded to the coupling active position through a nitrogen atom contained in the ring (e.g., imidazolidine-2,4 dion-3-yl or oxazolidin-2,4-dion-3-yl) or an aryloxy group, an most preferably an imidazolidin-2,4-dion-3-yl group.

The couplers represented by the general formula (Y) may be in the form of a dimer, higher polymer (for example, telomer, homopolymer, or copolymer) or a bis-compound which is formed in the same manner as the coupler represented by formula (I) or (II) by bonding at $R_1$, Q, X or

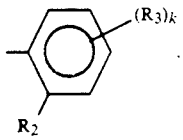

In such cases, the number of carbon atoms with respect to each substituent described above may be outside of the ranges described above.

When the couplers of formulae (I) to (V) and (Y) are in the form of a higher polymer, typical examples thereof include homopolymers or copolymers of addition polymerizable ethylenically unsaturated compounds having a yellow dye-forming coupler residue (yellow color forming monomers). Couplers represented by the following formula are preferred.

$$-(G_i)_{gi}-(H_j)_{hj}- \quad \text{(Y-a)}$$

In the formula (Y-a), $G_i$ is a repeating monomer unit derived from a color forming monomer and a linking group represented by the following formula (Y-b); $H_j$ is a repeating unit derived from a non-color forming monomer; i is a positive integer; j is 0 or a positive integer; and gi and hj are the weight fractions of $G_i$ and $H_j$, respectively. When i or j is 2 or greater, $G_i$ or $H_j$ is composed of two or more repeating units.

(Y-b)

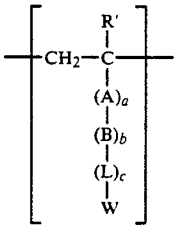

In the formula (Y-b), R′ is a hydrogen atom, a chlorine atom or an alkyl group having 1 to 4 carbon atoms; A is —CONH—, —COO— or a substituted or unsubstituted phenylene group; B is a substituted or unsubstituted alkylene, phenylene or aralkylene group; L is —CONH—, —NHCONH—, —NHCOO—, —NHCO—, —OCONH—, —NH—, —COO—, —OCO—, —CO—, —O—, —S—, —$SO_2$—, —$NHSO_2$— or —$SO_2NH$—; a, b, c are each 0 or 1; and W is a moiety of a yellow coupler formed by removing one hydrogen atom from $X_{1-7}$, $R_{1-4}$, Z, Y, or Ar in the coupler represented by formulae (I) to (V), or from $R_1$, Q, X or

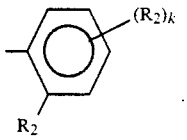

in the coupler represented by formula (Y).

Examples of the non-color forming ethylenic monomer represented by $H_j$ that are incapable of coupling with an oxidized aromatic primary amine developing agent include acrylic acid, α-chloroacrylic acid, α-alkylacrylic acids (e.g., methacrylic acid), amides and esters derived from these acrylic acids (e.g., acrylamide, methacrylamide, n-butylacrylamide, t-butylacrylamide, diacetone acrylamide, methyl acrylate, ethyl acrylate, n-propyl acrylate, n-butyl acrylate, t-butyl acrylate, isobutyl acrylate, 2-ethylhexyl acrylate, n-octyl acrylate, lauryl acrylate, methyl methacrylate, ethyl methacrylate, n-butyl methacrylate and β-hydroxyethyl methacrylate), vinyl esters (e.g., vinyl acetate, vinyl propionate and vinyl laurate), acrylonitrile, methacrylonitrile, aromatic vinyl compounds (e.g., styrene and derivatives thereof such as vinyltoluene, divinylbenzene, vinylacetophenone and sulfostyrene), itaconic acid, citraconic acid, crotonic acid, vinylidene chloride, vinyl alkyl ethers (e.g., vinyl ethyl ether), maleic esters, N-vinyl-2-pyrrolidone, N-vinylpyridine and 2- and 4-vinylpyridine. Acrylic esters, methacrylic esters and maleic esters are particularly preferred. These non-color forming ethylenic monomers may be used as a mixture of two or more of them. For example, a combination of methyl acrylate and butyl acrylate, a combination of butyl acrylate and styrene, a combination of butyl methacrylate and methacrylic acid or a combination of methyl acrylate and diacetone acrylamide can be used.

Ethylenically unsaturated monomers to be copolymerized with the vinyl monomers corresponding to the formula (Y-b) can be chosen so that the forms such as solid, liquid or micelle forms of the resulting copolymers, the physical properties and/or chemical properties (e.g., solubility in water or organic solvents) thereof, the compatibility thereof with binders such as gelatin in photographic colloid compositions, flexibility, thermal stability, the coupling reactivity thereof with the oxidation product of developing agents and non-diffusibility in photographic colloid are favorably affected, as is known in the field of polymer couplers. These copolymers may be any of a random copolymer and a specific sequence-copolymer (e.g., a block copolymer, an alternating copolymer).

The number-average molecular weight of the yellow polymer couplers used in the present invention is usually on the order of from several thousands to millions, but oligomer type polymers having a number-average molecular weight of 5000 or less can be used.

When formula (Y-a) represents a copolymer, the weight fractions of the repeating monomer units represented by gi and hj are preferably 10 to 100 and 90 to 0, respectively, and more preferably 30 to 70 and 70 to 30, respectively.

The yellow polymer couplers used in the present invention may be any of lipophilic polymers soluble in organic solvents (e.g., ethyl acetate, butyl acetate, ethanol, methylene chloride, cyclohexanone, dibutyl phthalate, tricresyl phosphate), hydrophilic polymers miscible with hydrophilic colloid such as an aqueous gelatin solution and polymers having a structure capable of forming a micelle in hydrophilic colloid.

The lipophilic polymer couplers obtained by polymerizing the vinyl monomers giving the coupler units of formula (Y-b) may be used by emulsifying and dispersing the solutions of the polymer in organic solvents in the form of a latex in an aqueous gelatin solution, or it can be obtained by direct emulsion polymerization.

A method for emulsifying and dispersing the lipophilic polymer couplers in the form of latex in an aqueous gelatin solution is described in U.S. Pat. No. 3,451,820. Emulsion polymerization can be carried out by methods described in U.S. Pat. Nos. 4,080,211 and 3,370,952.

Specific examples of the substituents in the general formula (Y) are set forth below.

(1) Examples of the

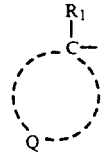

group:

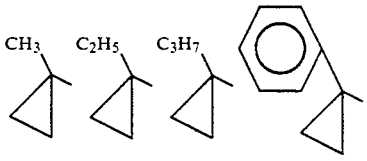

-continued

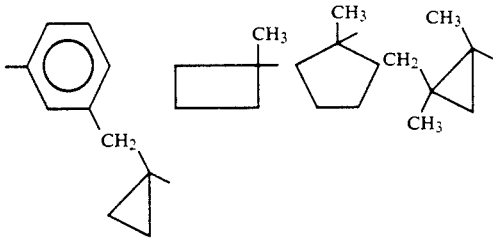

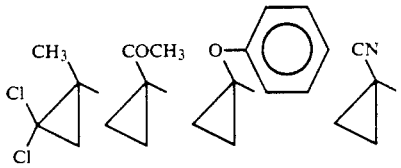

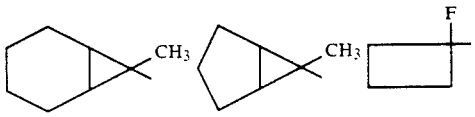

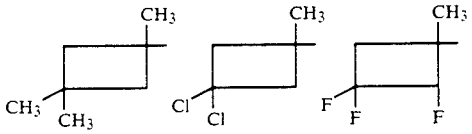

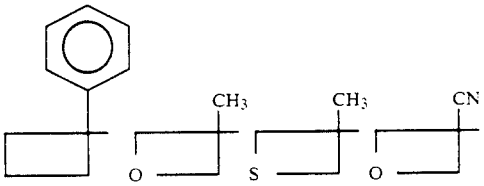

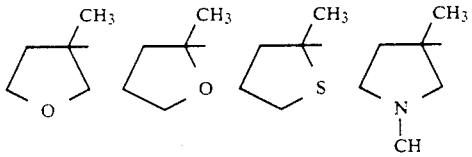

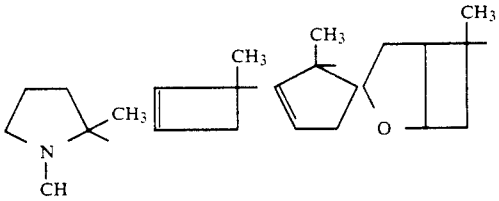

(2) Examples of $R_2$:

F, Cl, Br, I, $CH_2O$—,

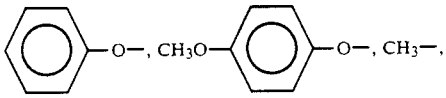

$C_2H_5$—, i-$C_3H_7$—, t-$C_4H_9$—, $CH_3OCH_2CH_2O$—, $CF_3$—, $(CH_3)_2N$—,

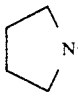

N—, n-$C_4H_9O$—,

-continued n-$C_{14}H_{29}O$, n-$C_{16}H_{33}O$—,

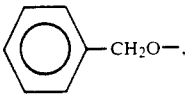

$CH_2O$—, n-$C_{12}H_{25}O$—.

(3) Examples of $R_3$:

F, Cl, Br, I, —$OCH_3$,

—$OC_{12}H_{25}$, —$OC_{16}H_{33}$, —$COOCH_3$,

—$COOC_{12}H_{25}$, —$COOCH(CH_3)COOC_{12}H_{25}$,

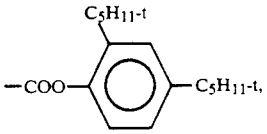

—COO—

$C_5H_{11}$-t,

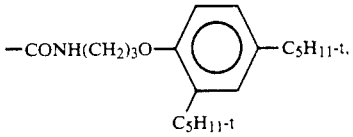

—$CONH(CH_2)_3O$—

$C_5H_{11}$-t, $C_5H_{11}$-t

—$SO_2NH(CH_2)_3OC_{12}H_{25}$, —$SO_2N(C_8H_{17})_2$,

—$SO_2N(CH_3)_2$, —$SO_2NHCOC_2H_5$,

—$NHCOC_{13}H_{27}$, —$NHCOCH(C_6H_{13})C_8H_{17}$,

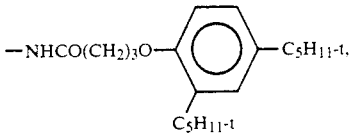

—$NHCO(CH_2)_3O$—

$C_5H_{11}$-t, $C_5H_{11}$-t

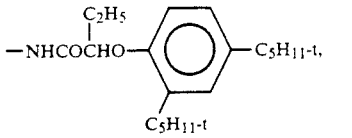

—$NHCOCH(C_2H_5)O$—

$C_5H_{11}$-t, $C_5H_{11}$-t

—$NHCOCH(CH_3)CH_2SO_2C_{12}H_{25}$,

—$NHSO_2C_{16}H_{33}$, —$NHSO_2$—

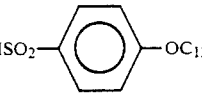

$OC_{12}H_{25}$

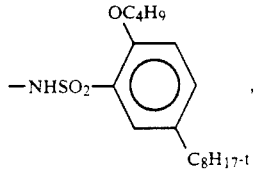

—$NHSO_2$—

$OC_4H_9$ $C_8H_{17}$-t

, —$SO_2NH$—

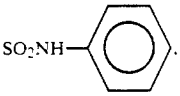

.

-continued
$-SO_2NHC_3H_7$-i, $-OCOC_{15}H_{31}$, $-OSO_2C_{16}H_{33}$, $-SO_2C_{12}H_{25}$, $-NHCOOC_{12}H_{25}$
(4) Examples of X:
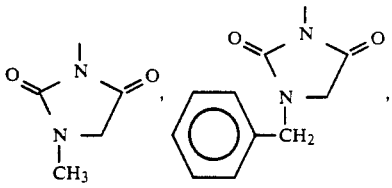
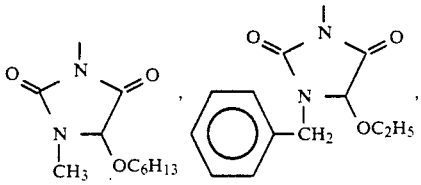
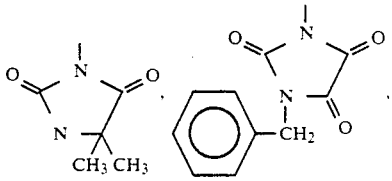
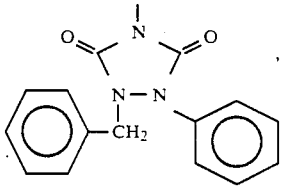
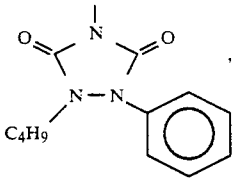
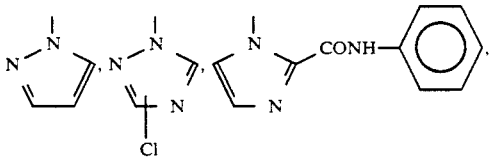
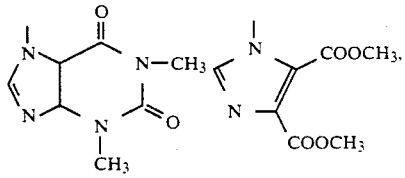
-continued
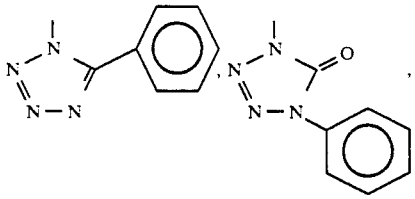
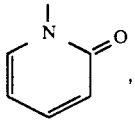
, H, Cl, Br, I, $-OCOCH_3$,
$-OSO_2CH_3$, 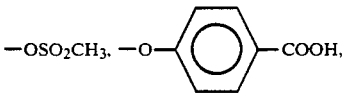
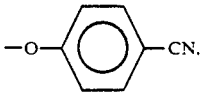
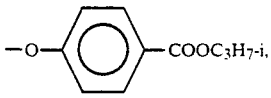
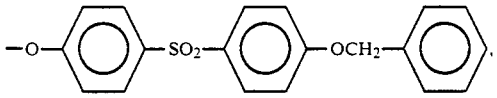
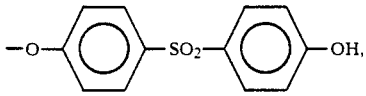
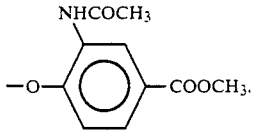
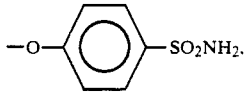
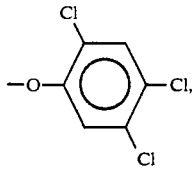
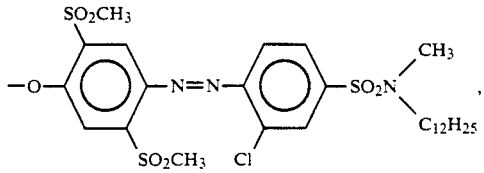

-continued
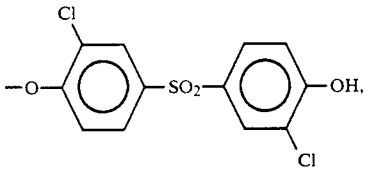
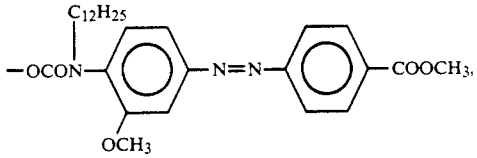
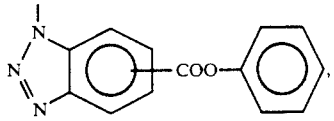
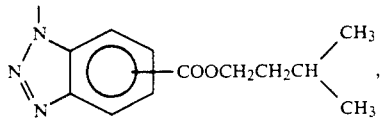
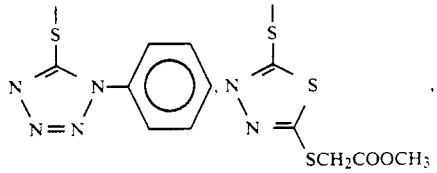
-continued
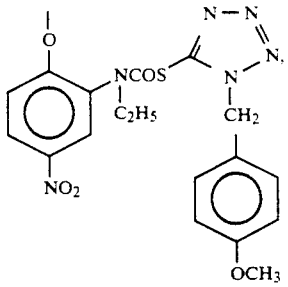
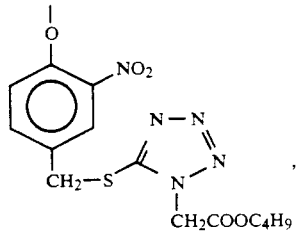
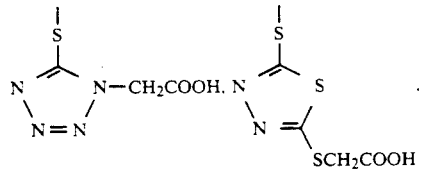
Specific examples of the yellow couplers represented by the general formula (A) are set forth below, but the present invention should not be construed as being limited thereto.
Y-1
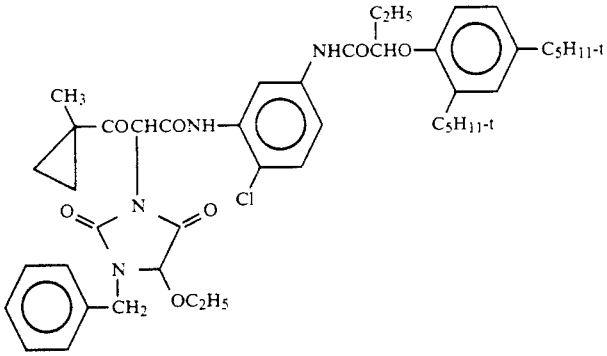
Y-2
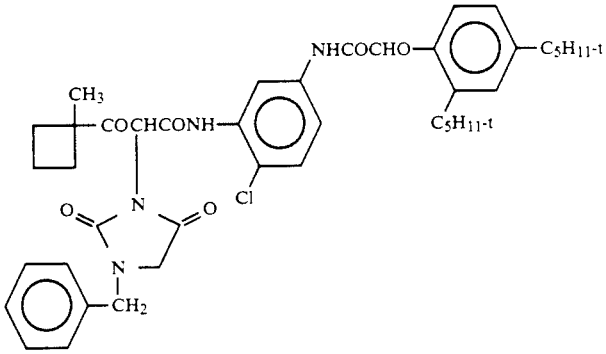

-continued
Y-3
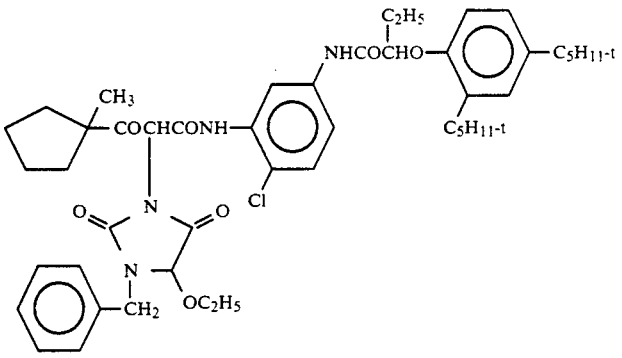
Y-4
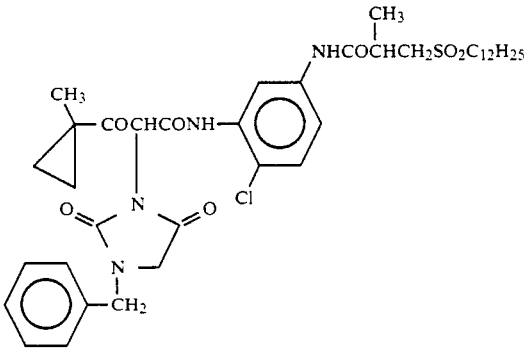
Y-5
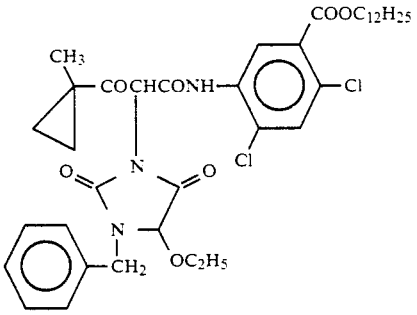
Y-6
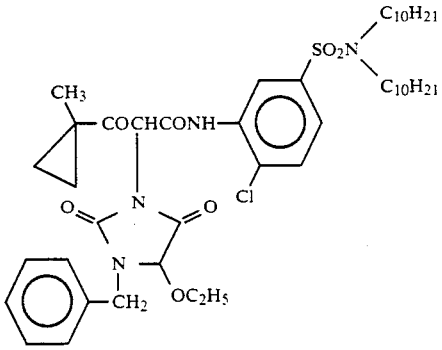

-continued
Y-7
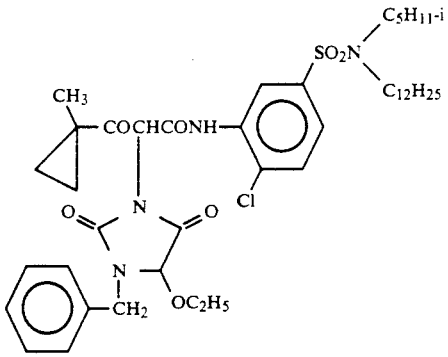
Y-8
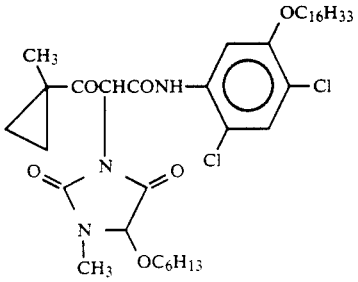
Y-9
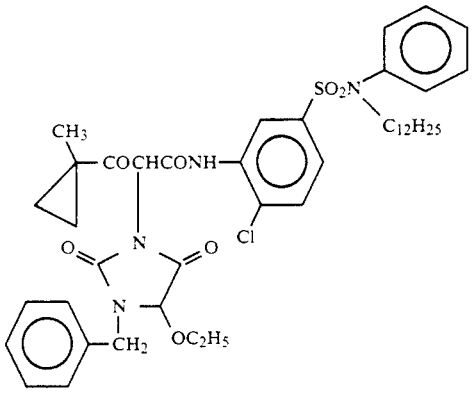
Y-10
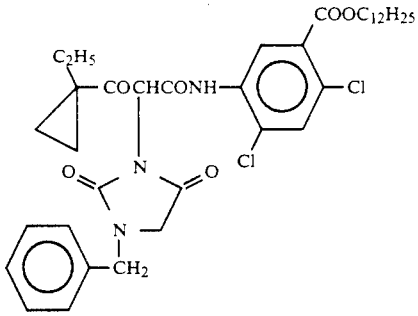
Y-11
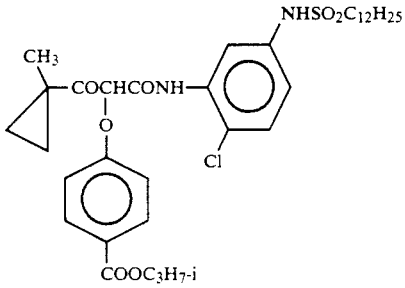

-continued
Y-12
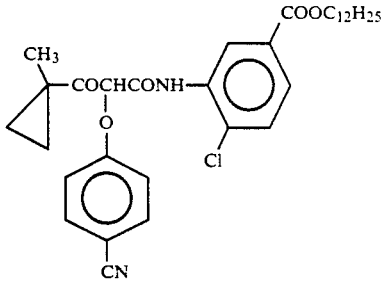
Y-13
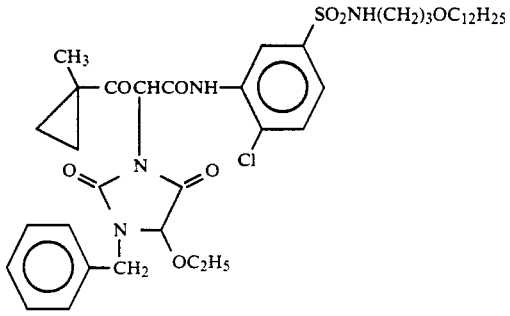
Y-14
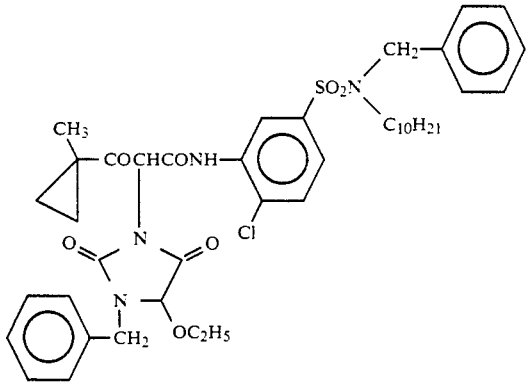
Y-15
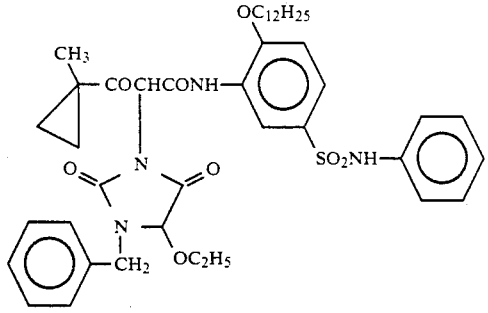
Y-16
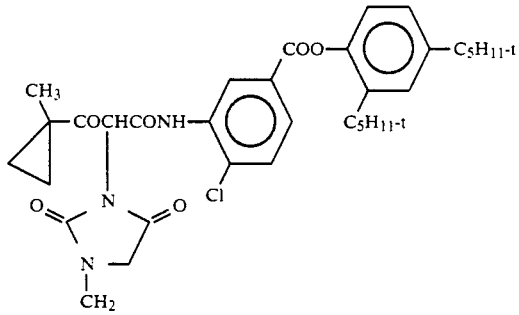

-continued
Y-17
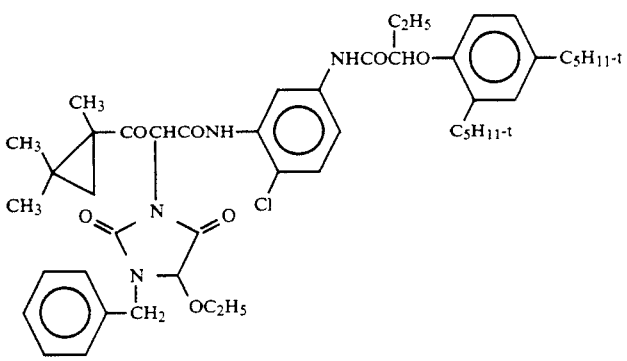
Y-18
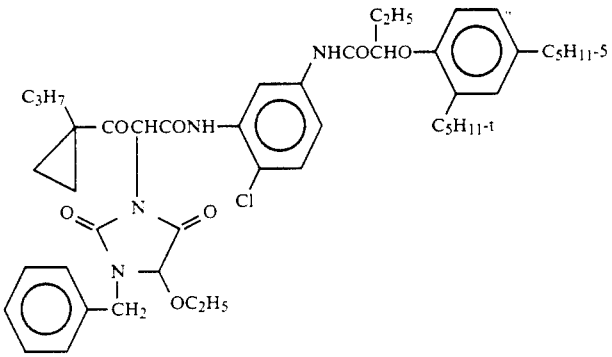
Y-19
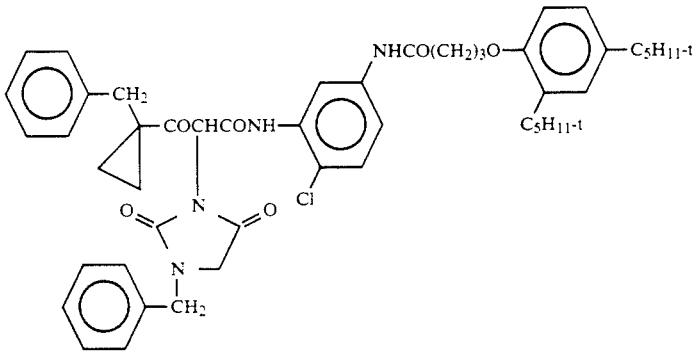
Y-20
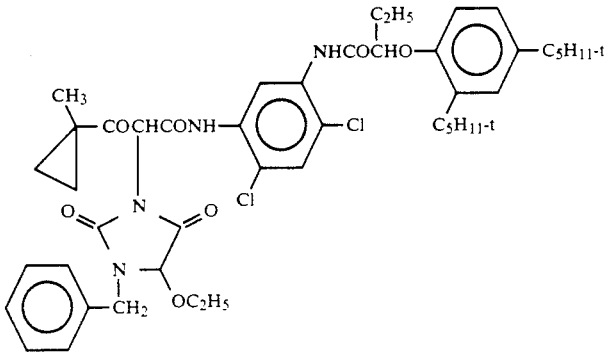

-continued
Y-21
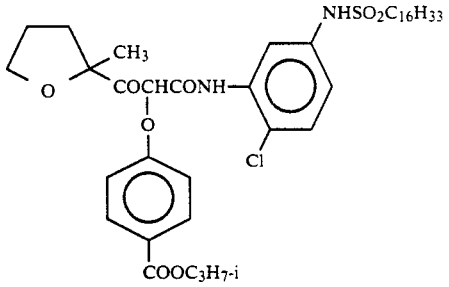
Y-22
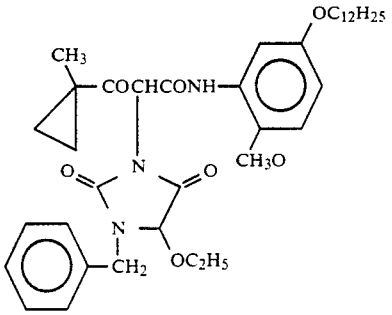
Y-23
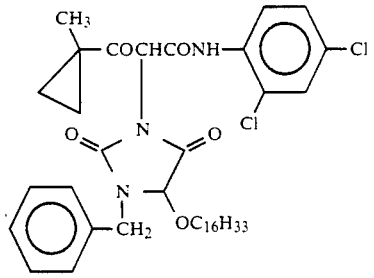
Y-24
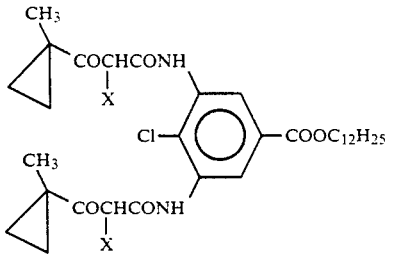
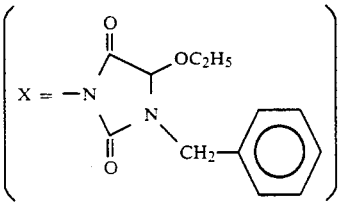

-continued
Y-25
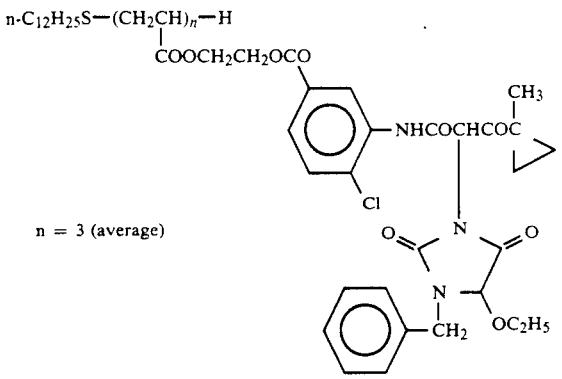
n = 3 (average)
Y-26
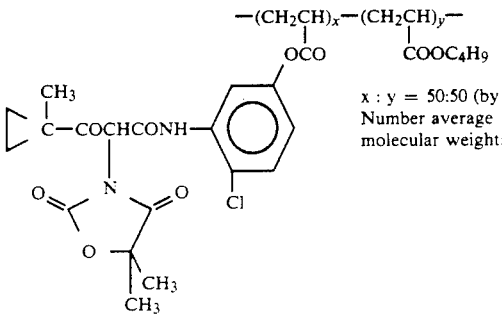
x : y = 50:50 (by weight)
Number average
molecular weight: 50,000
Y-27
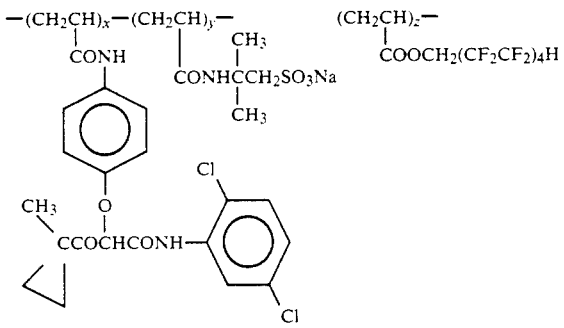
x : y : z = 50:30:20 (by weight)
Number average
molecular weight: 70,000
Y-28
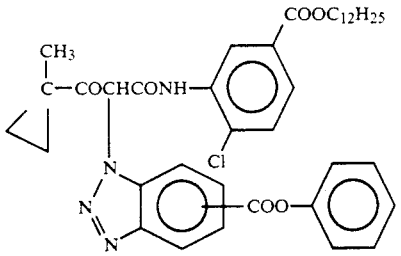
Y-29
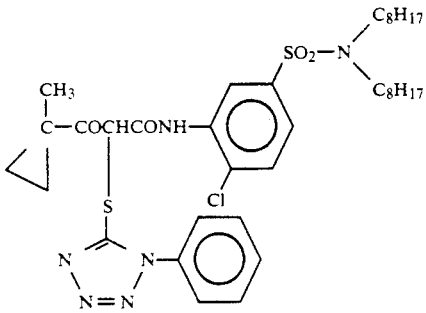

-continued

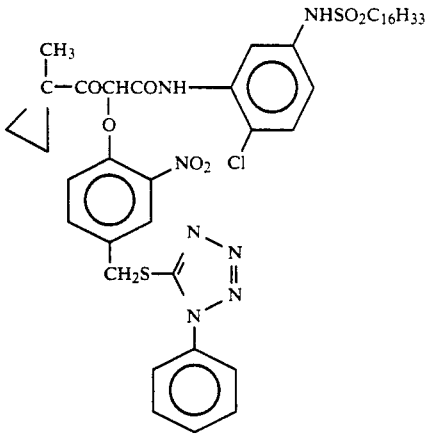

Y-30

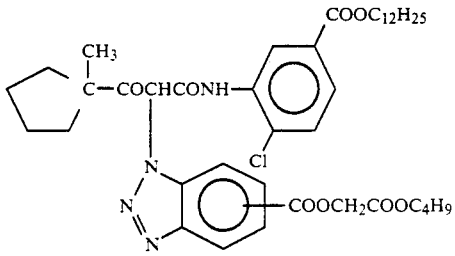

Y-31

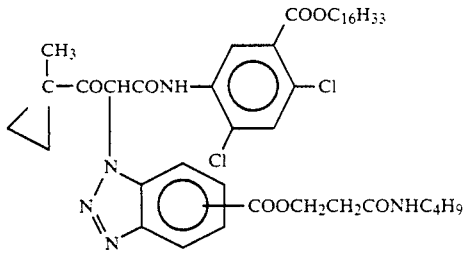

Y-32

The yellow couplers represented by the general formula (Y) can be synthesized from a carboxylic acid represented by the general formula (A)' shown below according to a conventionally known synthesis method (for example, synthesis method described in JP-A-51-102636).

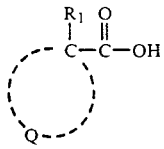

(A)'

The carboxylic acid represented by the general formula (A)' can be synthesized by a method described, for example, in *J. Chem. Soc.* (*C*), 2548 (1968), *J. Am. Chem. Soc.*, 56, 2710 (1934), *Synthesis*, 258 (1971), *J. Org. Chem.*, 43, 1729 (1978) or *CA*, 66, 18533y (1960).

The acyl acetamide coupler having the acyl group of the carboxylic acid represented by the general formula (A)' according to the present invention is preferably incorporated into a light-sensitive silver halide emulsion layer of a light-sensitive material or a light-insensitive layer (such as protective layer, antihalation layer and intermediate layer) adjacent to a silver halide emulsion layer and particularly preferably incorporated into a light-sensitive silver halide emulsion layer. The acyl acetamide coupler may also be incorporated into the layer containing the yellow coupler represented by formula (I) or (II). The total amount of the acyl acetamide coupler added to the light-sensitive material is preferably from $1\times10^{-3}$ to 1.2 g/m$^2$, more preferably from $1\times10^{-2}$ to 1.0 g/m$^2$, and particularly preferably from $1\times10^{-1}$ to 0.8g/m$^2$. When the coupler having no photographically useful groups at X in formula (Y) is added to a light-sensitive silver halide emulsion layer, it can be used in a range preferably from $5\times10^{-4}$ to 2 mols, more preferably from $1\times10^{-3}$ to 1 mol, and particularly preferably from $2\times10^{-2}$ to $5\times10^{-1}$ mol per mol of silver halide. When the coupler having a photographically useful group at X in formula (Y) is added to a light-sensitive silver halide emulsion layer, it can be used in a range preferably from $1\times10^{-4}$ to $5\times10^{-1}$ mol, more preferably from $2\times10^{-4}$ to $2\times10^{-1}$ mol, and particularly preferably from $5\times10^{-4}$ to $1\times10^{-2}$ mol per mol of silver halide. When the acyl acetamide coupler is incorporated into the light-insensitive layer, it can be used in a range preferably from $5\times10^{-5}$ to $2\times10^{-1}$ g/m$^2$, more preferably from $1\times10^{-4}$ to $1\times10^{-1}$ g/m$^2$, particular preferably from $2\times10^{-4}$ to $5\times10^{-2}$ g/m$^2$.

When the coupler represented by the general formula (I) and/or (II) and the coupler represented by the general formula (Y) are employed in the same layer, a mixing ratio of these coupler is not restricted and can be appropriately selected according on the object of use.

In such a case the ratio of the coupler represented by the general formula (Y) may be within the range of from 0.01 to 99.99 mol % based on the total of these couplers. When the coupler represented by the general formula (Y) is used separately from the layer containing the coupler represented by formula (I) and/or (II) the ratio of each coupler is from 0.01 to 99.99 mol % based on the total amount of these couplers in the photographic material.

The total amount of couplers represented by formula (I), (II) or (Y) in the photographic material is preferably from $1\times10^{-3}$ to 2.0 g/m$^2$, more preferably from $2\times10^{-3}$ to 1.5 g/m$^2$, particular preferably from $5\times10^{-3}$ to 1.2 g/m$^2$.

The acyl acetamide type coupler having an acyl group represented by the general formula (A) can be used as a mixture of two or more thereof, and can be used together with other known yellow couplers and various compounds described hereinafter. In the latter case the ratio of the coupler having an acyl group represented by the general formula (A) is preferably at least 50 mol % and more preferably at least 70 mol %.

When Z in the general formulae (I) and (II) and X in the general formula (Y) are photographically useful groups (for example, DIR group) couplers represented by these formulae may be incorporated into any layer of the blue-, red- and green-sensitive layers in the photographic material. When Z and X in the general formulae are not photographically useful groups the couplers preferably incorporated into a blue-sensitive layer.

When the yellow coupler represented by general formula (I), (II) or (Y) having a DIR group is incorporated into a green-sensitive layer containing a magenta coupler, fastness of magenta color images is improved. The type of the magenta coupler contained in the green-sensitive layer may be optionally selected. The amount of the yellow couplers in the green-sensitive layer to the total amount of the magenta coupler having no photographically useful group is preferably from $1\times10^{-2}$ to 20 mol %, more preferably from $1\times10^{-1}$ to 10 mol %, particular preferably from $2\times10^{-1}$ to 5 mol %.

The acyl acetamide couplers having an acyl group represented by the general formula (A) can be incorporated into a light-sensitive material together with a high-boiling point organic solvent described below.

The acyl acetamide couplers having an acyl group represented by the general formula (A) according to the present invention exhibit excellent properties, for example, a high color forming property and good preservability when incorporated into a light-sensitive material. Also, color images formed therefrom have a small absorption on the longer wavelength side, have excellent color reproducibility, and exhibit high fastness. Further, the couplers maintain high color forming property when the amount of high-boiling point organic solvent, described below, to be used is reduced.

In order to incorporate the coupler represented by the general formula (I) and/or (II) and the coupler having a group represented by the general formula (A) into a constituting layer of a light-sensitive material according to the present invention, various known techniques can be employed. Usually, they can be added according to an oil-droplet-in-water dispersion method known as an oil protected process. For example, couplers are first dissolved in a solvent, and then emulsified and dispersed in a gelatin aqueous solution containing a surface active agent. Alternatively, water or a gelatin aqueous solution may be added to a coupler solution containing a surface active agent, followed by phase inversion to obtain an oil-droplet-in-water dispersion.

For example, in an oil droplet-in-water type dispersing method as described, for example, in U.S. Pat. No. 2,322,027, couplers are dissolved in a high-boiling point organic solvent which has a boiling point above about 175° C. at normal pressure, for example, a phthalic acid ester, a phosphoric acid ester, a benzoic acid ester, a fatty acid ester, an amide, a phenol, an alcohol, a carboxylic acid, an N,N-dialkylaniline, a hydrocarbon, an oligomer and a polymer and/or a low-boiling point organic solvent which has a boiling point of from about 30° C. to about 160° C. at normal pressure, for example, an ester (e.g., ethyl acetate, butyl acetate, ethyl propionate, β-ethoxyethyl acetate, and methyl cellosolve acetate), an alcohol (e.g., secondary butyl alcohol), a ketone (e.g., methyl isobutyl ketone, methyl ethyl ketone, and cyclohexanone), an amide (e.g., dimethylformamide, and N-methylpyrrolidone), and an ether (e.g., tetrahydrofuran, and dioxan), and then emulsified and dispersed in a hydrophilic colloid such as gelatin. The coupler dispersion may be subjected to distillation, noodle washing, ultrafiltration, or the like to remove the low-boiling point solvent and then mixed with a photographic emulsion.

In the present invention, the high-boiling point organic solvents include water-insoluble polymer compounds as well as the above described plasticizers.

The high-boiling point organic solvent can be employed in any form of liquid, wax and solid. The high-boiling point organic solvents which have a dielectric constant preferably of from 2 to 20, more preferably from 3 to 15 (at 25° C.) and a refractive index preferably of from 1.30 to 1.70, more preferably from 1.35 to 1.60 (at 25° C.) are suitably employed.

The high-boiling point organic solvent used in the present invention is preferably represented by the following general formula (S-1), (S-2), (S-3), (S-4), (S-5), (S-6), (S-7), (S 8) or (S-9):

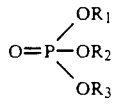
(S-1)

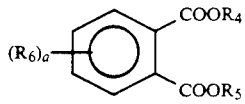
(S-2)

$(Ar-COO\rightarrow_b R_7$ (S-3)

$(R_8-COO\rightarrow_c R_9$ (S-4)

$R_{10}\leftarrow COO-R_{11})_d$ (S-5)

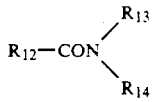
(S-6)

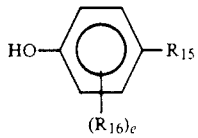
(S-7)

-continued

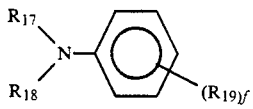

(S-8)

$$-(A_1)_{a1}-(A_2)_{a2}- \ldots -(A_n)_{an}- \quad \text{(S-9)}$$

wherein $R_1$, $R_2$ and $R_3$ each represents an alkyl group, a Cycloalkyl group or an aryl group; $R_4$ and $R_5$ each represents an alkyl group, a cycloalkyl group or an aryl group; $R_6$ represents a halogen atom (e.g., F, Cl, Br, and I), an alkyl group, an alkoxy group, an aryloxy group or an alkoxycarbonyl group; a represents an integer of from 0 to 3, and when a represents 2 or 3, two or three $R_6$'s may be the same or different; Ar represents an aryl group; b represents an integer of from 1 to 6; $R_7$ represents a b-valent hydrocarbon group or a hydrocarbon group connected via an ether bond; $R_8$ represents an alkyl group or a cycloalkyl group; c represents an integer of from 1 to 6; $R_9$ represents a c-valent hydrocarbon group or a hydrocarbon group connected via an ether bond; d represents an integer of from 2 to 6; $R_{10}$ represents a d-valent hydrocarbon group provided that aromatic groups are excluded; $R_{11}$ represents an alkyl group, a cycloalkyl group or an aryl group; $R_{12}$, $R_{13}$ or $R_{14}$ each represents a hydrogen atom (provided that two or more of $R_{12}$, $R_{13}$ $R_{14}$ do not represent a hydrogen atom at the same time), an alkyl group, a cycloalkyl group or an aryl group, or $R_{12}$ and $R_{13}$ or $R_{13}$ and $R_{14}$ may combine with each other to form a ring; $R_{15}$ represents an alkyl group, a cycloalkyl group, an alkoxycarbonyl group, an alkylsulfonyl group, an arylsulfonyl group, an aryl group or a cyano group; $R_{16}$ represents a halogen atom, an alkyl group, a cycloalkyl group, an aryl group, an alkoxy group or an aryloxy group; e represents an integer of from 0 to 3, and when e represents 2 or 3, two or three $R_{16}$'s may be the same or different; $R_{17}$ and $R_{18}$ each represents an alkyl group, a cycloalkyl group or an aryl group; $R_{19}$ represents a halogen atom, a cycloalkyl group, an alkyl group, an aryl group, an alkoxy group or an aryloxy group; f represents an integer of from 0 to 4, and when f represents 2, 3 or 4, two, three or four $R_{19}$'s may be the same or different; the above-described groups except a halogen atom may be substituted; $A_1$, $A_2$, . . . and $A_n$ each represents a polymer unit formed from a noncolor forming ethylenic monomer, each different from the other; $a_1$, $a_2$, . . . and $a_n$ each represents a weight ratio of the polymer unit; and n represents an integer of from 1 to 30.

Specific examples of the high-boiling point organic solvent which are employed in the present invention are set forth below, but the present invention should not be construed as being limited thereto.

S-1

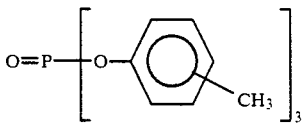

(a mixture of o-, m-, and p-compounds)

-continued

S-2

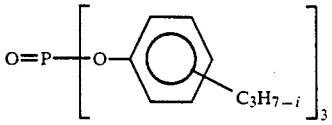

(a mixture of o-, m-, and p-compounds)

S-3

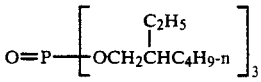

S-4

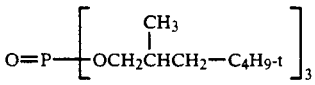

S-5

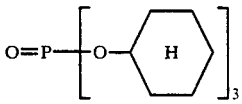

S-6

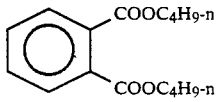

S-7

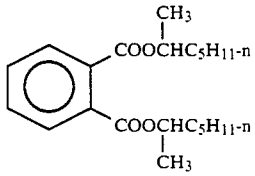

S-8

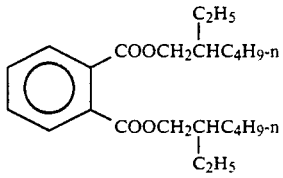

S-9

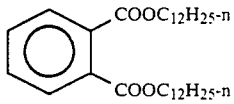

S-10

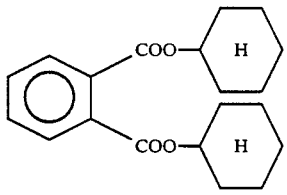

S-11

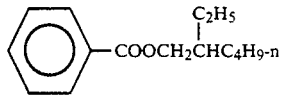

S-12

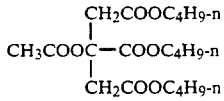

S-13

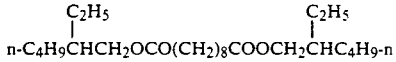

-continued

S-14 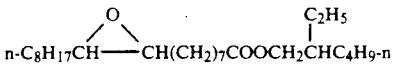

S-15 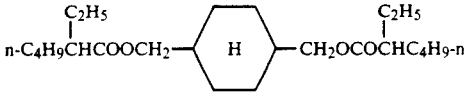

S-16 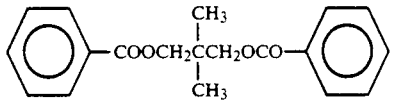

S-17 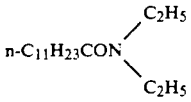

S-18 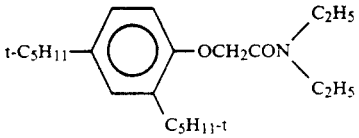

S-19 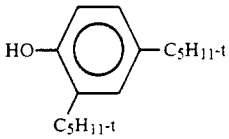

S-20 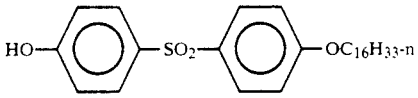

S-21 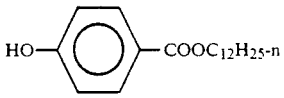

S-22 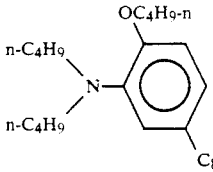

S-23 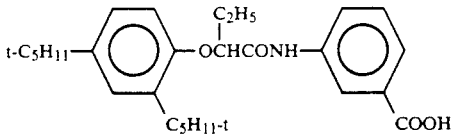

S-24 Polymethylmethacrylate
(average molecular weight 20,000)

S-25 Poly(N-t-butylacrylamido)
(average molecular weight 60,000)

S-26 Chlorinated paraffin (average composition: $C_{12}H_{18}Cl_8$)

Other examples of the high-boiling point organic solvent which can be used in the present invention and/or synthesis methods thereof are described, for example, in U.S. Pat. Nos. 2,322,027, 2,533,514, 2,772,163, 2,835,579, 3,676,137, 3,912,515, 3,936,303, 4,080,209, 4,127,413, 4,193,802, 4,239,851, 4,278,757, 4,636,873, 4,483,918 and 4,745,049, European Patent 276,319A, JP-A-48 47335, JP-A-51-149028, JP-A-61-84641, JP-A-62-118345, JP-A-62-247364, JP-A-63-167357, JP-A-64-68745 and JP-A-1-101543.

In the present invention, the high-boiling point organic solvent described above is employed in an amount so that a weight ratio of the organic solvent to the total weight of the coupler represented by the general formula (I) and/or (II) described above and the coupler containing the acyl group represented by the general formula (A) described above contained in the same layer is preferably not more than 1.0. The weight ratio is more preferably in a range of from 0.01 to 0.50, particularly preferably in a range of from 0.05 to 0.35.

The reduction of the above described weight ratio of high-boiling point organic solvent to coupler is advantageous since it effects an improvement in the image quality of the layers positioned under the layer containing the organic solvent and coupler (i.e., layers close to the support). In general, however, the reduction of the weight ratio undesirably results in a decrease in the fastness of the color image and in an increase in the fluctuation of photographic performance during preservation of the light-sensitive material. On the contrary, the combination of the couplers according to the present invention has the advantage that it can reduce these degradations.

The high-boiling point organic solvent can be used as a mixture of two or more thereof, and can be used together with other high-boiling point organic solvent.

The photographic light-sensitive material of the present invention may have at least one blue-sensitive silver halide emulsion layer, at least one green-sensitive silver halide emulsion layer and at least one red-sensitive silver halide emulsion layer on a support. The number of silver halide emulsion layers and light-insensitive layers and the order thereof are not particularly restricted. One typical example is a silver halide photographic material comprising a support having thereon at least one light-sensitive layer composed of a plurality of silver halide emulsion layers which have substantially the same spectral sensitivity but different speeds. The light-sensitive layer is a unit light-sensitive layer having a spectral sensitivity to any of blue light, green light and red light. In a multilayer silver halide color photographic material, unit light-sensitive layers are generally provided on the support in the order of a red-sensitive layer, a green-sensitive layer and a blue-sensitive layer from the support side. The order of these layers can be varied depending on the purpose. Further, a layer structure wherein between two layers having the same spectral sensitivity, a light-sensitive layer having a different spectral sensitivity is sandwiched may be used.

Between the above described silver halide light-sensitive layers or as the uppermost layer or the undermost layer, various light-insensitive layers such as an intermediate layer can be provided.

Into such a intermediate layer, couplers and DIR compounds as described, for example, in JP-A-61-43748, JP-A-59-113438, JP A-59-113440, JP-A-61-20037 and JP-A-61-20038 may be incorporated. Further, the intermediate layer may contain conventional agents to prevent color mixing.

The plurality of silver halide emulsion layers which constitute the unit light-sensitive layer preferably have a two layer construction, consisting of a high speed emulsion layer and a low speed emulsion layer as described, for example, in West German Patent 1,121,470 and British Patent 923,045. It is preferred that these layers are disposed in order of increasing speed from the support side. Further, a light-insensitive layer may be provided between silver halide emulsion layers. Moreover, a low speed emulsion layer may be provided further away from the support and a high speed emulsion layer may be provided on the side closest to the support as described, for example, in JP-A-57-112751, JP-A-62-200350, JP-A-62-206541 and JP-A-62-206543.

Specific examples of the layer construction include in order starting farthest from the support a low speed blue-sensitive layer (BL)/a high speed blue-sensitive layer (BH)/a high speed green-sensitive layer (GH)/a low speed green-sensitive layer (GL)/a high speed red-sensitive layer (RH)/a low speed red-sensitive layer (RL); an order of BH/BL/GL/GH/RH/RL; or an order of BH/BL/GH/GL/RL/RH.

Further, an order of a blue-sensitive layer/GH/RH/GL/RL from the farthest from the support as described in JP-B-55-34932 may be employed. Moreover, an order of a blue-sensitive layer/GL/RL/GH/RH from the farthest from the support as described in JP-A-56-25738 and JP-A-62-63936 may also employed.

Furthermore, a layer construction of three layers having different speeds consisting of an upper silver halide emulsion layer having the highest speed, an intermediate silver halide emulsion layer having lower speed than that of the upper layer, and a lower silver halide emulsion layer having lower speed than that of the intermediate layer in order of increasing speed from the support side as described in JP-B-49-15495 is also employed. When the unit light-sensitive layer of the same spectral sensitivity is composed of three layers having different speeds, an order of an intermediate speed emulsion layer/a high speed emulsion layer/a low speed emulsion layer from the farthest from the support may be employed as described in JP-A-59-202464.

In addition, an order of a high speed emulsion layer/a low speed emulsion layer/an intermediate speed emulsion layer, or an order of a low speed emulsion layer/an intermediate speed emulsion layer/a high speed emulsion layer may be employed.

In case of consisting four layers or more, the order can be varied as described above.

In order to improve color reproducibility, it is preferred that a donor layer (CL) of interimage effect having a spectral sensitivity distribution different from that of the main light-sensitive layer such as BL, GL or RL is provided adjacent or close to the main layer as described, for example, in U.S. Pat. Nos. 4,663,271, 4,705,744 and 4,707,436, JP-A-62-160448 and JP-A-63-89580.

As described above, various layer constructions and dispositions may be appropriately selected depending on the purpose of the photographic light-sensitive material.

In the photographic light-sensitive material of the present invention, the silver halide preferably employed in the photographic emulsion layers is silver iodobromide, silver iodochloride or silver iodochlorobromide each containing about 30 mol % or less of silver iodide. Silver iodobromide or silver iodochlorobromide each containing from about 2 mol % to about 10 mol % of silver iodide is particularly preferred.

Silver halide grains in the silver halide emulsion may have a regular crystal structure, for example, a cubic, octahedral or tetradecahedral structure, an irregular crystal structure, for example, a spherical or tabular structure, a crystal defect, for example, a twin plane, or a composite structure thereof.

A particle size of silver halide may vary from fine grains of about 0.2 micron or less to large size grains of about 10 microns of a diameter of projected area. Further, a polydispersed emulsion and a monodispersed emulsion may be used.

The silver halide photographic emulsion which can be used in the present invention can be prepared using known methods, for example, those as described in *Research Disclosure,* No. 17643 (December, 1978), pages 22 to 23; "I. Emulsion Preparation and Types", ibid., No. 18716 (November, 1979), page 648; ibid., No. 307105 (November, 1989), pages 863 to 865; P. Glafkides, *Chimie et Physique Photographique,* Paul Montel (1967); G. F. Duffin, *Photographic Emulsion Chemistry,* The Focal Press (1966); and V. L. Zelikman et al., *Making and Coating Photographic Emulsion,* The Focal Press (1964).

Monodispersed emulsions as described, for example, in U.S. Pat. Nos. 3,574,628 and 3,655,394, and British Patent 1,413,748 are preferably used in the present invention.

Further, tabular silver halide grains having an aspect ratio of about 3 or more can be employed in the present invention. The tabular grains may be easily prepared by the method described, for example, in Gutoff, *Photographic Science and Engineering,* Vol. 14, pages 248 to 257 (1970), U.S. Pat. Nos. 4,434,226, 4,414,310, 4,433,048 and 4,439,520, and British Patent 2,112,157.

The crystal structure of silver halide grains may be uniform, composed of different halide compositions between the inner portion and the outer portion, or may have a stratified structure.

Further, silver halide in which silver halide grains having different compositions are connected by epitaxial junctions or silver halide in which silver halide grains are connected with compounds other than silver halide such as silver thiocyanate, or lead oxide, may also be employed.

Moreover, a mixture of grains having a different crystal structure may be used.

The silver halide emulsion used in the present invention may be a surface latent image type emulsion wherein latent images are mainly formed on the surfaces of grains, an internal latent image type emulsion wherein latent images are mainly formed in the interior of grains or an emulsion wherein latent images are formed both on the surface and in the interior of grains. In any event, it is necessary to be a negative type emulsion. Among the internal latent image type emulsions, core/shell type internal latent image type emulsions as described in JP-A-63-264740 may be employed. A method for preparation of core/shell type internal latent image type emulsions is described in JP-A-59-133542. In such emulsions, the thickness of the shell of the grain may be varied depending on the condition of development processing of the emulsions, but is preferably from 3 to 40 nm, particularly preferably from 5 to 20 nm.

The silver halide emulsions used in the present invention are usually subjected to physical ripening, chemical ripening and spectral sensitization. Various kinds of additives which can be employed in these steps are described in *Research Disclosure,* No. 17643, (December, 1978), ibid., No. 18716 (November, 1979) and ibid., No. 307105 (November, 1989) and relevant items thereof are summarized in the table shown below.

In the photographic light-sensitive material of the present invention, two or more kinds of emulsions which are different from each other with respect to at least one characteristic of grain size, grain size distribution, halogen composition, shape of grain and sensitivity of light-sensitive silver halide emulsions may be employed as a mixture in the same layer.

Further, surface-fogged silver halide grains as described in U.S. Pat. No. 4,082,553, internal-fogged silver halide grains and colloidal silver as described in U.S. Patent 4,626,498 and JP-A-59-214852, and colloidal silver can preferably be incorporated into light-sensitive silver halide emulsion layers and/or substantially light-insensitive hydrophilic colloid layers. Surface-fogged or internal-fogged silver halide grains are silver halide grains which may uniformly (non imagewise) developed irrespective of the nonexposed area and the exposed area of the photographic light-sensitive material. Methods for preparation of internal-fogged or surface-fogged silver halide grains are described in U.S. Patent 4,626,498 and JP-A-59-214852.

The silver halide for forming the internal core of the internal-fogged core/shell type silver halide grains may have the same halogen composition or two or more different halogen compositions. As the internal-fogged or surface-fogged silver halide, any of silver chloride, silver chlorobromide, silver iodobromide or silver chloroiodobromide may be employed. The grain size of the fogged silver halide grains is not specifically restricted but is preferably from 0.01 to 0.75 μm, particularly preferably from 0.05 to 0.6 μm as the mean grain size. The shape of the grains is not also specifically restricted, and the grains may be regular grains. Further, it is preferably a monodispersed emulsion, although a polydispersed emulsion may be employed. The term "monodispersed emulsion" as used herein means an emulsion in which at least 95% by weight or by number of the silver halide grains have a grain size falling within the range of the mean grain size ±40%.

In the present invention, it is preferred to employ a light-insensitive fine grain silver halide. The terminology "light-insensitive fine grain silver halide" means silver halide fine grains which are not sensitive to light at the time of imagewise exposure for obtaining dye images and are not substantially developed on development processing. These silver halide fine grains are preferably those previously not fogged.

The fine grain silver halide has a silver bromide content of from 0 to 100 mol %, and may contain silver chloride and/or silver iodide, if desired. Preferred silver halides are those containing from 0.5 to 10 mol % of silver iodide.

The fine grain silver halide has preferably an average grain size (the average value of the diameter corresponding to a circle of the projected area) of from 0.01 to 0.5 μm, more preferably from 0.02 to 0.2 μm.

The fine grain silver halide can be prepared by the same methods as those for conventional light-sensitive silver halide. The surface of the silver halide grain does not need to be optically sensitized. Spectral sensitization is also not needed. However, it is preferred to have previously added a known stabilizer, for example, a triazole compound, an azaindene compound, a benzothiazolium compound, a mercapto compound, or a zinc compound to the fine grain silver halide before it is added to the coating solution. A layer containing the fine grain silver halide may preferably contain colloidal silver.

A coating amount of silver in the photographic light-sensitive material of the present invention is preferably 6.0 g/m$^2$ or less, more preferably 4.5 g/m$^2$ or less.

Further, known photographic additives which can be used in the present invention are also described in the above described *Research Disclosure* references and concerned items thereof are summarized in the table below.

| Kind of Additives | RD17643 | RD18716 | RD307105 |
|---|---|---|---|
| 1. Chemical sensitizer | p. 23 | p. 648, right col. | p. 866 |
| 2. Sensitivity increasing agent | p. 23 | p. 648, right col. | p. 866 |
| 3. Spectral sensitizer and Supersensitizer | pp. 23–24 | p. 648, right col. to p. 649, right col. | pp. 866–868 |
| 4. Whiteners | p. 24 | p. 647, right col. | p. 868 |
| 5. Antifoggant and Stabilizer | pp. 24–25 | p. 649, right col. | pp.868–870 |
| 6. Light Absorbent, Filter Dye, and UV Absorbent | pp. 25–26 | p. 649, right col. to p. 650, left col. | p. 873 |
| 7. Antistaining Agents | p. 25, right col. | p. 650, left to right cols. | p. 872 |
| 8. Dye Image Stabilizer | p. 25 | p. 650, left col. | p. 872 |
| 9. Hardeners | p. 26 | p. 651, left col. | pp. 874–875 |
| 10. Binders | p. 26 | p. 651, left col. | pp. 873–874 |
| 11. Plasticizer and Lubricants | p. 27 | p. 650, right col. | p. 876 |
| 12. Coating Aids and Surfactants | pp. 26–27 | p. 650, right col. | pp. 875–876 |
| 13. Antistatic Agents | p. 27 | p. 650 right col. | pp. 876–877 |
| 14. Matting agents | | | pp. 878–879 |

Further, in order to prevent degradation of the photographic property due to formaldehyde gas, it is preferred to add a compound capable of reacting with formaldehyde to fix it as described in U.S. Pat. Nos. 4,411,987 and 4,435,503 to the photographic light- (sensitive material.

It is also preferred to incorporate mercapto compounds as described in U.S. Pat. Nos. 4,740,454 and 4,788,132, JP-A-62-18539 and JP-A-1-283551 into the photographic light sensitive material of the present invention.

It is also preferred to incorporate compounds capable of releasing a fogging agent, a development accelerator, a silver halide solvent or precursors thereof, irrespective of the amount of the developed silver to be formed by development processing as described in JP-A-1-106052, into the photographic light-sensitive material of the present invention.

It is also preferred to incorporate dispersed dyes as described in International Patent Laid-Open No. WO88/04794 and Japanese Patent Kohyo Koho Hei-1-502912 and dyes as described in European Patent 317,308A, U.S. Pat. No. 4,420,555 and JP-A-1-259358 into the photographic light-sensitive material of the present invention.

In the present invention, various color couplers can be employed and specific examples thereof are described in the patents cited in *Research Disclosure*, No.

17643, "VII-C" to "VII-G" and ibid., No. 307105, "VII-C" to "VII-G".

As yellow couplers used in the present invention, for example, those as described in U.S. Pat. Nos. 3,933,501, 4,022,620, 4,326,024, 4,401,752 and 4,248,961, JP-B-58-10739, British Patents 1,425,020 and 1,476,760, U.S. Pat. Nos. 3,973,968, 4,314,023 and 4,511,649, and European Patent 249,473A are preferred, in addition to the above described couplers.

As magenta couplers used in the present invention pyrazolone type and pyrazoloazole type compounds are preferred. Magenta couplers as described, for example, in U.S. Pat. Nos. 4,310,619 and 4,351,897, European Patent 73,636, U.S. Pat. Nos. 3,061,432 and 3,725,067, *Research Disclosure,* No. 24220 (June, 1984), JP-A-60-33552, *Research Disclosure,* No. 24230 (June, 1984), JP-A-60-43659, JP-A-61-72238, JP-A-60-35730, JP-A-55-118034, JP-A-60-185951, and U.S. Pat. Nos. 4,500,630, 4,540,654 and 4,556,630, and International Patent Laid-Open No. WO88/04795 are particularly preferred.

As cyan couplers used in the present invention phenol type and naphthol type couplers are exemplified. Cyan couplers as described, for example, in U.S. Pat. Nos. 4,052,212, 4,146,396, 4,228,233, 4,296,200, 2,369,929, 2,801,171, 2,772,162, 2,895,826, 3,772,002, 3,758,308, 4,334,011 and 4,327,173, West German Patent Application (OLS) No. 3,329,729, European Patents 121,365A and 249,453A, U.S. Pat. Nos. 3,446,622, 4,333,999, 4,775,616, 4,451,559, 4,427,767, 4,690,889, 4,254,212 and 4,296,199, and JP-A-61-42658 are preferred. Further, pyrazoloazole type couplers as described in JP-A-64-553, JP-A-64-554, JP-A-64-555 and JP-A 64-556, and imidazole couplers as described in U.S. Pat. No. 4,818,672 can be employed.

Typical examples of polymerized dye forming couplers are described, for example, in U.S. Pat. Nos. 3,451,820, 4,080,211, 4,367,282, 4,409,320 and 4,576,910, British Patent 2,102,137, and European Patent 341,188A.

As couplers capable of forming appropriately diffusible dyes, those as described, for example, in U.S. Pat. No. 4,366,237, British Patent 2,125,570, European Patent 96,570, and West German Patent Application (OLS) No. 3,234,533 are preferable employed.

As colored couplers for correcting undesirable absorptions of dyes formed, those as described, for example, in *Research Disclosure,* No. 17643, "VII-G", ibid., No. 307105, "VII-G", U.S. Patent 4,163,670, JP-B-57-39413, U.S. Pat. Nos. 4,004,929 and 4,138,258, and British Patent 1,146,368 are preferably employed. It is also preferred to use couplers for correcting undesirable absorptions of dyes formed by a fluorescent dye released upon coupling as described, for example, in U.S. Pat. No. 4,774,181, or couplers having a dye precursor group capable of forming a dye upon reaction with a developing agent, as a releasing group, as described, for example, in U.S. Pat. No. 4,777,120.

Couplers capable of releasing a photographically useful moiety during the course of coupling can be also employed preferably in the present invention. As DIR couplers capable of releasing a development inhibitor, those described, for example, in the patents cited in *Research Disclosure,* No. 17643, "VII-F" and ibid., No. 307105, "VII-F" described above, JP-A-57-151944, JP-A-57-154234, JP-A-60-184248, JP-A-63-37346, JP-A-63-37350, and U.S. Pat. Nos. 4,248,962 and 4,782,012 are preferred.

Couplers capable of releasing a bleach accelerator as described, for example, in *Research Disclosure,* No. 11449, ibid., No. 24241, and JP-A-61-201247 are useful for reducing the period for a processing step having bleaching ability. They are particularly effective when incorporated into the photographic light-sensitive material containing tabular silver halide grains described above.

As couplers which release imagewise a nucleating agent or a development accelerator at the time of development, those as described, for example, in British Patents 2,097,140 and 2,131,188, JP-A-59-157638, and JP-A-59-170840 are preferred. Further, compounds capable of releasing a fogging agent, a development accelerator or a silver halide solvent upon an oxidation reduction reaction with an oxidation product of a developing agent as described in JP-A-60-107029, JP-A-60-252340, JP A-1-44940 and JP-A-1-45687 are preferably employed.

Furthermore, competing couplers such as those described, for example, in U.S. Pat. No. 4,130,427; polyequivalent couplers such as those described, for example, in U.S. Pat. Nos. 4,283,472, 4,338,393 and 4,310,618; DIR redox compound or DIR coupler releasing couplers or DIR coupler or DIR redox compound releasing redox compound such as those described, for example, in JP-A-60-185950 and JP-A-62-24252; couplers capable of releasing a dye which turns to a colored form after being released such as those described, for example, in European Patents 173,302A and 313,308A; ligand releasing couplers such as those described, for example, in U.S. Pat. No. 4,555,477; couplers capable of releasing a leuco dye such as those described, for example, in JP-A-63-75747; and couplers capable of releasing a fluorescent dye such as those described, for example, in U.S. Pat. No. 4,774,181 may be employed in the photographic light-sensitive material of the present invention.

The couplers which are used in the present invention can be introduced into the photographic light-sensitive material according to various dispersing methods in addition to an oil droplet-in-water type dispersion method described hereinbefore.

The processes and effects of latex dispersing methods and the specific examples of latexes for loading are described, for example, in U.S. Pat. No. 4,199,363, West German Patent Application (OLS) Nos. 2,541,274 and 2,541,230.

It is preferred to add various kinds of antiseptics or antimolds for example, phenethyl alcohol or, 1,2-benzisothiazolin-3-one, n-butyl p-hydroxybenzoate, phenol, 4-chloro-3,5-dimethylphenol, 2-phenoxyethanol, or 2-(4-thiazolyl)benzimidazole, as described, for example, in JP-A-63-257747, JP-A-62-272248 and JP-A-1-80941 to the color photographic light-sensitive material of the present invention.

The present invention can be applied to various color photographic light-sensitive materials, and typical examples thereof include color negative films for the general use or cinematography, color reversal films for slides or television, color papers, color positive films, and color reversal papers.

Suitable supports which can be used in the present invention are described, for example, in *Research Disclosure,* No. 17643, page 28, ibid., No. 18716, page 647, right column to page 648, left column, and ibid., No. 307105, page 879, as mentioned above.

It is preferred that the total layer thickness of all hydrophilic colloid layers provided on the emulsion layer side of the photographic light-sensitive material according to the present invention is not more than 28 μm, more preferably not more than 23 μm, further more preferably not more than 18 μm, and particularly preferably not more than 16 μm. Also, a layer swelling rate of $T_{\frac{1}{2}}$ is preferably not more than 30 seconds, more preferably not more than 20 seconds. The layer thickness means the thickness of layer measured after preservation under the condition of 25° C. and relative humidity of 55% for 2 days. The layer swelling rate of $T_{\frac{1}{2}}$ is determined according to known methods in the art. For instance, the degree of swelling can be measured using a swellometer of the type described in A. Green, *Photogr. Sci. Eng.*, Vol. 19, No. 2, page 124 to 129, and $T_{\frac{1}{2}}$ is defined as a time necessary for reaching a layer thickness to a half (½) of a saturated layer thickness which is 90% of the maximum swelling layer thickness obtained when treated in a color developing solution at 30° C. for 3 minutes and 15 seconds.

The layer swelling rate of $T_{\frac{1}{2}}$ can be controlled by adding a hardening agent to a gelatin binder or changing the aging condition after coating.

The rate of swelling is preferably from 150% to 400%. The rate of swelling can be calculated by a formula of (maximum swelling layer thickness−layer thickness)/layer thickness wherein the maximum swelling layer thickness has the same meaning as defined above.

It is desired that the photographic light sensitive material of the present invention has a hydrophilic colloid layer having a total dry thickness of from 2 to 20 μm (this is called a "backing layer") on the surface opposite to that coated with the photographic emulsion layers. The backing layer preferably contains the above-described light-absorbing agent, filter dye, ultraviolet absorbent, antistatic agent, hardening agent, binder, plasticizer, lubricant, coating aid, and surfactant. The backing layer desirably has a rate of swelling of from 150 to 500%.

The color photographic light-sensitive material according to the present invention can be subjected to development processing in a conventional manner as described in *Research Disclosure*, No. 17643, pages 28 to 29, ibid., No. 18716, page 651, left column to right column, and ibid., No. 30705, pages 880 to 881, as mentioned above.

The color developing solution which can be used in development processing of the color photographic light-sensitive material according to the present invention is an alkaline aqueous solution containing preferably an aromatic primary amine color developing agent as a main component. As the color developing agent, while an aminophenol compound is useful, a p-phenylenediamine compound is preferably employed. Typical examples of p-phenylenediamine compounds include 3-methyl-4-amino-N,N-diethylaniline, 3-methyl-4-amino-N-ethyl-N-β-hydroxyethylaniline, 3-methyl-4-amino-N-ethyl-N-β-methanesulfonamidoethylaniline, 3-methyl-4-amino-N-ethyl-N-β-methoxyethylaniline, or the sulfates, hydrochlorides or p-toluenesulfonates thereof. Among these compounds, 3-methyl-4-amino N ethyl-N-β-hydroxyethylaniline sulfate is particularly preferred.

Two or more kinds of color developing agents may be employed in a combination thereof, depending on the purpose.

The color developing solution can ordinarily contain pH buffering agents, such as carbonates, borates or phosphates of alkali metals, and development inhibitors or anti-fogging agents such as chlorides, bromides, iodides, benzimidazoles, benzothiazoles, or mercapto compounds. Further, if necessary, the color developing solution may contain various preservatives, for example, hydroxylamine, diethylhydroxylamine, sulfites, hydrazines such as N,N-biscarboxymethylhydrazine, phenylsemicarbazides, triethanolamine, or catechol sulfonic acids; organic solvents such as ethyleneglycol, or diethylene glycol; development accelerators such as benzyl alcohol, polyethylene glycol, quaternary ammonium salts, or amines; dye forming couplers; competing couplers; auxiliary developing agents such as 1-phenyl-3-pyrazolidone; viscosity imparting agents; and various chelating agents representatively illustrated by aminopolycarboxylic acids, aminopolyphosphonic acids, alkylphosphonic acids, or phosphonocarboxylic acids. Representative examples of the chelating agents include ethylenediaminetetraacetic acid, nitrilotriacetic acid, diethylenetriaminepentaacetic acid, cyclohexanediaminetetraacetic acid, hydroxyethyliminodiacetic acid, 1-hydroxyethylidene-1,1-diphosphonic acid, nitrilo-N,N,N-trimethylenephosphonic acid, ethylenediamine-N,N,N,N-tetramethylenephosphonic acid, ethylenediamine-di(o-hydroxyphenylacetic acid), and salts thereof.

When reversal processing is conducted, the photographic light-sensitive material is first subjected to black-and-white development, and thereafter to color development. The black-and-white developing solution may contain known black-and white developing agents, for example, dihydroxybenzenes such as hydroquinone, 3-pyrazolidones such as 1-phenyl-3-pyrazolidone or aminophenols such as N-methyl p-aminophenol, either singly or in combination thereof.

The pH of the color developing solution or the black-and-white developing solution is usually in a range from 9 to 12. Further, the amount of replenishment for the developing solution can be varied depending on the color photographic light-sensitive materials to be processed, but is generally not more than 3 liters per square meter of the photographic light-sensitive material. The amount of replenishment can be reduced to not more than 500 ml by decreasing the bromide ion concentration in the replenisher. In reducing the amount of replenishment, it is preferred to prevent evaporation and aerial oxidation of the processing solution by means of reducing an area of a processing tank which is in contact with the air.

The contact area of a photographic processing solution with the air in the processing tank can be represented by an opening rate as defined below.

$$\text{Opening Rate} = \frac{\text{Contact area of processing solution with the air (cm}^2\text{)}}{\text{Volume of processing solution (cm}^3\text{)}}$$

The opening rate described above is preferably not more than 0.1, more preferably from 0.001 to 0.05. Means for reducing the opening rate include a method using a movable cover as described in JP-A-1-82033, a slit development processing method as described in JP-A-63-216050, in addition to a method wherein a shelter such as a floating cover is provided on the surface of a photographic processing solution in a processing tank. It is preferred to apply the reduction of the opening rate not only to the steps of color development and black-and-white development but also to all of the other following steps, for example, bleaching, bleach-fixing, fixing, washing with water and stabilizing.

Further, the amount of replenishment can be reduced using a means which restrain accumulation of bromide ion in the developing solution.

A processing time for the color development is usually selected from a range of 2 minutes to 5 minutes. However, it is possible to conduct further reduction of the processing time by performing the color development at high temperature and high pH using a high concentration of color developing agent.

After color development, the photographic emulsion layers are usually subjected to a bleach processing. The bleach processing can be performed simultaneously with a fix processing (bleach-fix processing), or it can be performed independently of the fix processing. Further, for the purpose of a rapid processing, a processing method wherein after a bleach processing, a bleach-fix processing is conducted may be employed. Moreover, it may be appropriate, depending on the purpose, to use a continuous two tank bleach-fixing bath, to carry out fix processing before bleach-fix processing, or to conduct bleach processing after bleach-fix processing.

Examples of bleaching agents which can be employed in the bleach processing or bleach-fix processing include compounds of a multivalent metal such as iron(III); peracids; quinones; or nitro compounds. Representative examples of bleaching agents include organic complex salts of iron(III), for example, complex salts of aminopolycarboxylic acids (such as ethylenediaminetetraacetic acid, diethylenetriaminepentaacetic acid, cyclohexanediaminetetraacetic acid, methyliminodiacetic acid, 1,3-diaminopropanetetraacetic acid, or glycol ether diaminetetraacetic acid), or complex salts organic acids (such as citric acid, tartaric acid, or malic acid). Of these compounds, iron(III) complex salts of aminopolycarboxylic acids, representatively illustrated by an iron(III) complex salt of ethylenediaminetetraacetic acid and an iron(III) complex salt of 1,3-diaminopropanetetraacetic acid, are preferred in view of the rapid processing and less environmental pollution that result. Furthermore, iron(III) complex salts of aminopolycarboxylic acids are particularly useful in both bleaching solutions and bleach-fixing solutions.

The pH of the bleaching solution or bleach-fixing solution containing an iron(III) complex salt of aminopolycarboxylic acid is usually in the range from 4.0 to 8. For the purpose of rapid processing, it is possible to process at a pH lower than the above described range.

In the bleaching solution, the bleach-fixing solution or a prebath thereof, a bleach accelerating agent can be used, if desired. Specific examples of suitable bleach accelerating agents include compounds having a mercapto group or a disulfide bond as described, for example, in U.S. Pat. No. 3,893,858, West German Patents 1,290,812 and 2,059,988, JP-A-53-32736, JP-A-53-57831, JP-A-53-37418, JP-A-53-72623, JP-A-53-95630, JP-A-53-95631, JP-A-53-104232, JP-A-53-124424, JP-A-53-141623, JP-A-53-28426, and *Research Disclosure*, No. 17129 (July 1978); thiazolidine derivatives as described, for example, in JP-A-50-140129; thiourea derivatives as described, for example, in JP-B-45-8506, JP-A-52-20832, JP-A-53-32735 and U.S. Pat. No. 3,706,561; iodides as described, for example, in West German Patent 1,127,715 and JP-A-58-16235; polyoxyethylene compounds as described, for example, in West German Patents 966,410 and 2,748,430; polyamine compounds as described, for example, in JP-B-45-8836; compounds as described, for example, in JP-A-49-40943, JP-A-49-59644, JP-A-53-94927, JP-A-54-35727, JP-A-55-26506, and JP-A-58-163940; and bromide ions. Of these compounds, the compounds having a mercapto group or a disulfide bond are preferred in view of their large bleach accelerating effects. Particularly, the compounds as described in U.S. Pat. No. 3,893,858, West German Patent 1,290,812 and JP-A-53-95630 are preferred. Further, the compounds as described in U.S. Pat. No. 4,552,834 are also preferred. These bleach accelerating agents may be incorporated into the color photographic light-sensitive material. These bleach accelerating agents are particularly effectively employed when color photographic light sensitive materials for photographing are subjected to bleach-fix processing.

To the bleaching solution or bleach-fixing solution, an organic acid is preferably incorporated to prevent bleach stain. Particularly preferred organic acids are compounds having an acid dissociation constant (pKa) from 2 to 5 and include specifically, for example, acetic acid, propionic acid and hydroxyacetic acid.

Fixing agents which can be employed in the fixing solution or bleach-fixing solution include thiosulfates, thiocyanates, thioether compounds, thioureas, or a large amount of iodide. Of these compounds, thiosulfates are generally employed. Particularly, ammonium thiosulfate is most widely employed. The combinations of thiosulfates with thiocyanates, thioether compounds or thioureas are also preferably employed. It is preferred to use sulfites, bisulfites, carbonylbisulfite adducts or sulfinic acid compounds as described in European Patent 294769A as preservatives in the fixing solution or bleach-fixing solution. Moreover, it is preferred to add various aminopolycarboxylic acids and a organic phosphonic acids to the fixing or bleach-fixing solution for the purpose of stabilization of the solution.

The fixing solution or bleach-fixing solution may preferably contain compounds having a pKa value of from 6.0 to 9.0, preferably imidazoles such as imidazole, 1-methylimidazole, 1-ethylimidazole or 2-methylimidazole, in an amount of from 0.1 to 10 mol/liter, for the purpose of suitably adjusting the pH value of the solution.

A shorter total time for the desilvering step is preferable as far as inferior desilvering does not occur. Thus, the processing time for the desilvering step is preferably from 1 minute to 3 minutes, more preferably from 1 minute to 2 minutes. The processing temperature is from 25° to 50° C., preferably 35° to 45° C. In the preferred processing temperature range, the desilvering rate increases and the occurrence of stain after processing is effectively prevented.

In the desilvering step, it is preferred to stir as strongly as possible.

Specific examples of methods for strengthening stirring include a method wherein a jet of the processing solution strikes against the emulsion surface of the light-sensitive material as described in JP-A-62-183460, a method for increasing stirring effect using a rotating means as described in JP-A-62-183461, a method for increasing stirring effect by transferring the light-sensitive material by bringing the emulsion surface thereof into contact with a wiper blade provided in the solution to form turbulent flow on the emulsion surface, and a method of increasing circulation flux of the total processing solution. These means for strengthening stirring are effective in the bleaching solution, the bleach-fixing solution and the fixing solution. It is believed that the strengthening of stirring promotes the supply of bleaching agent and fixing agent to the emulsion layer, resulting in the increase in the desilvering rate.

Further, the above-described means for strengthening stirring are more effective when using a bleach accelerating agent and enable remarkable increases in its accelerating effect or to eliminate fixing hindrance due to the bleach accelerating agent.

The automatic developing machine to be used for processing of the present invention is preferably provided with a transportation means for the light-sensitive material as described in JP-A-60-191257, JP-A-60-191258 and JP-A-60-191259. As described in JP-A-60-191257, such a transportation means can greatly reduce an amount of processing solution carried over from the preceding bath to the after bath and degradation of the processing solution is effectively prevented. Such an effect is particularly useful for the reduction of the processing time at each step and the reduction of the replenishment amount of the processing solution at each step.

After a desilvering step, the silver halide color photographic material according to the present invention is generally subjected to a water washing step and/or a stabilizing step.

The amount of water required for the water washing step may vary within a wide range depending on the characteristics of photographic light-sensitive materials (due to elements used therein, for example, couplers), the uses thereof, the temperature of washing water, a number of water washing tanks (stages), a replenishment system such as countercurrent or orderly current, or other various conditions. A relationship between a number of water washing tanks and an amount of water in a multi-stage countercurrent system can be determined based on the method as described in *Journal of the Society of Motion Picture and Television Engineers,* Vol. 64, pages 248 to 253 (May, 1955).

According to the multi-stage countercurrent system described in the above literature, the amount of water for washing can be significantly reduced. However, increased staying time of water in the tank causes propagation of bacteria and other problems such as adhesion of floatage formed on the photographic materials. In the method of processing the silver halide color photographic material according to the present invention, a method for reducing amounts of calcium ions and magnesium ions as described in JP-A-62-288838 can be particularly effectively employed in order to solve such problems. Further, sterilizers, for example, isothiazolone compounds and thiabendazoles as described in JP-A-57-8542, chlorine containing sterilizers such as sodium chloroisocyanurate, benzotriazoles, sterilizers as described in Hiroshi Horiguchi, *Bokin-Bobaizai No Kagaku* (Sankyo Shuppan, 1986), *Biseibutsu No Mekkin-, Sakkin-, Bobai-Gijutsu,* edited by Eiseigijutsu Kai (Kogyogijutsu Kai 1982), and *Bokin-Bobaizai Jiten,* edited by Nippon Bokin-Bobai Gakkai (1986) can be employed.

The pH of the washing water used in the processing of the photographic light-sensitive materials according to the present invention is usually from 4 to 9, preferably from 5 to 8. The temperature of the washing water and the time for a water washing step can vary depending on the characteristics or uses of photographic light-sensitive materials. However, it is generally selected from a range of from 15° C. to 45° C. and a period from 20 sec. to 10 min. and preferably a range of from 25° C. to 40° C. and a period from 30 sec. to 5 min.

The photographic light-sensitive material of the present invention can also be directly processed with a stabilizing solution in place of the above-described water washing step. In such a stabilizing process, any known methods as described, for example, in JP-A-57-8543, JP-A-58-14834 and JP-A-60-220345 can be employed.

Further, it is possible to conduct the stabilizing process subsequent to the above-described water washing process. One example thereof is a stabilizing bath containing a dye stabilizer and a surface active agent, which is employed as a final bath in the processing of color photographic light-sensitive materials for photographing. Examples of the dye stabilizers include aldehydes such as formalin or glutaraldehyde, N-methylol compounds, hexamethylenetetramine, and aldehyde sulfite adducts. To such a stabilizing bath, various chelating agents and antimolds may also be added.

Overflow solutions resulting from replenishment of the above-described washing water and/or stabilizing solution may be reused in other steps such as the desilvering step.

In the processing using an automatic developing machine, concentration of the processing solution at each step tends to occur by evaporation. In order to compensate the concentration of processing solution, it is preferred to replenish an appropriate amount of water.

For the purpose of simplification and acceleration of processing, a color developing agent may be incorporated into the silver halide color photographic material according to the present invention. In order to incorporate the color developing agent, it is preferred to employ various precursors of color developing agents. Suitable examples of the precursors of developing agents include indoaniline compounds as described in U.S. Pat. No. 3,342,597, Schiff's base type compounds as described in U.S. Pat. No. 3,342,599 and *Research Disclosure,* No. 14850 and ibid., No. 15159, aldol compounds as described in *Research Disclosure,* No. 13924, metal salt complexes as described in U.S. Pat. No. 3,719,492, and urethane type compounds as described in JP-A-53-135628.

Further, the silver halide color photographic material according to the present invention may contain, if desired, various 1-phenyl-3-pyrazolidones for the purpose of accelerating color development. Typical examples of the compounds include those as described, for example in JP-A-56-64339, JP-A-57-144547, and JP-A-58-115438.

In the present invention, various kinds of processing solutions can be employed at a temperature range from 10° C. to 50° C. Although a standard temperature is from 33° C. to 38° C., it is possible to carry out the processing at higher temperatures in order to accelerate the processing whereby the processing time is shortened, or at lower temperatures in order to achieve improvement in image quality and to maintain stability of the processing solutions.

The silver halide photographic material of the present invention may also apply to heat developable light-sensitive materials as described, for example, in U.S.

Pat. No. 4,500,626, JP-A-60-133449, JP-A-59-218443, JP-A-61-238056 and European Patent 210,660A2.

The silver halide color photographic material having at least one light-sensitive silver halide emulsion layer and containing the coupler represented by the general formula (I) or (II) and the acyl acetanilide coupler represented by the general formula (A) has high sensitivity and good stability during preservation provides a high color density and a color image of a small absorption on the longer wavelength side which has excellent color reproducibility, graininess and sharpness.

The present invention will be explained in greater detail with reference to the following example, but the present invention should not be construed as being limited thereto.

EXAMPLE 1

On a cellulose triacetate film support provided with a subbing layer was coated each layer having the composition set forth below to prepare a color light-sensitive material, which was designated Sample 101.

With respect to the compositions of the layers, the coating amounts of silver halide are shown in terms of silver coating amount in units of g/m$^2$, and those of other additives such as couplers and gelatin are shown in units of g/m$^2$.

| | |
|---|---|
| First Layer: Low-Sensitive Emulsion Layer | |
| Silver iodobromide emulsion (AgI in AgBrI: 4 mol %, internal high AgI type, diameter corresponding to sphere: 0.5 μm, coefficient of variation of diameter corresponding to sphere: 12%, octahedral grain) | 0.41 (as silver) |
| Gelatin (total) | 2.65 |
| Comparative Coupler (a) | 0.90 |
| Comparative Coupler (b) | 0.10 |
| S-6 | 0.40 |
| Second Layer: High-Sensitive Emulsion Layer | |
| Silver iodobromide emulsion (AgI in AgBrI: 10 mol %, internal high AgI type, diameter corresponding to sphere: 1.3 μm, coefficient of variation of diameter corresponding to sphere: 20%, mixture of regular crystals and twin crystals, diameter/thickness ratio: 5.5) | 0.52 (as silver) |
| Gelatin (total) | 2.00 |
| Comparative Coupler (a) | 0.12 |
| S-6 | 0.048 |
| Third Layer: Protective Layer | |
| Gelatin | 1.32 |

In the production of the above described light-sensitive material, the surface active agent shown below was used in order to prepare the coupler dispersion.

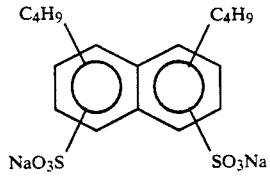

(a mixture of compounds having substituents at various positions)

Further, the surface active agent shown below as a coating aid and the compound shown below as a gelatin hardener were employed.

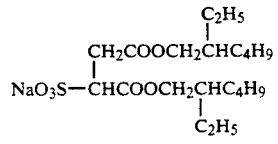

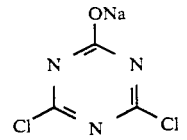

Samples 102 to 122 were prepared in the same manner as Sample 101 except for changing the couplers used in the first layer and second layer to the equimolar amount of couplers shown in Tables 1 and 2 below and adjusting a weight ratio of S-6/total couplers to 0.40.

Each of these samples thus prepared was cut into strips of 35 mm width, imagewise exposed, and processed according to the processing steps shown below using an automatic developing machine until an accumulated amount of replenisher for the color developing solution reached three times the tank capacity. Thereafter, the same sample was wedgewise exposed to white light and processed in the same manner as above.

Sample 122 resulted in the deposition of couplers and the evaluation of characteristics thereof could not be conducted because the color formation was inferior after the above described processing.

| Processing Step | Processing Time | Processing Temperature (°C.) | Amount of* Replenishment (ml) | Tank Capacity (l) |
|---|---|---|---|---|
| Color Development | 3 min. 15 sec. | 38 | 33 | 10 |
| Bleaching | 6 min. 30 sec. | 38 | 25 | 20 |
| Washing with Water | 2 min. 10 sec. | 24 | 1200 | 10 |
| Fixing | 4 min. 20 sec. | 38 | 25 | 20 |
| Washing with Water (1) | 1 min. 05 sec. | 24 | ** | 10 |
| Washing with Water (2) | 1 min. 00 sec. | 34 | 1200 | 10 |
| Stabilizing | 1 min. 05 sec. | 38 | 25 | 10 |
| Drying | 4 min. 20 sec. | 55 | | |

*Amount of replenishment per meter of a 35 mm wide strip
**Countercurrent piping system from Washing with Water (2) to Washing with Water (1)

The composition of each processing solution used is illustrated below.

| | Mother Solution | Replenisher |
|---|---|---|
| Color Developing Solution: | | |
| Diethylenetriaminepenta-acetic acid | 1.0 g | 1.1 g |
| 1-Hydroxyethylidene-1,1-diphosphonic acid | 3.0 g | 3.2 g |
| Sodium sulfite | 4.0 g | 4.4 g |
| Potassium carbonate | 30.0 g | 37.0 g |
| Potassium bromide | 1.4 g | 0.7 g |
| Potassium iodide | 1.5 mg | — |
| Hydroxylamine sulfate | 2.4 g | 2.8 g |
| 4-(N-Ethyl-N-β-hydroxy-ethylamino)-2-methylaniline sulfate | 4.5 g | 5.5 g |
| Water to make | 1.0 l | 1.0 l |
| pH | 10.05 | 10.10 |
| Bleaching Solution: | | |
| Sodium iron(III) ethylene-diamine tetraacetate tri-hydrate | 100.0 g | 120.0 g |
| Disodium ethylenediamine-tetraacetate | 10.0 g | 10.0 g |
| Ammonium bromide | 140.0 g | 160.0 g |
| Ammonium nitrate | 30.0 g | 35.0 g |
| Aqueous ammonia (27%) | 6.5 ml | 4.0 ml |
| Water to make | 1.0 l | 1.0 l |
| pH | 6.0 | 5.7 |
| Fixing Solution: | | |
| Disodium ethylenediamine-tetraacetate | 0.5 g | 0.7 g |
| Sodium sulfite | 7.0 g | 8.0 g |
| Sodium bisulfite | 5.0 g | 5.5 g |
| Aqueous solution of ammonium thiosulfate (700 g/l) | 170.0 ml | 200.0 ml |
| Water to make | 1.0 l | 1.0 l |
| pH | 6.7 | 6.6 |
| Stabilizing Solution: | | |
| Formalin (37%) | 2.0 ml | 3.0 ml |
| Polyoxyethylene-p-monononyl-phenylether (average degree of polymerization: 10) | 0.3 g | 0.45 g |
| Disodium ethylenediamine-tetraacetate | 0.05 g | 0.08 g |
| Water to make | 1.0 l | 1.0 l |
| pH | 5.0 to 8.0 | 5.0 to 8.0 |

The sample thus processed was subjected to density measurement with blue light to provide a characteristic curve, and the evaluation of characteristics was conducted as described below.

(1) Photographic Performance

A logarithm value of a reciprocal of an exposure amount necessary to provide a density of minimum density (Dmin) plus 0.2 was determined and designated sensitivity (S). A density value (D) at a point having an exposure amount (log E) of 1.5 higher than the point of sensitivity was measured. With respect to the sensitivity, a sensitivity difference (ΔS) of each sample was determined by taking the sensitivity of Sample 101 as the standard. With respect to the density, a density percent (D%) was determined by taking the density of Sample 101 as the standard.

(2) Color Image Fastness

Each sample after the processing was preserved under conditions of 80° C. and 70% RH for a period sufficient for determining the efficient difference to evaluate the color image fastness at high temperature and high humidity. After the preservation, a density at the point having a density of 1.50 measured before the preservation was measured and a color image remaining rate (%) was determined.

(3) Color Reproducibility

Each sample after the processing was subjected to density measurement with green light, a density value of a point having an exposure amount necessary for providing a yellow density of minimum density plus 1.5 was obtained, and a density difference ($\Delta D_G$) was determined by taking the density of Sample 101 as the standard. The density difference of the longer wavelength side was used as a measure for evaluating the color reproducibility of the yellow color image.

(4) Preservability of Light-Sensitive Material

Of a pair of each sample, one was preserved under conditions of 50° C. and 40% RH for 7 days and the other was preserved at 5° C. for 7 days in a refrigerator, then the pair was exposed to white light and simultaneously subjected to development processing as described above. In the same manner as described above, a logarithm value of a reciprocal of an exposure amount necessary to provide a density of minimum density plus 1.0 was measured and a difference ($\Delta S_T$) between the pair (same sample) was determined.

The results thus obtained are shown in Tables 1 and 2 below.

TABLE 1

| Sample No. | Coupler First Layer | Coupler Second Layer | Photographic Performance ΔS | Photographic Performance D (%) | Color Image Remaining Rate (%) | $\Delta D_G$ | $\Delta S_T$ |
|---|---|---|---|---|---|---|---|
| 101 (Comparison) | Comparative Coupler (a) Comparative Coupler (b) | Comparative Coupler (a) | 0.00 (standard) | 100 (standard) | 75 | 0.00 (standard) | 0.09 |
| 102 (Comparison) | Comparative Coupler (a) Comparative Coupler (c) | " | 0.00 | 100 | 81 | 0.00 | 0.09 |
| 103 (Comparison) | Comparative Coupler (a) Cited Coupler (d) | " | 0.00 | 103 | 83 | −0.01 | 0.09 |
| 104 (Comparison) | Comparative Coupler (e) Comparative Coupler (b) | Comparative Coupler (e) | −0.03 | 97 | 85 | +0.02 | 0.08 |
| 105 (Comparison) | Comparative Coupler (e) Comparative Coupler (b) | " | −0.03 | 97 | 87 | +0.02 | 0.08 |
| 106 (Comparison) | Comparative Coupler (e) Cited Coupler (d) | " | −0.03 | 100 | 88 | +0.01 | 0.07 |
| 107 (Comparison) | Comparative Coupler (e) (6) | " | −0.02 | 104 | 90 | 0.00 | 0.06 |
| 108 (Present Invention) | Comparative Coupler (e) (6) | Y-6 | +0.05 | 127 | 92 | −0.09 | 0.04 |
| 109 (Present | Y-6 Cited Coupler (d) | " | +0.05 | 129 | 94 | −0.11 | 0.04 |

TABLE 1-continued

| Sample No. | Coupler First Layer | Coupler Second Layer | Photographic Performance ΔS | Photographic Performance D (%) | Color Image Remaining Rate (%) | $\Delta D_G$ | $\Delta S_T$ |
|---|---|---|---|---|---|---|---|
| Invention) | | | | | | | |
| 110 (Present Invention) | Y-6 (6) | " | +0.05 | 131 | 96 | −0.12 | 0.03 |
| 111 (Present Invention) | Y-6 (2) | " | +0.05 | 133 | 98 | −0.13 | 0.02 |
| 112 (Present Invention) | (1) | " | +0.05 | 133 | 98 | −0.13 | 0.02 |

TABLE 2

| Sample No. | Coupler First Layer | Coupler Second Layer | Photographic Performance ΔS | Photographic Performance D (%) | Color Image Remaining Rate (%) | $\Delta D_G$ | $\Delta S_T$ |
|---|---|---|---|---|---|---|---|
| 113 (Present Invention) | Y-6 Y-32 | (1)/Y-6 = 1/1 (molar ratio) | +0.04 | 134 | 97 | −0.12 | 0.02 |
| 114 (Present Invention) | Y-6 (4) | (1)/Y-6 = 1/1 (molar ratio) | +0.04 | 133 | 98 | −0.13 | 0.02 |
| 115 (Present Invention) | Y-6 (7) | (1)/Y-6 = 1/1 (molar ratio) | +0.04 | 132 | 96 | −0.12 | 0.03 |
| 116 (Present Invention) | (1) Y-28 | (1)/Y-6 = 1/1 (molar ratio) | +0.04 | 133 | 98 | −0.13 | 0.02 |
| 117 (Present Invention) | (1) (2) | (1)/Y-6 = 1/1 (molar ratio) | +0.04 | 131 | 99 | −0.14 | 0.02 |
| 118 (Present Invention) | (1) (6) | (1)/Y-6 = 1/1 (molar ratio) | +0.04 | 130 | 97 | −0.13 | 0.03 |
| 119 (Present Invention) | (1)/Y-6 = 1/1 (molar ratio) Y-28 | (1)/Y-6 = 1/1 (molar ratio) | +0.04 | 134 | 98 | −0.13 | 0.02 |
| 120 (Present Invention) | (1)/Y-6 = 1/1 (molar ratio) (2) | (1)/Y-6 = 1/1 (molar ratio) | +0.04 | 133 | 99 | −0.14 | 0.02 |
| 121 (Present Invention) | (1)/Y-6 = 1/1 (molar ratio) (6) | (1)/Y-6 = 1/1 (molar ratio) | +0.04 | 131 | 97 | −0.13 | 0.03 |
| (Present | (molar ratio) | (molar ratio) | | | | | |
| 122 (Comparison) | Cited Coupler (f) (6) | (1)/Y-6 = 1/1 (molar ratio) | Evaluation could not be conducted because of inferior color formation due to the deposited coupler | | | | |

The structural formulae of the comparative couplers and cited couplers cited in prior arts, which are used above are shown below.

Comparative Coupler (a):
Coupler corresponding to the description of RD 18053 (1979)

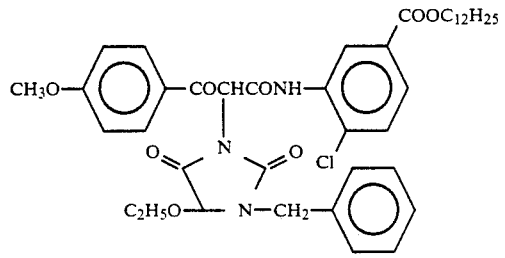

Comparative Coupler (b):
Compound (16) described in U.S. Pat. No. 4,477,563

-continued

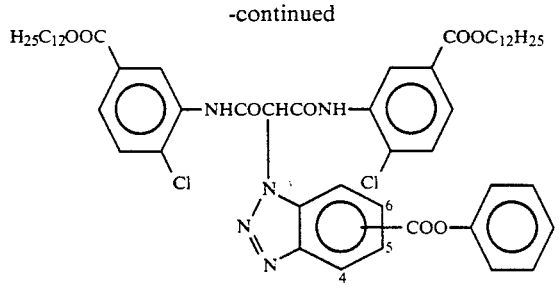

(a 1:1 mixture of compounds having the substituent at 5- or 6-position)

Comparative Coupler (c):
Compound (I-12) described in JP-A-2-250053

-continued

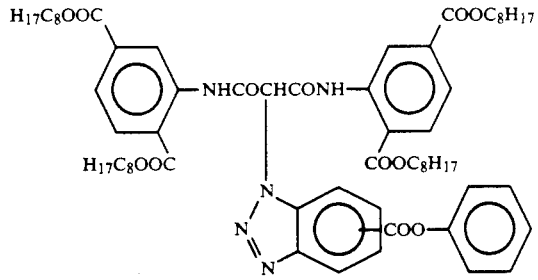

(a 1:1 mixture of compounds having the substituent at 5- or 6-position)

Cited Coupler (d):
Compound (6) described in JP-A-52-69624

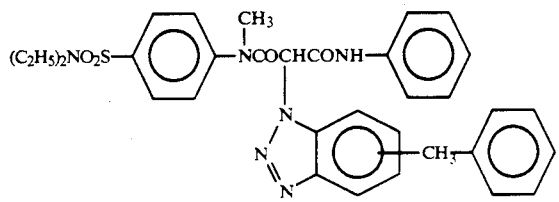

(a 1:1 mixture of compounds having the substituent at 5- or 6-position)

Comparative Coupler (e)
Compound (8) described in French Patent 1,558,452

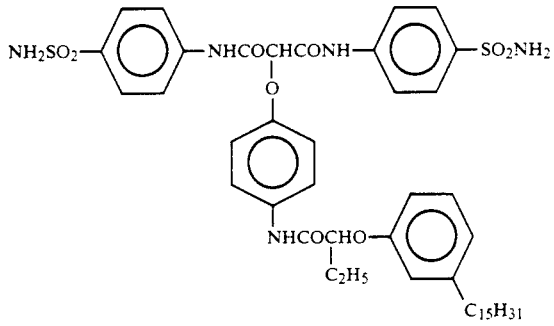

Comparative Coupler (f)
Compound (14) described in French Patent 1,558,452

-continued

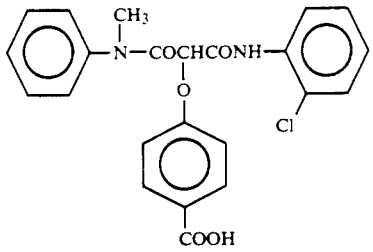

It can be seen from the results shown in Tables 1 and 2 that Samples 108 to 119 which fulfill the essential elements of the present invention exhibit excellent properties with respect to photographic performance, color image fastness, spectral absorption characteristics of color image, and preservability of light-sensitive material in comparison with Samples 101 to 107. However, in the present invention, it can be seen that the coupler should have a diffusion resistant hydrophobic group in its molecule from the result of Sample 122.

Further, it is apparent that the coupler represented by the general formula (I) or (II) is superior to Cited Couplers (d) and (e) with respect to the above described various properties from the result of mutual comparison of Samples 108 to 111 each containing the coupler of the general formula (I), the coupler of the general formula (II) or Cited coupler (d), each of which has the essential elements of the present invention. Moreover, the couplers represented by the general formula (II) are superior to the couplers represented by the general formula (I). These results can be seen from the comparison of Samples 114 and 115, Samples 117 and 118 and Samples 120 and 121.

EXAMPLE 2

Samples 201 to 218 were prepared in the same manner as Sample 101 of Example 1 except for changing the couplers used in the first layer and the second layer to the equimolar amount of couplers shown in Tables 3 and 4 below and adjusting a weight ratio of S-6/total couplers to 0.4. These samples were subjected to processing and evaluation in the same manner as described in Example 1.

The results obtained are shown in Tables 3 and 4 below.

TABLE 3

| | Coupler | | Photographic Performance | | Color Image Remaining Rate | | |
|---|---|---|---|---|---|---|---|
| Sample No. | First Layer | Second Layer | ΔS | D (%) | (%) | $\Delta D_G$ | $\Delta S_T$ |
| 201 (Present Invention) | (5) (9) | (3)/Y-5 = 1/2 (molar ratio) | +0.04 | 129 | 96 | −0.12 | 0.03 |
| 202 (Present Invention) | (8) (6) | (3)/Y-5 = 1/2 (molar ratio) | +0.04 | 129 | 96 | −0.12 | 0.03 |
| 203 (Present Invention) | (17) (7) | (3)/Y-5 = 1/2 (molar ratio) | +0.04 | 128 | 96 | −0.12 | 0.03 |
| 204 (Present Invention) | (44) (6) | (3)/Y-5 = 1/2 (molar ratio) | +0.04 | 128 | 96 | −0.12 | 0.03 |
| 205 (Present Invention) | (14) (27) | (3)/Y-5 = 1/2 (molar ratio) | +0.04 | 131 | 99 | −0.14 | 0.02 |
| 206 (Present Invention) | (1) (12) | (3)/Y-5 = 1/2 (molar ratio) | +0.04 | 131 | 99 | −0.14 | 0.02 |
| 207 (Present | (19) (34) | (3)/Y-5 = 1/2 (molar ratio) | +0.04 | 132 | 99 | −0.14 | 0.02 |

TABLE 3-continued

| Sample No. | Coupler First Layer | Coupler Second Layer | Photographic Performance ΔS | Photographic Performance D (%) | Color Image Remaining Rate (%) | $\Delta D_G$ | $\Delta S_T$ |
|---|---|---|---|---|---|---|---|
| Invention) | | | | | | | |
| 208 (Present Invention) | (43) (42) | (3)/Y-5 = 1/2 (molar ratio) | +0.04 | 132 | 99 | −0.14 | 0.02 |

TABLE 4

| Sample No. | Coupler First Layer | Coupler Second Layer | Photographic Performance ΔS | Photographic Performance D (%) | Color Image Remaining Rate (%) | $\Delta D_G$ | $\Delta S_T$ |
|---|---|---|---|---|---|---|---|
| 209 (Present Invention) | (3)/Y-5 = 1/1 (molar ratio) (33) | Y-4 | +0.05 | 133 | 99 | −0.14 | 0.02 |
| 210 (Present Invention) | (43)/Y-5 = 1/1 (molar ratio) (33) | Y-8 | +0.05 | 133 | 99 | −0.14 | 0.02 |
| 211 (Present Invention) | (10)/Y-5 = 1/1 (molar ratio) (33) | Y-9 | +0.05 | 133 | 99 | −0.14 | 0.02 |
| 212 (Present Invention) | (29)/Y-5 = 1/1 (molar ratio) (33) | Y-4 | +0.05 | 130 | 98 | −0.13 | 0.03 |
| 213 (Present Invention) | (30)/Y-5 = 1/1 (molar ratio) (33) | Y-8 | +0.05 | 130 | 98 | −0.13 | 0.03 |
| 214 (Present Invention) | (32)/Y-5 = 1/1 (molar ratio) (33) | Y-9 | +0.05 | 130 | 98 | −0.13 | 0.03 |
| 215 (Present Invention) | (15)/Y-10 = 1/1 (molar ratio) (11) | Y-11 | +0.03 | 130 | 99 | −0.14 | 0.02 |
| 216 (Present Invention) | (18)/Y-8 = 1/1 (molar ratio) (21) | Y-7 | +0.05 | 130 | 99 | −0.14 | 0.02 |
| 217 (Present Invention) | (19)/Y-9 = 2/1 (molar ratio) Y-30 | Y-14 | +0.05 | 130 | 99 | −0.13 | 0.03 |
| 218 (Present Invention) | (13)Y-15 = 1/1 (molar ratio) (45) | Y-20 | +0.04 | 128 | 98 | −0.04 | 0.02 |

From the results shown in Tables 3 and 4, it can be seen that Samples 201 to 218 according to the present invention exhibit excellent properties with respect to photographic performance, color image fastness, spectral absorption characteristic of color image and preservability of light-sensitive material in comparison with Samples 101 to 106 for comparison in Example 1. Further, it is apparent that the couplers represented by the general formula (II) are superior to the couplers represented by the general formula (I) with respect to the above described various properties from the comparison of Samples 201 to 204 with Samples 205 to 208. This is consistent with the result obtained in Example 1. Moreover, when Samples 209 to 211 are compared with Samples 212 to 214, Samples 209 to 211 exhibit better results. This fact means that among the couplers represented by the general formula (II), those of N-releasing type are superior to those of O-releasing type.

EXAMPLE 3

Samples 301 to 320 were prepared in the same manner as Sample 101 of Example 1 except for changing the couplers used in the first layer and the second layer to the equimolar amount of couplers shown in Tables 5 and 6 and also changing a weight ratio of S-6/total couplers as shown in Tables 5 and 6.

Each of these samples thus prepared was cut into strips of 35 mm width, imagewise exposed, and processed according to the processing steps shown below using an automatic developing machine until an accumulated amount of replenisher for the color developing solution reached three times the tank capacity. Thereafter, the same sample was wedgewise exposed to white light and processed in the same manner as above.

| Processing Step | Processing Time | Processing Temperature (°C.) | Amount of* Replenishment (ml) | Tank Capacity (l) |
|---|---|---|---|---|
| Color Development | 3 min. 05 sec. | 38.0 | 600 | 5 |
| Bleaching | 50 sec. | 38.0 | 140 | 3 |
| Bleach-Fixing | 50 sec. | 38.0 | — | 3 |
| Fixing | 50 sec. | 38.0 | 420 | 3 |
| Washing with Water | 30 sec. | 38.0 | 980 | 2 |

-continued

| Processing Step | Processing Time | Processing Temperature (°C.) | Amount of* Replenishment (ml) | Tank Capacity (l) |
|---|---|---|---|---|
| Stabilizing (1) | 20 sec. | 38.0 | — | 2 |
| Stabilizing (2) | 20 sec. | 38.0 | 560 | 2 |
| Drying | 1 min. | 60 | | |

*Amount of replenishment per meter of a 35 mm wide strip

The stabilizing steps were conducted using a counter-current system from (2) to (1), and the whole overflow solution of the washing water was introduced into the fixing bath. The replenishment for the bleach-fixing bath was effected by connecting an upper portion of the bleaching tank with the bottom of the bleach-fixing tank by a pipe, and connecting an upper portion of the fixing tank with the bottom of the bleach-fixing tank by a pipe in an automatic developing machine, whereby the whole overflow solution caused by supply of replenisher to the bleaching tank and fixing tank was introduced into the bleach-fixing tank. The amount of developing solution carried over to the bleaching step, the amount of bleaching solution carried over to the bleach-fixing step, the amount of bleach-fixing solution carried over to the fixing step and the amount of fixing solution carried over to the washing with water step were 65 ml, 50 ml, 50 ml and 50 ml per $m^2$ of light-sensitive material, respectively. The crossover time of each step was 5 seconds and included in the processing time for the former step.

The composition of each processing solution used is illustrated below.

| | Mother Solution | Replenisher |
|---|---|---|
| Color Developing Solution: | | |
| Diethylenetriaminepenta-acetic acid | 2.0 g | 2.2 g |
| 1-Hydroxyethylidene-1,1-diphosphonic acid | 3.3 g | 3.3 g |
| Sodium sulfite | 3.9 g | 5.2 g |
| Potassium carbonate | 37.5 g | 39.0 g |
| Potassium bromide | 1.4 g | 0.4 g |
| Potassium iodide | 1.3 mg | — |
| Hydroxylamine sulfate | 2.4 g | 3.3 g |
| 2-Methyl-4-[N-ethyl-N-(β-hydroxyethyl)amino]aniline sulfate | 4.5 g | 6.0 g |
| Water to make | 1.0 l | 1.0 l |
| pH | 10.05 | 10.15 |
| Bleaching Solution: | | |
| Ammonium iron(III) 1,3-propylenediaminetetra-acetate monohydrate | 144.0 g | 206.0 g |
| Ammonium bromide | 84.0 g | 120.0 g |
| Ammonium nitrate | 17.5 g | 25.0 g |
| Hydroxyacetic acid | 63.0 g | 90.0 g |
| Acetic acid | 54.2 g | 80.0 g |
| Water to make | 1.0 l | 1.0 l |
| pH (adjusted with aqueous ammonia) | 3.80 | 3.60 |

Bleach-Fixing Solution

A mixed solution of the above described bleaching solution (mother solution) and the fixing solution (mother solution) described below in 15:85 by volume.

| Fixing Solution: | Mother Solution | Replenisher |
|---|---|---|
| Ammonium sulfite | 19.0 g | 57.0 g |
| Ammonium thiosulfate aqueous solution (700 g/l) | 280 ml | 840 ml |
| Imidazole | 28.5 g | 85.5 g |
| Ethylenediaminetetraacetic acid | 12.5 g | 37.5 g |
| Water to make | 1.0 l | 1.0 l |
| pH (adjusted with aqueous ammonia and acetic acid) | 7.40 | 7.45 |

Washing Water: (Both Mother Solution and Replenisher)

City water was passed through a mixed bed type column filled with an H-type strong acidic cation exchange resin (Amberlite IR-120B manufactured by Rohm & Haas Co.) and an OH type strong basic anion exchange resin (Amberlite IRA-400 manufactured by Rohm & Haas Co.) to prepare water containing not more than 3 mg/l of calcium ion and magnesium ion. To the water thus-treated were added sodium dichloroisocyanurate in an amount of 20 mg/l and sodium sulfate in an amount of 150 mg/l. The pH of the solution was in a range from 6.5 to 7.5.

| Stabilizing Solution: (both mother solution and replenisher) | |
|---|---|
| Formalin (37%) | 1.2 ml |
| Sodium p-toluenesulfinate | 0.3 g |
| Polyoxyethylene-p-monononylphenylether (average degree of polymerization: 10) | 0.2 g |
| Disodium Ethylenediaminetetraacetate | 0.05 g |
| Water to make | 1.0 l |
| pH | 7.2 |

With each sample thus processed, the photographic performance, color image remaining rate and preservability of light-sensitive material ($\Delta S_T$) was evaluated in the same manner as Example 1. As to the photographic performance, a sample having the highest weight ratio of S-6/coupler among samples using the same coupler composition was taken as the standard.

The results obtained are shown in Tables 5 and 6.

TABLE 5

| Sample No. | First layer Coupler | First layer S-6/Coupler (weight ratio) | Second layer Coupler | Second layer S-6/Coupler (weight ratio) | Photographic Performance ΔS | Photographic Performance D (%) | Color Image Remaining Rate (%) | $\Delta S_T$ |
|---|---|---|---|---|---|---|---|---|
| 301 (Comparison) | Comparative Coupler (a) | 1.2 | Comparative Coupler (a) | 1.2 | 0.00 (standard) | 100 (standard) | 81 | 0.07 |

TABLE 5-continued

| Sample No. | First layer Coupler | First layer S-6/Coupler (weight ratio) | Second layer Coupler | Second layer S-6/Coupler (weight ratio) | Photographic Performance ΔS | Photographic Performance D (%) | Color Image Remaining Rate (%) | $\Delta S_T$ |
|---|---|---|---|---|---|---|---|---|
| 302 (Comparison) | Comparative Coupler (b) Comparative Coupler (a) | 1.0 | Comparative Coupler (a) | 1.0 | −0.01 | 99 | 80 | 0.07 |
| 303 (Comparison) | Comparative Coupler (b) Comparative Coupler (a) | 0.5 | Comparative Coupler (a) | 0.5 | −0.04 | 91 | 77 | 0.08 |
| 304 (Comparison) | Comparative Coupler (b) Comparative Coupler (a) | 0.35 | Comparative Coupler (a) | 0.35 | −0.07 | 87 | 75 | 0.10 |
| 305 (Comparison) | Comparative Coupler (b) Comparative Coupler (a) | 0.1 | Comparative Coupler (a) | 0.1 | −0.12 | 78 | 72 | 0.12 |
| 306 (Present Invention) | Comparative Coupler (b) Comparative Coupler (e)/Y-5 = 1/1 (molar ratio) | 1.2 | Comparative Coupler (e)/Y-5 = 1/1 (molar ratio) | 1.2 | 0.00 (standard) | 100 (standard) | 95 | 0.05 |
| 307 (Present Invention) | Comparative Coupler (e)/Y-5 = 1/1 (molar ratio) | 1.0 | Comparative Coupler (e)/Y-5 = 1/1 (molar ratio) | 1.0 | −0.01 | 99 | 95 | 0.05 |
| 308 (Present Invention) | Comparative Coupler (e)/Y-5 = 1/1 (molar ratio) | 0.5 | Comparative Coupler (e)/Y-5 = 1/1 (molar ratio) | 0.5 | −0.02 | 97 | 93 | 0.05 |
| 309 (Present Invention) | Comparative Coupler (e)/Y-5 = 1/1 (molar ratio) | 0.35 | Comparative Coupler (e)/Y-5 = 1/1 (molar ratio) | 0.35 | −0.03 | 94 | 92 | 0.06 |
| 310 (Present Invention) | Comparative Coupler (e)/Y-5 = 1/1 (molar ratio) | 0.1 | Comparative Coupler (e)/Y-5 = 1/1 (molar ratio) | 0.1 | −0.05 | 90 | 90 | 0.08 |

TABLE 6

| Sample No. | First layer Coupler | First layer S-6/Coupler (weight ratio) | Second layer Coupler | Second layer S-6/Coupler (weight ratio) | Photographic Performance ΔS | Photographic Performance D (%) | Color Image Remaining Rate (%) | $\Delta S_T$ |
|---|---|---|---|---|---|---|---|---|
| 311 (Present Invention) | Y-5 (4) | 1.2 | Y-5 | 1.2 | 0.00 (standard) | 100 (standard) | 98 | 0.02 |
| 312 (Present Invention) | Y-5 (4) | 1.0 | " | 1.0 | 0.00 | 100 | 98 | 0.02 |
| 313 (Present Invention) | Y-5 (4) | 0.5 | " | 0.5 | 0.00 | 100 | 98 | 0.02 |
| 314 (Present Invention) | Y-5 (4) | 0.35 | " | 0.35 | −0.01 | 99 | 98 | 0.02 |
| 315 (Present Invention) | Y-5 (4) | 0.1 | " | 0.1 | −0.02 | 97 | 97 | 0.03 |
| 316 (Present Invention) | (1)/Y-5 = 1/1 (molar ratio) (2) | 1.2 | (5)/Y-5 = 1/1 (molar ratio) | 1.2 | 0.00 (standard) | 100 (standard) | 99 | 0.02 |
| 317 (Present Invention) | (1)/Y-5 = 1/1 (molar ratio) (2) | 1.0 | (5)/Y-5 = 1/1 (molar ratio) | 1.0 | 0.00 | 100 | 99 | 0.02 |
| 318 (Present Invention) | (1)/Y-5 = 1/1 (molar ratio) (2) | 0.5 | (5)/Y-5 = 1/1 (molar ratio) | 0.5 | 0.00 | 100 | 99 | 0.02 |
| 319 (Present Invention) | (1)/Y-5 = 1/1 (molar ratio) (2) | 0.35 | (5)/Y-5 = 1/1 (molar ratio) | 0.35 | −0.01 | 99 | 99 | 0.02 |

TABLE 6-continued

| Sample No. | First layer Coupler | First layer S-6/Coupler (weight ratio) | Second layer Coupler | Second layer S-6/Coupler (weight ratio) | Photographic Performance ΔS | Photographic Performance D (%) | Color Image Remaining Rate (%) | $\Delta S_T$ |
|---|---|---|---|---|---|---|---|---|
| 320 (Present Invention) | (1)/Y-5 = 1/1 (molar ratio) (2) | 0.1 | (5)/Y-5 = 1/1 (molar ratio) | 0.1 | −0.01 | 98 | 98 | 0.03 |

It can be seen from the results shown in Tables 5 and 6 that Samples 306 to 320 which fulfill the essential elements of the present invention exhibit a small fluctuation of photographic performance, a small extent of degradation of color image and good preservability of raw light-sensitive material as compared with Samples 301 to 305 for comparison even when the weight ratio of high-boiling point organic solvent (S-6)/total couplers is decreased. Among the samples according to the present invention, those in which a ratio of the coupler represented by the general formula (I) or (II) used is high are superior with respect to the above described properties. As is apparent from the above results, the ratio of high-boiling point organic solvent used to coupler can be reduced according to the present invention.

EXAMPLE 4

On a cellulose triacetate film support provided with a subbing layer was coated each layer having the composition set forth below to prepare a multilayer color light-sensitive material, which was designated Sample 401.

Photographic Layer

With respect to the compositions of the layers, the coating amounts are shown in units of g/m$^2$, coating amounts of silver halide are shown in terms of silver coating amount in units of g/m$^2$, and those of the sensitizing dyes are shown as a molar amount per mol of silver halide present in the same layer.

| | |
|---|---|
| First Layer: Antihalation Layer | |
| Black colloidal silver as silver | 0.18 |
| Gelatin | 1.40 |
| Second Layer: Intermediate Layer | |
| 2,5-Di-tert-pentadecylhydroquinone | 0.18 |
| EX-1 | 0.18 |
| EX-3 | 0.020 |
| EX-12 | $2.0 \times 10^{-3}$ |
| U-1 | 0.060 |
| U-2 | 0.080 |
| U-3 | 0.10 |
| S-1 | 0.10 |
| S-6 | 0.020 |
| Gelatin | 1.04 |
| Third Layer: First Red-Sensitive Emulsion Layer | |
| Emulsion A as silver | 0.25 |
| Emulsion B as silver | 0.25 |
| Sensitizing dye I | $6.9 \times 10^{-5}$ |
| Sensitizing dye II | $1.8 \times 10^{-5}$ |
| Sensitizing dye III | $3.1 \times 10^{-4}$ |
| EX-2 | 0.17 |
| EX-10 | 0.020 |
| EX-14 | 0.09 |
| EX-8 | 0.10 |
| U-1 | 0.070 |
| U-2 | 0.050 |
| U-3 | 0.070 |
| S-1 | 0.060 |
| Gelatin (total) | 0.87 |
| Fourth Layer: Second Red-Sensitive Emulsion Layer | |
| Emulsion G as silver | 1.00 |

-continued

| | |
|---|---|
| Sensitizing dye I | $5.1 \times 10^{-5}$ |
| Sensitizing dye II | $1.4 \times 10^{-5}$ |
| Sensitizing dye III | $2.3 \times 10^{-4}$ |
| EX-2 | 0.20 |
| EX-3 | 0.050 |
| EX-10 | 0.015 |
| EX-14 | 0.10 |
| EX-9 | 0.12 |
| EX-15 | 0.050 |
| U-1 | 0.070 |
| U-2 | 0.050 |
| U-3 | 0.070 |
| Gelatin (total) | 1.30 |
| Fifth Layer: Third Red-Sensitive Emulsion Layer | |
| Emulsion D as silver | 1.60 |
| Sensitizing dye I | $5.4 \times 10^{-5}$ |
| Sensitizing dye II | $1.4 \times 10^{-5}$ |
| Sensitizing dye III | $2.4 \times 10^{-4}$ |
| EX-2 | 0.097 |
| EX-3 | 0.010 |
| EX-4 | 0.080 |
| S-1 | 0.22 |
| S-6 | 0.10 |
| Gelatin (total) | 1.63 |
| Sixth Layer: Intermediate Layer | |
| EX-5 | 0.040 |
| S-1 | 0.020 |
| Gelatin | 0.80 |
| Seventh Layer: First Green-Sensitive Emulsion Layer | |
| Emulsion A as silver | 0.15 |
| Emulsion B as silver | 0.15 |
| Sensitizing dye IV | $3.0 \times 10^{-5}$ |
| Sensitizing dye V | $1.0 \times 10^{-4}$ |
| Sensitizing dye VI | $3.8 \times 10^{-4}$ |
| EX-1 | 0.021 |
| EX-6 | 0.26 |
| EX-7 | 0.030 |
| Comparative coupler (c) | 0.30 |
| S-1 | 0.10 |
| S-23 | 0.010 |
| Gelatin (total) | 0.63 |
| Eighth Layer: Second Green-Sensitive Emulsion Layer | |
| Emulsion C as silver | 0.45 |
| Sensitizing dye IV | $2.1 \times 10^{-5}$ |
| Sensitizing dye V | $7.0 \times 10^{-5}$ |
| Sensitizing dye VI | $2.6 \times 10^{-4}$ |
| EX-6 | 0.094 |
| EX-7 | 0.026 |
| Comparative Coupler (c) | 0.022 |
| S-1 | 0.16 |
| S-23 | $8.0 \times 10^{-3}$ |
| Gelatin (total) | 0.50 |
| Ninth Layer: Third Green-Sensitive Emulsion Layer | |
| Emulsion E as silver | 1.20 |
| Sensitizing dye IV | $3.5 \times 10^{-5}$ |
| Sensitizing dye V | $8.0 \times 10^{-4}$ |
| Sensitizing dye VI | $3.0 \times 10^{-4}$ |
| EX-1 | 0.013 |
| EX-11 | 0.065 |
| EX-13 | 0.019 |
| S-1 | 0.25 |
| S-6 | 0.10 |
| Gelatin (total) | 1.54 |
| Tenth Layer: Yellow Filter Layer | |
| Yellow colloidal silver as silver | 0.050 |
| EX-5 | 0.080 |
| S-1 | 0.030 |
| Gelatin | 0.95 |

-continued

| | |
|---|---|
| Eleventh Layer: FIrst Blue-Sensitive Emulsion Layer | |
| Emulsion A as silver | 0.080 |
| Emulsion B as silver | 0.070 |
| Emulsion F as silver | 0.070 |
| Sensitizing dye VII | $3.5 \times 10^{-4}$ |
| Comparative Coupler (c) | 0.050 |
| Comparative Coupler (a) | 0.76 |
| S-1 | 0.243 |
| Gelatin (total) | 1.10 |
| Twelfth Layer: Second Blue-Sensitive Emulsion Layer | |
| Emulsion G as silver | 0.45 |
| Sensitizing dye VII | $2.1 \times 10^{-4}$ |
| Comparative Coupler (a) | 0.155 |
| EX-10 | $7.0 \times 10^{-3}$ |
| S-1 | 0.049 |
| Gelatin (total) | 0.78 |
| Thirteenth Layer: Third Blue-Sensitive Emulsion Layer | |
| Emulsion H as silver | 0.77 |
| Sensitizing dye VII | $2.2 \times 10^{-4}$ |
| Comparative Coupler (a) | 0.21 |
| S-1 | 0.063 |
| Gelatin (total) | 0.69 |
| Fourteenth Layer: First Protective Layer | |
| Emulsion I as silver | 0.20 |
| U-4 | 0.11 |
| U-5 | 0.17 |
| S-1 | $5.0 \times 10^{-2}$ |
| Gelatin (total) | 1.00 |
| Fifteenth Layer: Second Protective Layer | |
| H-1 | 0.40 |
| B-1 (diameter: 1.7 μm) | $5.0 \times 10^{-2}$ |
| B-2 (diameter: 1.7 μm) | 0.10 |
| B-3 | 0.10 |
| P-1 | 0.20 |
| Gelatin | 1.20 |

In addition to the above described components, the each of layers contained W-1, W-2, W 3, B-4, B-5, F-1, F-2, F-3, F-4, F-5, F-6, F-7, F-8, F-9, F-10, F-11, F-12, F-13, iron salt, lead salt, gold salt, platinum salt, iridium salt and rhodium salt, to improve the preservability, processability, pressure-resistance, anti-fungal properties, anti bacterial properties, anti-static properties and coatability.

The silver halide emulsion used are shown below. Silver halide in the emulsions was silver iodobromide.

TABLE 7

| Emulsion | Average AgI Content in AgBrI (%) | Average Particle Diameter (μm) | Coefficient of Variation on Particle Diameter (%) | Diameter/ Thickness Ratio | Ratio of Silver Amount (AgI Content %) |
|---|---|---|---|---|---|
| A | 4.0 | 0.45 | 27 | 1 | Double Structure Grain Core/Shell = ⅓ (13/1) |
| B | 8.9 | 0.70 | 14 | 1 | Double Structure Grain Core/Shell = 3/7 (25/2) |
| C | 10 | 0.75 | 30 | 2 | Double Structure Grain Core/Shell = ½ (24/3) |
| D | 16 | 1.05 | 35 | 2 | Double Structure Grain Core/Shell = 4/6 (40/0) |
| E | 10 | 1.05 | 35 | 3 | Double Structure Grain Core/Shell = ½ (24/3) |
| F | 4.0 | 0.25 | 28 | 1 | Double Structure Grain Core/Shell = ⅓ (13/1) |
| G | 14.0 | 0.75 | 25 | 2 | Double Structure Grain Core/Shell = ½ (42/0) |
| H | 14.5 | 1.30 | 25 | 3 | Double Structure Grain Core/Shell = 37/63 (34/3) |
| I | 1 | 0.07 | 15 | 1 | Uniform Grain |

The structural formulae of the compounds used above are shown below.

EX-1

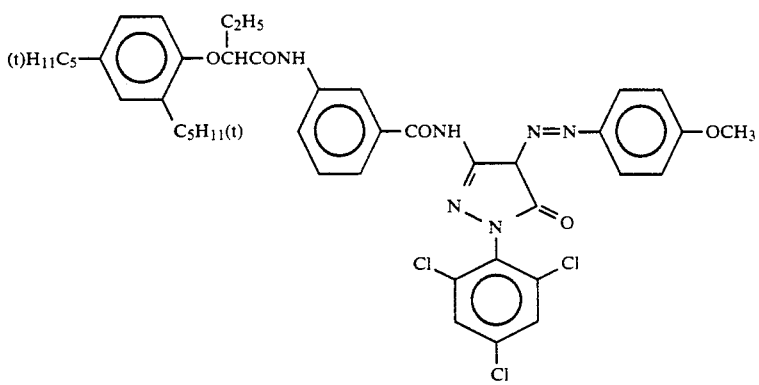

-continued
EX-2
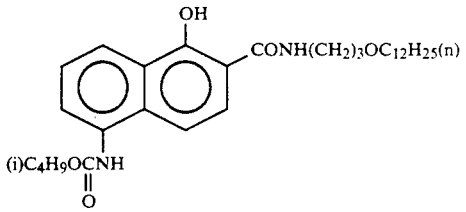
EX-3
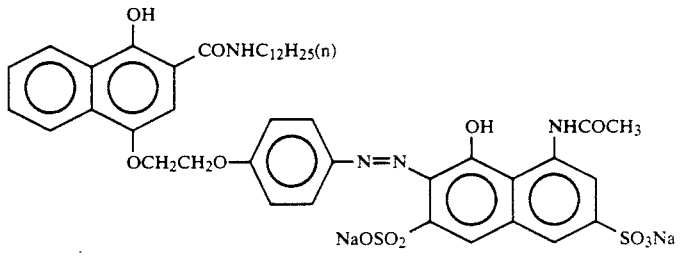
EX-4
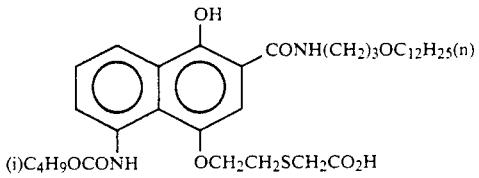
EX-5
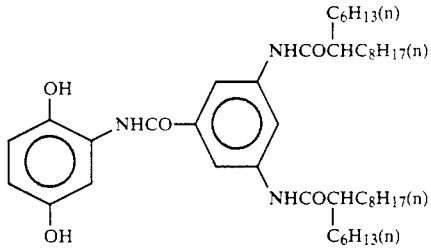
EX-6
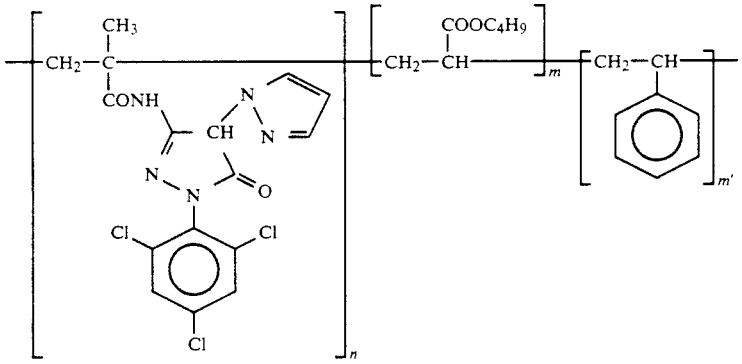
n = 50
m = 25 weight ratio
m' = 25
mol. wt. about 20,000

-continued
EX-7
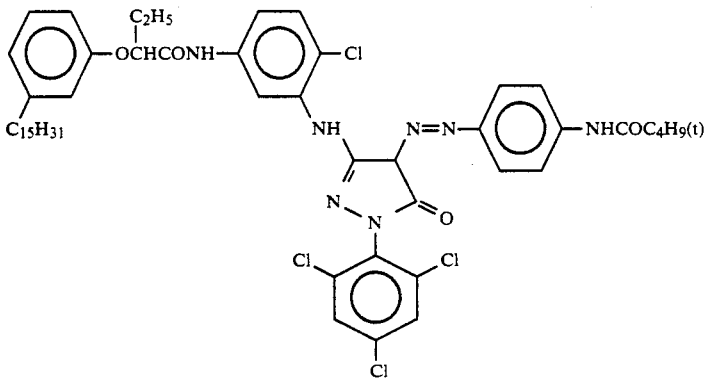
EX-8
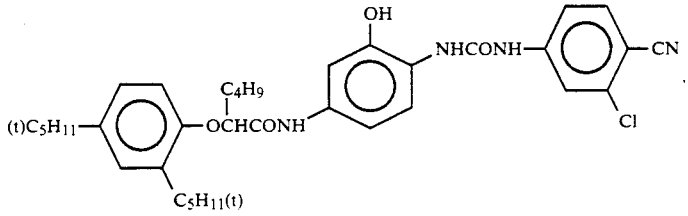
EX-9
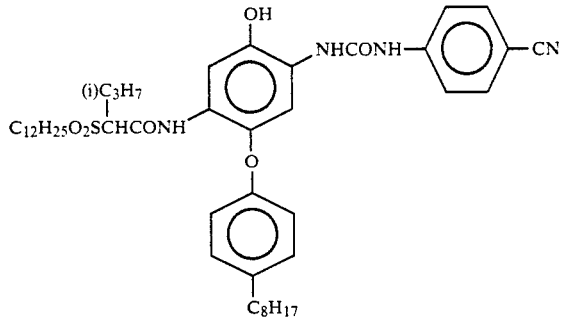
EX-10
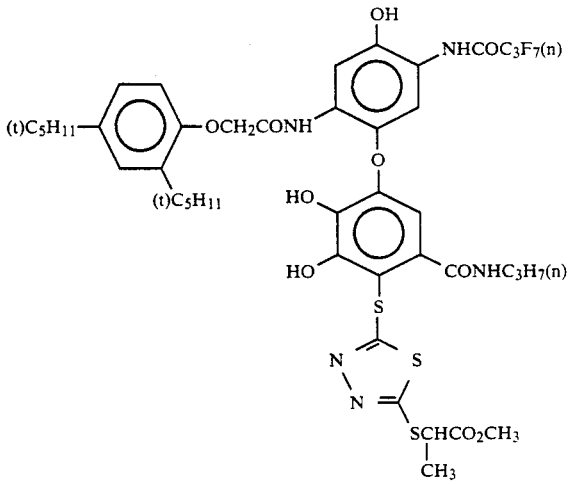

-continued
EX-11
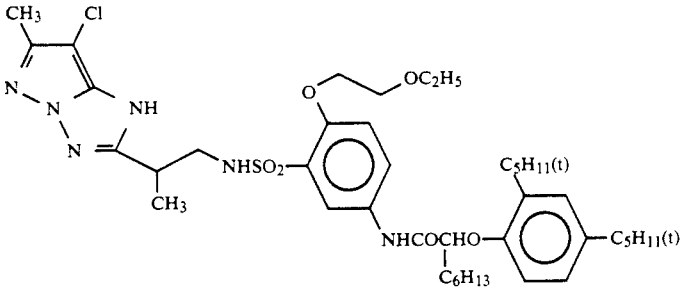
EX-12
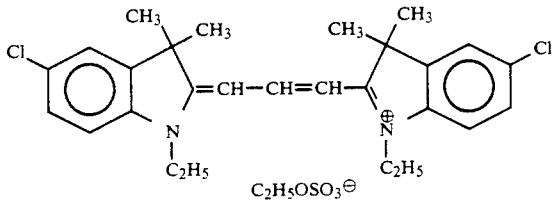
EX-13
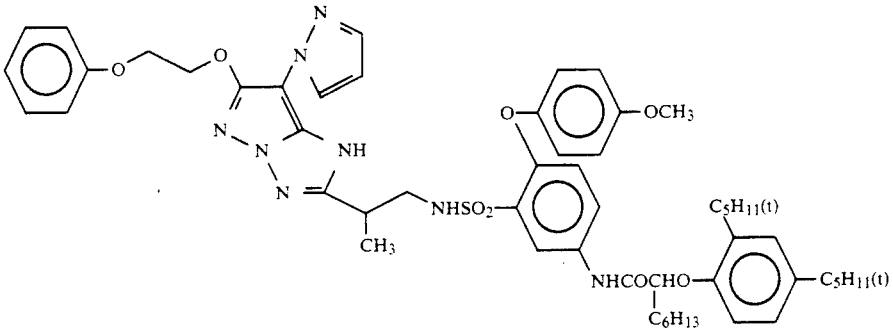
EX-14
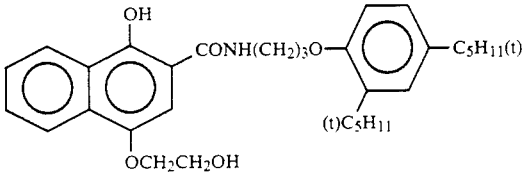
EX-15
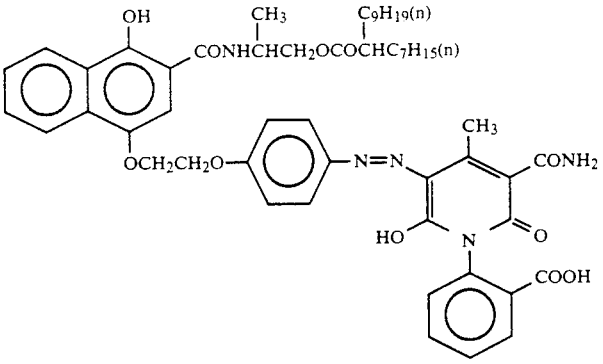
U-1
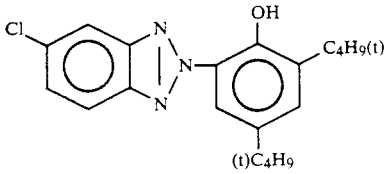

-continued
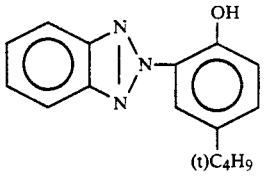
U-2
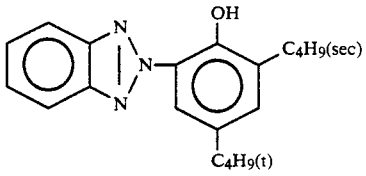
U-3
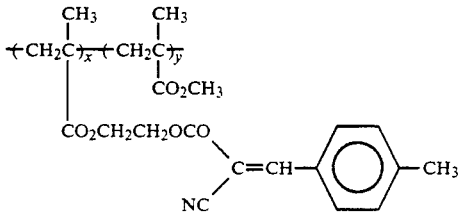
x:y = 70:30 (wt %)
U-4
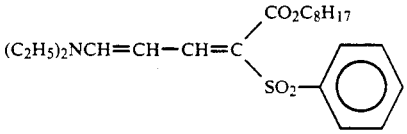
U-5
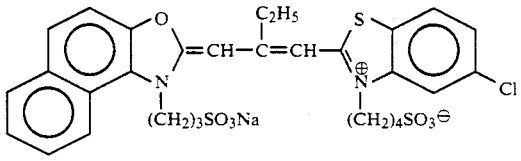
Sensitizing Dye I
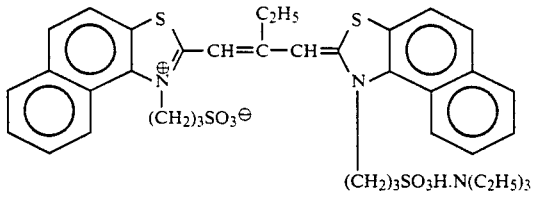
Sensitizing Dye II
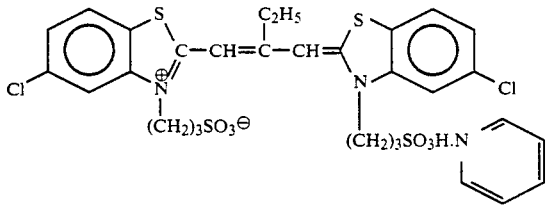
Sensitizing Dye III
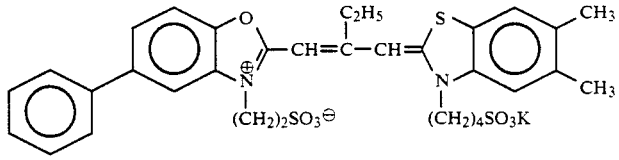
Sensitizing Dye IV -continued
Sensitizing Dye V
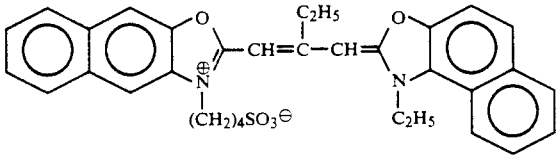
Sensitizing Dye VI
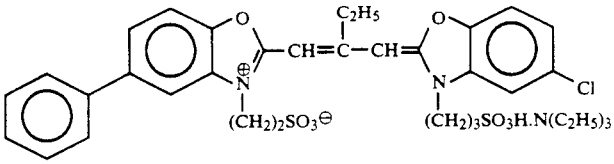
Sensitizing Dye VII
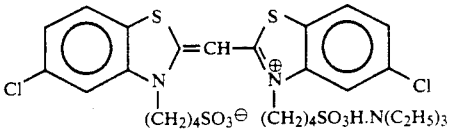
P-1
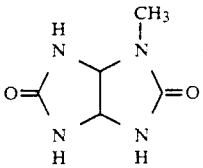
H-1
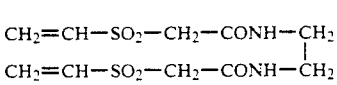
B-1
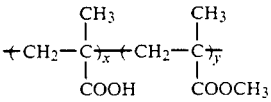
x/y = 10/90 (weight ratio)
MW: about 20,000
B-2
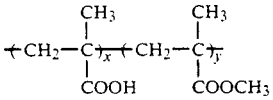
x/y = 40/60 (weight ratio)
MW: about 20,000
B-3
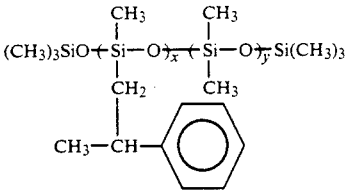
X/Y = 29/46 (weight ratio)
MW: about 10,000
B-4
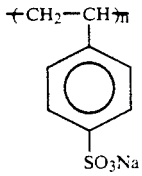
n = 200
MW: about 40,000

-continued
B-5
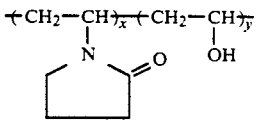
x/y = 70/30 (weight ratio)
MW: about 14,000
W-1
$C_8H_{17}SO_2NHCH_2CH_2CH_2OCH_2CH_2\overset{\oplus}{N}(CH_3)_3$
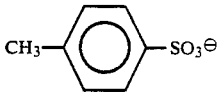
W-2
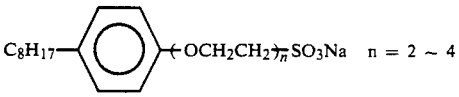
W-3
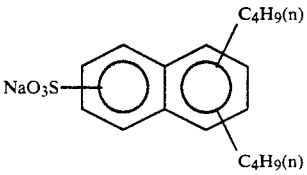
(a mixture of compounds having substituents at various positions)
F-1
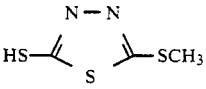
F-2
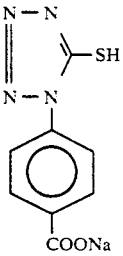
F-3
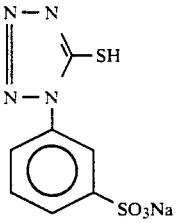
F-4
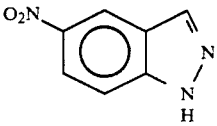
F-5
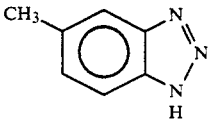
F-6
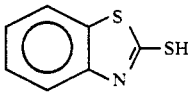

-continued

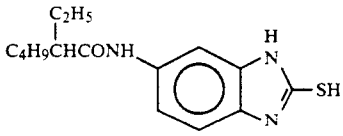

F-7

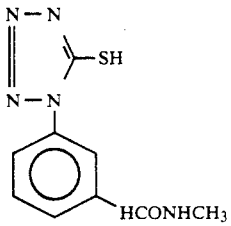

F-8

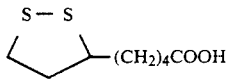

F-9

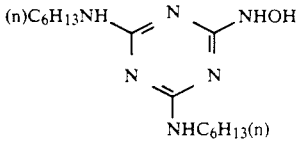

F-10

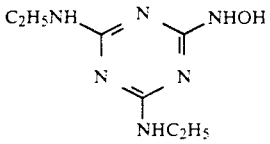

F-11

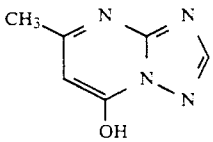

F-12

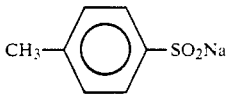

F-13

Samples 402 to 408 were prepared in the same manner as Sample 401 except for changing Comparative Coupler (a) and Comparative Coupler (c) used in the seventh and eighth green sensitive emulsion layers and the eleventh, twelfth and thirteenth blue-sensitive emulsion layers to the equimolar amount of couplers shown in Table 8 below and adjusting a weight ratio of S-1/total couplers in the eleventh to thirteenth blue-sensitive emulsion layers to 0.3.

Each of these samples was subjected to a three-color separation wedge exposure and processed in the same manner as described in Example 3. The photographic performance (ΔS and D (%)) of the yellow color image and color image remaining rates of the yellow color image and the magenta color image were evaluated in the same manner as described in Example 1. Further, graininess of the yellow image at a point having a density of the minimum density plus 1.0 was determined by the RMS value measured with a 48 μm-diameter aperture, and the sharpness of the yellow image was measured by a conventional MTF method (at 25 cycle/mm).

The results obtained are shown in Table 8 below.

TABLE 8

| Sample No. | Green-Sensitive Emulsion Layer | | Blue-Sensitive Emulsion Layer | | |
|---|---|---|---|---|---|
| | 7th Layer | 8th Layer | 11th Layer | 12th Layer | 13th Layer |
| 401 (Comparison) | Comparative Coupler (b) | Comparative Coupler (c) | Comparative Coupler (a) Comparative Coupler (c) | Comparative Coupler (a) | Comparative Coupler (a) |
| 402 (Present Invention) | (33) | (33) | Y-5 (6) | Y-5 | Y-5 |

TABLE 8-continued

| | | | | | |
|---|---|---|---|---|---|
| 403 (Present Invention) | (27) | (6) | Y-6 (2) | Y-6 | Y-6 |
| 404 (Present Invention) | Y-32 | (42) | (3)/Y-14 = 1/1 (molar ratio) Y-29 | Y-8 | Y-8 |
| 405 (Present Invention) | (21) | (12) | Y-7 Y-32 | (43)/Y-10 = 1/1 (molar ratio) | (43)/Y-10 = ⅓ (molar ratio) |
| 406 (Present Invention) | (9) | (6) | (1) (4) | (44)/Y-9 = 3/2 (molar ratio) | (44)/Y-9 = ½ (molar ratio) |
| 407 (Present Invention) | (34) | (11) | (10)/Y-9 = 1/1 (molar ratio) (9) | (29)/Y-6 = 2/1 (molar ratio) | (19)/Y-5 = ½ (molar ratio) |
| 408 (Present Invention) | (7) | (2) | (5)/Y-14 = 1/1 (molar ratio) (12) | (18)/Y-7 = ½ (molar ratio) | (17)/Y-10 = ½ (molar ratio) |

| Sample No. | Photographic Performance (yellow) ΔS | D (%) | Color Image Remaining Rate Yellow (%) | Magenta (%) | RMS (× $10^3$) | MTF (25 cycle/mm) |
|---|---|---|---|---|---|---|
| 401 (Comparison) | 0.00 (standard) | 100 (standard) | 79 | 94 | 20.3 | 52 |
| 402 (Present Invention) | 0.08 | 125 | 95 | 98 | 19.7 | 56 |
| 403 (Present Invention) | 0.08 | 127 | 97 | 98 | 19.7 | 56 |
| 404 (Present Invention) | 0.08 | 125 | 97 | 97 | 19.8 | 55 |
| 405 (Present Invention) | 0.08 | 128 | 96 | 98 | 19.9 | 55 |
| 406 (Present Invention) | 0.08 | 126 | 97 | 98 | 19.7 | 56 |
| 407 (Present Invention) | 0.08 | 127 | 97 | 98 | 19.7 | 56 |
| 408 (Present Invention) | 0.08 | 127 | 97 | 98 | 19.7 | 56 |

It can be seen from the results shown in Table 8 that Samples 402 to 408, which fulfill the essential elements of the present invention, are excellent in the photographic performance of high sensitivity and color-forming property, color image fastness, graininess and sharpness as compared with Sample 401 for comparison. Further, it is apparent that the fastness of the magenta color image is improved by incorporating a DIR coupler of the general formula (I), (II) or (A) according to the present invention into the green-sensitive emulsion layer. In addition, the graininess and sharpness of the magenta color image of Samples 402 to 408 according to the present invention are improved as compared with those of Sample 401 for comparison.

While the invention has been described in detail and with reference to specific embodiments thereof, it will be apparent to one skilled in the art that various changes and modifications can be made therein without departing from the spirit and scope thereof.

What is claimed is:

1. A silver halide color photographic material comprising a support having thereon at least one light-sensitive silver halide emulsion layer, wherein the silver halide color photographic material comprises i) a non-diffusive coupler represented by the general formula (I) or (II) described below:

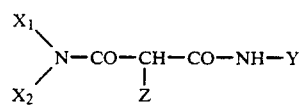

(I)

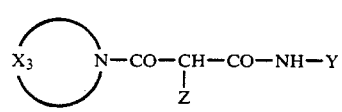

(II)

wherein $X_1$ and $X_2$ each represents an aliphatic or alicyclic hydrocarbon residue, an aryl group or a heterocyclic group; $X_3$ represents an organic moiety necessary to form a nitrogen-containing heterocyclic group together with >N—; Y represents an aryl group or a heterocyclic group; and Z represents a group capable of being released upon a reaction with an oxidation product of a developing agent; said coupler may be in the form of a dimer, a higher polymer or a bis-compound compound which is formed at $X_1$, $X_2$, $X_3$, Y or Z; ii) and an acyl acetamide coupler comprising, as an acyl group, a group represented by the general formula (A) described below:

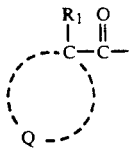

(A)

wherein $R_1$ represents a mono-valent group, and Q represents a non-metallic atomic group necessary to form a 3-membered, 4-membered or 5-membered hydrocarbon ring or a heterocyclic ring containing at least one hetero atom selected from N, 0, S and P as a ring-forming member together with C, provided that $R_1$ is not a hydrogen atom and does not combine with Q to form a ring; and said coupler may be in the form of a dimer, a higher polymer or a biscompound.

2. The silver halide color photographic material as claimed in claim 1, wherein $X_1$ and $X_2$ each represents a substituted or unsubstituted alkyl, alkenyl, cycloalkyl, cycloalkenyl, aryl group, or a heterocyclic group which is a 3-12 membered, saturated or unsaturated, substituted or unsubstituted, monocyclic or condensed heterocyclic ring having at least one hetero atom selected from the group consisting of a nitrogen atom, an oxygen atom and a sulfur atom; said heterocyclic group comprising $X_3$ and >N— is a 3-12 membered, saturated or unsaturated, substituted or unsubstituted, monocyclic or condensed heterocyclic ring which may further contain at least one hetero atom selected from a nitrogen atom, an oxygen atom and a sulfur atom; Y represents a substituted or unsubstituted aryl group or a heterocyclic group which is a 3-12 membered, saturated or unsaturated, substituted or unsubstituted, monocyclic or condensed heterocyclic ring having at least one hetero atom selected from the group consisting of a nitrogen atom, an oxygen atom and a sulfur atom.

3. The silver halide color photographic material as claimed in claim 2, wherein the substituent of said substituted groups is selected from the group consisting of a halogen atom, an alkoxycarbonyl group, an aliphatic or aromatic acylamino group, an alkyl- or aryl-sulfonamido group, a carbamoyl group, an N-alkyl- or aryl-sulfonylcarbamoyl group, a sulfamoyl group, an alkoxy group, an aryloxy group, an aryloxycarbonyl group, an N-aliphatic or aromatic acylsulfamoyl group, an alkyl- or aryl-sulfonyl group, an alkoxycarbonylamino group, a cyano group, a nitro group, a carboxy group, a hydroxy group, a sulfo group, an aliphatic or alcyclic hydrocarbonthio group, a ureido group, an aryl group, a 3- to 12-membered monocyclic or condensed heterocyclic group having at least one hetero atom selected from the group consisting of a nitrogen atom, an oxygen atom and a sulfur atom, an aliphatic or alicyclic hydrocarbyl group, an aliphatic or aromatic acyl group, an aliphatic or aromatic acyloxy group, an arylthio group, an alkyl-or aryl-sulfamoylamino group, and an N-alkyl- or aryl-sulfonylsulfamoyl amino group; these substituents (other than a halogen atom, a cyano group, a nitro group, a carboxy group, a hydroxyl group and a sulfo group) may be further substituted with at least one of said substituents.

4. The silver halide color photographic material as claimed in claim 1, wherein Z represents a nitrogen-containing heterocyclic group bonded to the coupling position through the nitrogen atom, an aryloxy group, an arylthio group, heterocyclic oxy group, a heterocyclic thio group, an aliphatic or aromatic acyloxy group, a carbamoyl oxy group, an aliphatic or alicyclic hydrocarbonthio group or a halogen atom.

5. The silver halide color photographic material as claimed in claim 1, wherein the coupler represented by the general formula (I) or (II) is a coupler represented by the following general formula (III), (IV) or (V):

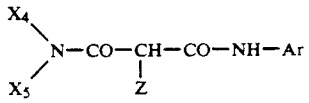

(III)

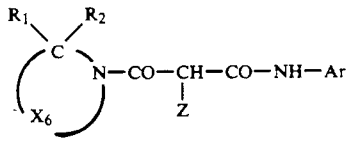

(IV)

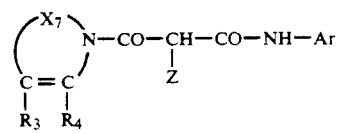

(V)

wherein Z has the same meaning as defined in the general formula (I); $X_4$ represents an aliphatic or alicyclic hydrocarbon residue; $X_5$ represents an aliphatic or alicyclic hydrocarbon residue or an aryl group; Ar represents a phenyl group having at least one substituent in the ortho positions; $X_6$ represents an organic moiety necessary to form a nitrogen-containing mono-cyclic or condensed heterocyclic group together with

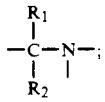

$X_7$ represents an organic moiety necessary to form a nitrogen-containing mono-cyclic or condensed heterocyclic group together with

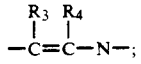

and $R_1$, $R_2$, $R_3$ and $R_4$ each represents a hydrogen atom or a substituent; and the coupler may be in the form of a dimer, a higher polymer or a biscompound which is formed at $X_4$, $X_5$, $X_6$, Ar, $R_{1-4}$ or Z.

6. The silver halide color photographic material as claimed in claim 1, wherein the acyl acetamide coupler is a coupler represented by the following general formula (Y):

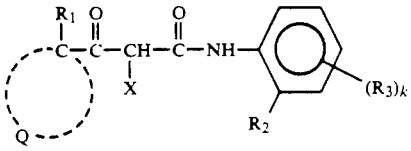

(Y)

wherein $R_1$ represents a mono-valent substituent other than a hydrogen atom; Q represents a non-metallic atomic group necessary for forming a 3-membered, 4-membered or 5-membered hydrocarbon ring or heterocyclic ring containing at least one hetero atom selected from N, S, O and P as a ring-forming member together with C; $R_2$ represents a hydrogen atom, a halogen atom, an alkoxy group, an aryloxy group, an aliphatic or alicyclic hydrocarbon residue or an amino group; $R_3$ represents a group capable of substituting on the benzene ring; X represents a hydrogen atom or a group capable of being released upon a coupling reaction with an oxidation product of an aromatic primary amine developing agent; and k represents an integer of from 0 to 4, when k represents 2 or more, two or more $R_3$'s may be the same or different; said coupler may be in the form of a dimer, a higher polymer or a biscompound which is formed at $R_1$, Q, X or

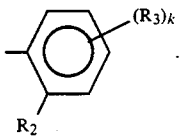

7. The silver halide color photographic material as claimed in claim 6, wherein $R_1$ represents a halogen atom, a cyano group, a substituted or unsubstituted alipahtic or alicyclic hydrocarbon residue, alkoxy group, aryl group or aryloxy group.

8. The silver halide color photographic material as claimed in claim 7, wherein the substituent of said substituted groups is selected from the group consisting of a halogen atom, an aliphatic or alicyclic hydrocarbon residue, an alkoxy group, a nitro group, an amino group, an alkyl- or aryl-carbonamido, an alkyl- or aryl-sulfonamido, and aliphatic or aromatic acyl group.

9. The silver halide color photographic material as claimed in claim 6, wherein said 3-membered, 4-membered and 5-membered hydrocarbon ring or a heterocyclic ring represented by Q is a saturated or unsaturated, unsubstituted or substituted with a substituent selected from the group consisting of a halogen atom, a hydroxy group, an aliphatic or alicyclic hydrocarbon residue, an aryl group, an aliphatic or aromatic acyl group, an alkoxy group, an aryloxy group, a cyano group, an alkoxycarbonyl group, an aliphatic or alicyclic hydrocarbon thio group and arylthio group; two of these groups may be bonded to from a hydrocarbon ring or a heterocyclic ring.

10. The silver halide color photographic material as claimed in claim 6, wherein $R_2$ represents a substituted alkoxy, aryloxy, aliphatic or alicyclic hydrocarbyl, or amino group with at least one substituent selected from the group consisting of a halogen atom, an aliphatic or alicyclic hydrocarbyl group, an alkoxy group and an aryloxy group.

11. The silver halide color photographic material as claimed in claim 6, wherein $R_3$ represents a halogen atom, an aliphatic or alicyclic hydrocarbyl group, an aryl group, an alkoxy group, an alkoxycarbonyl group, an aryloxycarbonyl group, an alkyl- or aryl-carbonamido group, an alkyl- or aryl- sulfonamido group, a carbamoyl group, a sulfamoyl group, an alkylsulfonyl group, an arylsulfonyl group, a ureido group, a sulfamoylamino group, an alkoxycarbonylamino group, an alkoxysulfonyl group, an aliphatic or aromatic acyloxy group, a nitro group, a heterocyclic group, an aliphatic or aromatic acyl group, an amino group, an imido group, an alkylsulfonyloxy group, or an arylsulfonyloxy group, a carboxy group, a sulfo group, or a hydroxy group; said groups (except a halogen atom, a nitro group, a carboxy group, a sulfo group, and a hydroxy group) may be further substituted with at least one of the above groups.

12. The silver halide color photographic material as claimed in claim 6, wherein the position of $R_3$ is the m-position or the p-position to the imino group in the general formula (Y).

13. The silver halide color photographic material as claimed in claim 6, wherein X represents a heterocyclic group bonded to the coupling active position through a nitrogen atom contained in the ring, an aryloxy group, an arylthio group, an aliphatic or aromatic acyloxy group, an alkylsulfonyloxy group, an arylsulfonyloxy group, a heterocyclic ring oxy group or a halogen atom.

14. The silver halide color photographic material as claimed in claim 1, wherein the coupler represented by the general formulae (I) or (II) is incorporated into at least one of the light-sensitive silver halide emulsion layer and a light-insensitive layer adjacent to at least one of the light-sensitive silver halide emulsion layer.

15. The silver halide color photographic material as claimed in claim 1, wherein the total amount of the coupler represented by general formula (I) or (II) added to the light-sensitive material is from 0.0001 to 0.80 $g/m^2$ when Z contains a photographically useful group.

16. The silver halide color photographic material as claimed in claim 1, wherein the total amount of the coupler represented by general formula (I) or (II) added is from 0.001 to 1.20 $g/m^2$ when Z does not contain a photographically useful group.

17. The silver halide color photographic material as claimed in claim 1, wherein the acyl acetamide coupler is incorporated into at least one of the light sensitive silver halide emulsion layer and a light-insensitive layer adjacent to at least one of the light-sensitive silver halide layer.

18. The silver halide color photographic material as claimed in claim 1, wherein the acyl acetamide coupler added to the light-sensitive material is from $1\times10^{-3}$ to 1.2 $g/m^2$.

19. The silver halide color photographic material as claimed in claim 1, wherein the silver halide color photographic material further contains a high-boiling point organic solvent, in an amount so that a weight ratio of the total amount of the high-boiling point organic solvent to the total amount of the coupler represented by the general formula (I) and/or (II) and the acyl acetamide coupler containing the acyl group represented by (A) contained in the same layer is not more than 1.0.

* * * * *